US005108459A

United States Patent [19]

Sasakura et al.

[11] Patent Number: 5,108,459

[45] Date of Patent: Apr. 28, 1992

[54] FINISHING AGENT FOR CELLULOSIC MATERIALS AND METHOD FOR TREATING CELLULOSIC MATERIALS WITH AQUEOUS SOLUTION OF AGED PHOSPHORIC ACID AMIDE FOR AGED AMIDOPHOSPHAZENE

[75] Inventors: Tadao Sasakura, Saitma; Yasuyuki Anasako, Itami; Yoshiyuki Hayashi, Otsu, all of Japan

[73] Assignee: Nitto Boseki Co., Ltd., Fukushima, Japan

[21] Appl. No.: 517,579

[22] Filed: May 1, 1990

Related U.S. Application Data

[63] Continuation-in-part of Ser. No. 473,655, Feb. 1, 1990, abandoned, which is a continuation of Ser. No. 299,266, Jan. 23, 1989, abandoned.

[30] Foreign Application Priority Data

| | | | |
|---|---|---|---|
| Jan. 29, 1988 | [JP] | Japan | 63-19077 |
| May 26, 1988 | [JP] | Japan | 63-128883 |
| May 30, 1988 | [JP] | Japan | 63-132252 |
| Oct. 6, 1988 | [JP] | Japan | 63-252327 |
| Oct. 6, 1988 | [JP] | Japan | 63-252328 |

[51] Int. Cl.[5] ..... D06M 13/44; D06M 13/45; D06M 101/06

[52] U.S. Cl. ..... 8/127.1; 8/181; 8/194; 8/115.64; 252/8.6; 252/8.8

[58] Field of Search ..... 8/127.1, 181, 194; 252/8.8

[56] References Cited

U.S. PATENT DOCUMENTS

| | | | |
|---|---|---|---|
| 2,661,264 | 12/1953 | Malowaw | 8/127.1 |
| 2,782,133 | 2/1957 | Valette | 428/289 |
| 3,068,060 | 12/1962 | Emmons et al. | 8/194 |

FOREIGN PATENT DOCUMENTS 47-045636 11/1972 Japan .

OTHER PUBLICATIONS

C. E. Morris and L. H. Chance, Textile Research Journal, 1973, 43, (No. 6), pp. 336–341.

P. I. Isaacs et al., Textile Research Journal, 1974, 44, (No. 9), pp. 700–707.

*Primary Examiner*—A. Lionel Clingman

*Attorney, Agent, or Firm*—Darby & Darby

[57] ABSTRACT

The present invention provides a treating agent for cellulosic materials such as fabrics which is mainly composed of an aqueous solution of an aged phosphorus amide compound or an aged amidophosphazene compound. The cellulosic materials treated with this treating agent has a soft hand and is very low in skrinkage after repeated washings and is high in resistance against staining with fluorescent dye contained in detergents, dyes released from other dyed fiber articles during washing and human blood, soy sauce, Worcester sauce, Coca-Cola and the like.

11 Claims, 42 Drawing Sheets

FINISHING AGENT FOR CELLULOSIC MATERIALS AND METHOD FOR TREATING CELLULOSIC MATERIALS WITH AQUEOUS SOLUTION OF AGED PHOSPHORIC ACID AMIDE FOR AGED AMIDOPHOSPHAZENE

RELATED U.S. APPLICATION DATA

This application is a continuation-in-part application of Ser. No. 473,655 filed on Feb. 1, 1990, which is a continuation application of Ser. No. 299,266 filed on Jan. 23, 1989, both now abandoned.

BACKGROUND OF THE INVENTION

This invention relates to a treating agent for cellulosic materials, especially cellulosic fabrics and a method for treatment using the treating agent.

As treating agents for preventing shrink of cellulosic fabrics during repeated washing, aminoplast resins have been sold. However, fabrics treated with such treating agent sometimes cause skin troubles when people have them in wear due to liberated formaldehyde. Recently, non-formaldehyde type resins have been sold to avoid the skin troubles, but they are poor in effect to prevent the shrink which occurs during repeated washing. Thus, there have not yet been established techniques on non-formaldehyde type treating agents and treating method which can provide cellulosic materials soft in hand and very small in shrinkage during repeated washings.

On the other hand, phosphorus amide compounds sold as treating agents, e.g., Lot No. HC-15, Lot No. HC-16 and Lot No. HC-18R (manufactured by Nippon Soda Co., Ltd.) suffer from the problem of hard hand of the resulting products.

Further, Morris et al disclose a technique for improvement of crease recovery and impartment of flameproofness by using phosphoryl triamide and derivatives of phosphoryl triamide, amide group of which is substituted with chloromethyl or alkylamine. (Tex. Res. J., 44, pages 700–707, '74). Moreover, P. Issacs et al disclose flameproofing method using phosphorus amide, phosphorus amide condensate and derivatives of these amides, amide group of which is substituted with alkoxy or lower alkylamine. (Tex. Res. J., 43, pages 336–341, '73). William D. Emmons (U.S. Pat. No. 3,068,060) disclose a method of treatment for increasing dimensional stability in washing by using a phosphoryl triamide derivative of the formula (1): $XP(O)(NH_2)_2$ (1) [wherein X is —$NHR^0$

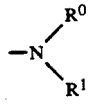

(wherein $R^1$ and $R^0$ are alkyl groups of $C_1$–$C_4$)].

However, none of these techniques use aged aqueous solution of phosphorus amide compound and thus, none of them disclose treatine agents mainly composed of such aged aqueous solution, treating method using the treating agents and fabrics obtained by the treating method.

On the other hand, with reference to amidophosphazene compounds, Japanese Patent Kokoku No. 47-45636 discloses a process for preparation of a solution of said compounds in ammonia water. Furthermore, U.S. Pat. No. 2,782,133 discloses method for flameproofing of cellulosic materials, especially cellulosic fabrics with amidophosphazene compounds and the results thereof. However, none of them use aged amidophosphazene compounds. The cellulosic fabrics treated with the substances disclosed in the above U.S. Pat. become hard and this is a defect. Further, AA-1000A type (manufactured by Nippon Soda Co., Ltd.) which is a commercially available amidophosphazene compound gives hard hand to the treated products.

Further, when cellulosic fiber products are washed with commercially available detergents, the fiber products are dyed with fluorescent dye contained in the detergents, resulting in discoloration of fiber products. This is the problem of staining. The discoloration is great especially for fiber products of light color. Furthermore, when washing is effected together with fiber product inferior in color fastness, the dye in the fiber product leaches into washing solution to dye other fibrous products or other fiber product is dyed at the portion which contacts with the fiber product inferior in color fastness. These problems become significant in use of the fiber products. There are also many problems in domestic and industrial washing with reference to stains of fabrics due to blood, soy sauce, Worcester sauce, ketchup, Coca-Cola and black tea. Washes stained with blood are selected and taken out and subjected to special washing in linen supplying business.

In order to solve these problems of staining, there are (1) a method to prevent staining of cellulosic fiber by water-repelling treatment or water-repelling and oil-repelling treatment and (2) a method to prevent staining by fixing a cationic type fluorescent dye breaking agent onto cellulosic fiber with a formalin-containing cellulose reactive resin against staining with fluorescent dyes a proposed in Japanese Patent Kokai (Laid-Open Publn) No. 62-170590. However, according to the method (1), water absorption property inherently possessed by cellulosic fiber is lost and thus, such cellulosic fiber is not suitable for uses which require water absorption property, for example, for comfortable cloth. According to the method (2), hand of cellulosic fiber product becomes hard and besides there are problems caused by free formalin. Further problem is that shrink is increased due to repetition of washing.

In general, treating solutions prepared by blending resins, flameproofing agents or catalysts which are used for subjecting fabrics to resin treatment or flameproofing treatment form precipitate due to condensation of resin or flameproofing agent with increase of temperature or fabrics treated with such treating solutions cannot have the desired properties or hand of the treated fabrics becomes firm. Therefore, such treating solution is used for treatment of fabrics immediately after preparation thereof or if treatment is one which requires long time, the treating solution is prepared in parts, so that the solutions are not left to stand for a long time. It is well known that the treating solution should be kept at low temperatures and be rapidly used or if the treatment requires a long time, the solution prepared in parts and each of them is rapidly used. Seiichiro Matsuzaki's "Resin Treatment of Fabric" (published from Maruzen Co. on Nov. 5, 1955) mentions in page 116, lines 22–24 on use of urea-formaldehyde that a treating bath prepared using ammonium salt as a catalyst generally keeps transparency for 4–6 hours at 38° C. and for further prolonging the life, ice is added to the bath to keep temperature of the bath at lower than 20° C. This indicates that life of treating bath is about 4–6 hours at 38° C. This is supported by the disclosures in "Resins for Fiber Treatment" (Dainippon Ink & Chemical Co. and Japan Reichold Co.), namely, on melamine resin, "When a mixed solution containing a catalyst is left to stand for a long time (more than about 10 hours) at high temperatures of higher than 30° C., sometimes water-insoluble materials are produced. When it is used over a long time, the solution is prepared dividedly in several times or the temperature of the solution must be kept at 10°–25° C." (page 67, lines 6–8) and, on water-soluble polymers, "When temperature of treating solution is high, especially in case of reactive silicone emulsion, it reacts with water to produce hydrogen gas and besides the solution becomes unstable and hence the treating solution must be kept at 10°–25° C." (page 68, lines 6–5 from the bottom).

As mentioned above, the longer the time for which the solution is left to stand is, the more the demerits are caused in state of the treating solution and properties of the treated fabric and hence the treating solution is used within several hours after preparation and is not left to stand for longer than 10 hours. U.S. Pat. No. 3,068,060 (Emmons), U.S. Pat. No. 2,782,133 (Vallette), U.S. Pat. No. 2,661,264 (Malowan), Japanese Patent Kokoku (Post Exam. Publn.) No. 47-45636, Morris's "Textile Research J.", 1973, 43, (No. 6), (pages 336–341) and Issacs's "Textile Research J.", 1974, 44 (No. 9), (pages 700–707) all do not disclose or suggest that shrink resistance with resistance to washing and excellent soft hand can be imparted to treated fabrics by using a treating solution which has been kept for a long time after preparation and which has showed a specific change therein.

SUMMARY OF THE INVENTION

The object of this invention is to provide a non-formaldehyde treating agent for cellulosic materials which is free from the above mentioned problems seen in the conventional techniques and can impart soft hand to the treated products, can provide cellulosic materials very low in shrinkage when they are repeatedly washed and can prevent staining with fluorescent dyes contained in detergents, dyes released from dyed fiber products during washing and human blood, soy sauce, Worcester sauce, Coca-Cola, etc., a treating method using said treating agent and cellulosic materials obtained by treating with said treating agent.

BRIEF DESCRIPTION OF THE DRAWINGS

FIGS. 32–37 are graphs which show that the absorptions of peak A and peak B do not occur in NMR curves when in general resin treatment, treating solution is kept within the general longest time of 10 hours of from preparation to use thereof.

FIGS. 38–42 are NMR curves of unaged amidophosphazene compound and unaged phosphorus amide compound.

DESCRIPTION OF THE INVENTION

Figure 1:
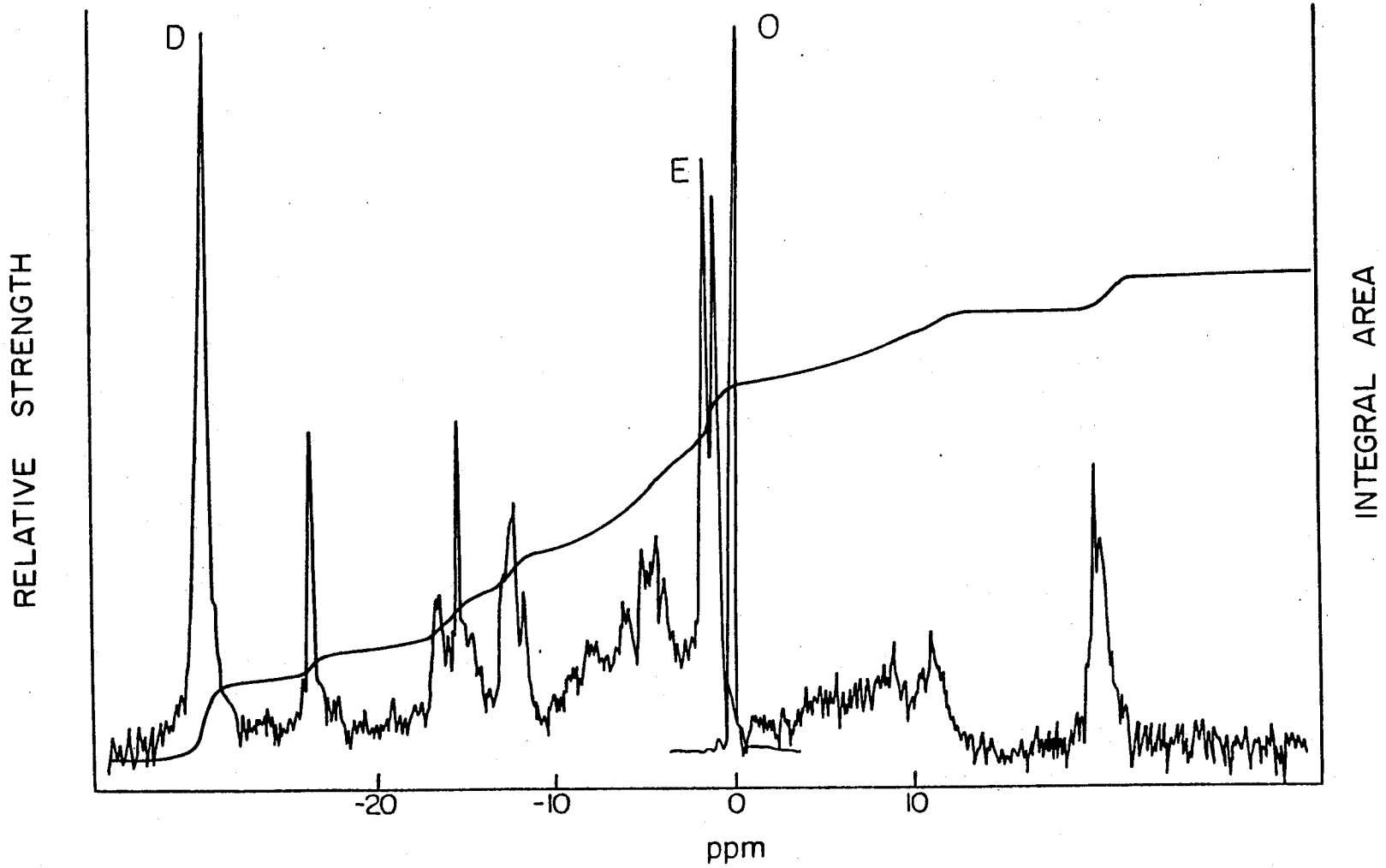
FIGS. 1–42 are graphs which show NMR curves of the treating agents of the present invention and comparative treating agents.

As a result of the inventors' intensive researches in an attempt to develop treating agents of non-formaldehyde type for obtaining cellulosic materials, especially cellulosic fabrics soft in hand, very low in shrinkage when they are repeatedly washed and can prevent staining with fluorescent dyes contained in detergents, dyes release from dyed fiber products during washing and human blood, soy sauce, Worcester sauce, Coca-Cola, etc., and method for treatment, it has been found that the above objects can be attained by using an aged aqueous solution of a phosphorus amide compound or an amidophosphazene compound as the treating agent.

That is, gists of this invention are as follows.

(1) A treating agent for cellulosic materials which is mainly composed of an aged aqueous solution of a phosphorus amide compound or an amidophosphazene compound.

(2) A method for treating cellulosic materials which comprises applying an aged aqueous solution of a phosphorus amide compound or an amidophosphazene compound to cellulosic materials and then heat treating the materials.

(3) A cellulosic material obtained by applying an aged aqueous solution of a phosphorus amide compound or an amidophosphazene compound thereto and then heat treating the materials.

The term "an aqueous solution of an aged phosphorus amide compound or an aged amidophosphazene compound" used herein means an aqueous solution of amidophosphazene or phosphorus amide which shows peaks at both about −24 ppm and about −16 ppm in NMR absorption spectrum in NMR measurement (the peak at about −24 ppm and the peak at about −16 ppm are hereinafter referred to as "peak A" and "peak B", respectively) and in which total amount of the peak A and the peak B measured by a method of obtaining integral area curve in NMR measurement is 15% or more.

Method for NMR measurement of 31P of the phosphorus amide and amidophosphazene used in the present invention and method for measurement of total amount of peak A and peak B are shown below.

Method for measurement of NMR of 31P

Unaged or aged phosphorous amide or amidophosphazene is dissolved in heavy water and the resulting aqueous solution is subjected to measurement by VARIAN FT-80 NMR SPECTROMETER equipped with a multinuclear apparatus using an NMR tube of 5 mm in a constant temperature chamber (25–27° C.). Absorption spectrum is indicated by negative value for that of low magnetic field side, using 85% phosphoric acid as an external standard. The absorption position moves depending on concentration, composition and pH of the aqueous solution to be measured, but peak A and peak B appear at about −24 ppm and about −16 ppm, respectively. However, peak C of amidophosphazene moves by several ppm (See, FIG. 13 and FIG. 14).

Method for measurement of total amount of peak A and peak B

The absorption spectrum obtained in the above measurement of 31P is processed by integrator and from the resulting integral area curve, area ratio of peak A to total area of sample and area ratio of peak B to total area of sample are obtained as content (%) of P and sum of these contents of P is shown as total content (%) of peak A and peak B.

In order to make aqueous solution of amidophosphazene or phosphorus amide into an aged composition which shows peak A and peak B, the aqueous solution must be treated in interrelation with kind of aqueous solution (e.g., water alone, aqueous ammonia solution, aqueous phosphoric acid solution, and aqueous oxalic acid solution), temperature or time (this treatment is called "aging treatment" in the present invention). For example, an aqueous solution which is prepared by dissolving amidophosphazene or phosphorus amide in merely water at a concentration of 400 g/l and which has been left to stand at 26° C. for 10 hours (in usual resin treatment, leaving for more that 10 hours is not effected because of demerits such as condensation of the resin) does not show peak A and peak B in NMR absorption spectrum (FIG. 35 and FIG. 37) while peak A and peak B appear in FIG. 9 where phosphorus amide was dissolved merely in water at a concentration of 400 g/l and the aqueous solution was treated at 20° C. for 2 days and in FIG. 15 or FIG. 16 where amidophosphazene was dissolved in 14% aqueous ammonia at a concentration of 400 g/l and this aqueous solution was treated at 50° C. for 6 hours or 12 hours, and it can be seen from integral area curve that total amount of peak A and peak B was 15% or more. Accordingly, the above aqueous solution treated at 26° C. for 10 hours is not the aged aqueous solution of the present invention while the above aqueous solutions treated at 20° C. for 2 days and at 50° C. for 12 hours are the aged aqueous solutions of the present invention. Furthermore, as is clear from comparison of FIG. 32 and FIG. 34, when amidophosphazene, as it is, is merely left to stand for a long time (in the above figure, about 2 years), the advantageous effect of aging according to the present invention cannot be obtained. Thus, the aged aqueous solution of the present invention is not determined merely by temperature or time, but is determined by mutual relation of respective elements and as a result, aqueous solution which shows peak A and peak B, total amount of which is 15% or more is the aged aqueous solution of the present invention.

Outline of the process for preparation of Lot No. HC-15 (manufactured by Nippon Soda Co., Ltd.) (FIG. 42) which is the phosphorus amide compound used in the present invention is explained below.

About 67 parts of phosphorus oxychloride is charged in an autoclave and diluted by adding about 720 parts of monochlorobenzene and then liquid ammonia is gradually added thereto with stirring and cooling the autoclave to allow the reaction to proceed, followed by stirring for several hours. Thereafter, excess ammonia is removed and product is collected by filtration and dried under reduced pressure. The product is a condensate of monomer and dimer and the higher having $[OP(NH_2)_3]$as a basic structure and a mixture of linear an cyclic compounds. Amount of the resulting product is about 108 parts and purity of the product is about 37% by weight with about 63% by weight of ammonium chloride. This reaction product is called crude phosphorus amide compound (containing by-produced ammonium chloride as it is). The crude phosphorus amide compound in the present invention means a reaction product of phosphorus oxychloride and ammonia which has not been purified. Furthermore, in the present invention, the crude phosphorus amide compound can be purified to increase content of phosphorus amide. For example, Lot No. HC-16 (purity 62.8%, ammonium chloride 7.2%) and Lot No. HC-18R (purity 61.0%, ammonium chloride 39.0%) (manufactured by Nippon Soda Co., Ltd.) are products obtained by further purifying crude products prepared by the process for production of Lot No. HC-15R.

The phosphorus amide compound used in this invention includes one or more of phosphoryl triamide $[OP(NH_2)_3]$, a phosphoryl triamide condensate and an amido substituted derivative of said phosphoryl triamide or phosphoryl triamide condensate, namely, said phosphoryl triamide or phosphoryl triamide condensate the amido group of which is substituted with other substituent.

As examples of the phosphorus amide condensates, mention may be made of imidodiphosphoryl tetraamide $NH(PO)_2(NH_2)_4$ which is a condensate of two molecules of phosphoryl triamide from which one molecule $NH_3$ is released, diimidotriphosphoryl pentaamide $(NH)2(PO)_3(NH_2)_5$ which is a condensate of three molecules of phosphoryl triamide from which two molecules of $NH_3$ are released, similarly, condensates of four molecules, five molecules and six molecules of phosphoryl triamide, etc.

The amido substituted derivatives include phosphoryl triamide and phosphoryl triamide condensate, a part of the amido groups of which is substituted with an alkoxy group, a substituted amino group, an ammoniumoxy group, a hydroxyl group or chlorine, for example, the following groups:

$-OCH_3$, $-OC_2H_5$, $-OC_3H_7$, $-OC_4H_9$, $-OC_5H_{11}$,

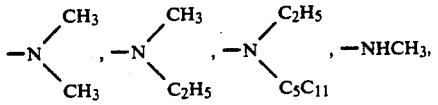

$-NHCH_3$, $-NHC_2H_5$, $-ONH_4$, $-OH$ and $-Cl$.

The amido substituted derivatives further include those which contain a small amount of unreacted —Cl group and those which contain OH resulting from hydrolysis of said unreacted Cl group. In production of the phosphorus amide compound, ammonium chloride ($NH_4Cl$) is by-produced and this ammonium chloride may be contained in the phosphorus amide compound in this invention.

Structural formulas of phosphorus triamide and those of phosphorus triamide condensate are shown below.

Phosphorus triamide

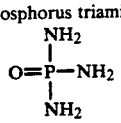

Phosphorus triamide condensate
Two molecule condensate

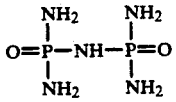

Three molecule condensate

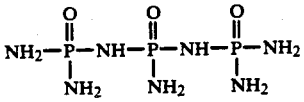

Four molecule condensate

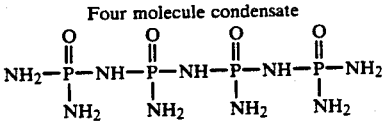

-continued

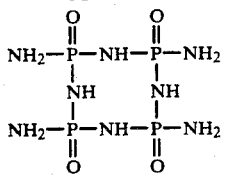

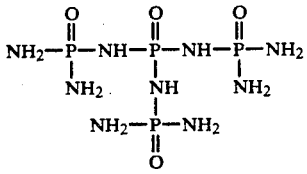

Five molecule condensate

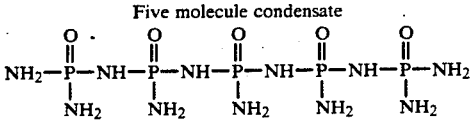

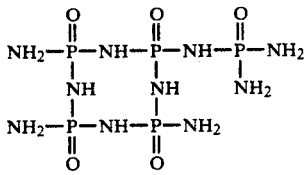

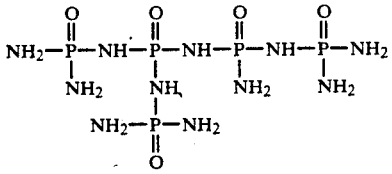

Six or more molecule condensates can be considered similarly.

The amidophosphazene compounds used in this invention include, for example, cyclic amidophosphazene compounds represented by the formula

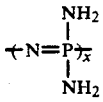

(1) (wherein x denotes an integer of 3 or more provided that the compound can be perfectly dissolved in water) and linear amidophosphazene compounds represented by the formulas: $P_nN_n(NH_2)_{2n+2}$ (wherein n is an integer of 1 or more provided that the compound can be perfectly dissolved in water) (2) and $P_nN_{n-1}(NH_2)_{2n+3}$ (wherein n is an integer of 2 or more provided that the compound can be perfectly dissolved in water) (3). A part of the amido group in the formula (1), (2) and (3) may be substituted with unsubstituted chloro group, hydroxyl group resulting from hydrolysis, alkoxy group such as methoxy or ethoxy, phenoxy group, monolower alkylamino group, di-lower alkylamino group, or the like. Examples of cyclic amidophosphazenes are shown below.

x = 3

-continued

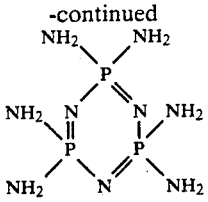

x = 4

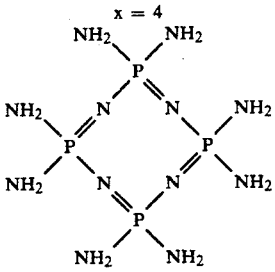

x = 6

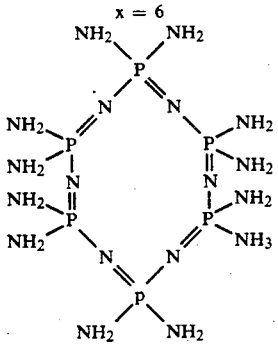

As typical examples of the amidophosphazene compound, mention may be made of AA-1000AGB-0345, AA-1000AGJ-006, AA-1000AGJ-007 and AA-1000AGJ-008 which manufactured by Nippon Soda Co., Ltd.

Outline of the process for preparation of amidophosphazene used in the present invention is explained using Lot No. AA-1000A manufactured by Nippon Soda Co., Ltd.

About 100 parts of chlorophosphazene oligomer (a mixture composed of cyclic trimer: about 50% by weight; cyclic tetramer: about 20% by weight; and other chlorophosphazene: about 30% by weight) prepared from phosphorus pentachloride and ammonium chloride by conventional method is dissolved in about 400 parts of monochlorobenzene and ammonia gas is gradually blown into the solution which is under stirring and cooling in an autoclave. Then, after further stirring, ammonia gas is removed and then product is collected by filtration and dried under reduced pressure. The product is a condensate of monomer and dimer and the higher having $\leftarrow N{=}P(NH_2)_2\rightarrow$ as a basic structure and a mixture of linear and cyclic compounds. The product is obtained in an amount of about 155 parts. Purity of the product is about 42% by weight with about 58% of ammonium chloride. This reaction product is called "crude amidophosphazene compound (containing by-produced ammonium chloride as it is)". Lot No. AA-1000AGB-0345 ~Lot No. AA-1000AGJ-007 are produced in accordance with the process for preparation of Lot No. AA-1000A mentioned above. Purity of these Lot No. crude amidophosphazene compounds and content of ammonium chloride are shown below.

| Lot No. | Purity (% by weight) | Ammonium chloride (% by weight) |
|---|---|---|
| AA-1000AGB-0345 | about 42% | about 58% |
| AA-1000AGJ-006 | about 42% | about 58% |
| AA-1000AGJ-007 | about 42% | about 58% |
| AA-1000AGJ-008 | about 42% | about 58% |

These Lot No. AA-1000AGB-0345 ~Lot No. AA-1000AGJ-008 are those which are specified by NMR spectrum and integral area curve of FIGS. 38–41. The "crude amidophosphazene compound" here is a reaction product of chlorophosphazen with ammonia which has not been purified. In the present invention, the crude amidophosphazene compound can be purified to increase content of amidophosphazene and this can be used.

Aqueous solutions of the phosphorus amide compounds or the amidophosphazene compounds include, for example, neutral aqueous solutions prepared by dissolving the compounds in neutral water or aqueous solutions of neutral compounds such as, for example, ammonium acetate, sodium chloride, sodium nitrate and magnesium chloride, alkaline aqueous solutions prepared by dissolving the compounds in alkaline aqueous solutions such as, for example, aqueous ammonia solution, aqueous sodium carbonate solution, aqueous sodium hydroxide solution, aqueous diammonium hydrogenphosphate solution, aqueous sodium phosphate solution, aqueous calcium hydroxide solution and aqueous sodium oxalate solution and acidic aqueous solutions prepared by dissolving the compounds in acidic aqueous solutions such as aqueous phosphoric acid solution, aqueous ammonium chloride solution, aqueous monoammonium hydrogenphosphate solution, aqueous monosodium hydrogenphosphate solution, aqueous acetic acid solution, aqueous oxalic acid solution and aqueous succinic acid solution.

To these aqueous solution of phosphorus amide compound or amidophosphazene compound there may be added, as auxiliary components, acidic catalysts such as diammonium phosphate, ammonium chloride, organic amine hydrochlorides, zinc chloride, magnesium chloride, zinc nitrate, zinc borofluoride, hydrochloric acid and phosphoric acid, a small amount of resin treating agents, softening agents, penetrants, water repellants and/or cellulose crosslinking agents which have been normally used.

Crude phosphorus amide compounds and crude amidophosphazene compounds contain by-product ammonium chloride in a large amount, but aqueous solution of crude phosphorus amide compound or crude amidophosphazene compound is one of preferred embodiments.

The treating agent of this invention can be obtained by aging aqueous solution of phosphorus amide compound or amidophosphazene compound.

For example, for preparation of aged aqueous solution of phosphorus amide compound, there may be employed various methods such as aging of an aqueous solution of a crude phosphorus amide compound which is a mixture of reaction product of phosphorus oxychloride and anhydrous ammonia and by-product ammonium chloride which is obtained in Example 1 of U.S. Pat. No. 2,661,264; aging of an aqueous solution mainly composed of phosphorus amide compound and ammonium chloride which is obtained by blowing anhydrous ammonia gas into a solution of phosphorus oxychloride in monochlorobenzene, adding an aqueous solution to the resulting mixed precipitate of phosphorus amide compound and ammonium chloride and stirring it and subjecting to separation into layers the aqueous solution of monochlorobenzene, phosphorus amide compound and ammonium chloride; and aging of an aqueous solution of phosphorus amide compound which is obtained by adding aqueous ammonia to phosphorus oxychloride.

For preparation of aged aqueous solution of amidophosphazene compound, there may also be employed various methods such as aging of an aqueous solution of crude amidophosphazene compound obtained by blowing ammonia gas into an aqueous solution of chlorophosphazene in anhydrous carbon tetrachloride and subjecting the resulting mixed precipitate of amidophosphazene compound and ammonium chloride to filtration and drying as shown in Example 1 of U.S. Pat. No. 2,782,133; aging of an aqueous solution mainly composed of amidophosphazene compound and ammonium chloride which is obtained by blowing ammonia gas into a solution of chlorophosphazene in monochlorobenzene, adding an aqueous solution to the resulting mixed precipitate of amidophosphazene compound and ammonium chloride, stirring the mixture and separating it into layers; aging of an aqueous solution mainly composed of amidophosphazene compound of relatively low molecular weight and by-produced ammonium chloride which is obtained by mixing a group of phosphonitrile chloride compounds, specifically, a mixture of compounds represented by the formulas $(PNCl_2)_n$ and $(PNCl_2)_m.PCl_5$, prepared by reacting phosphorus pentachloride with ammonium chloride in an inert solvent such as monochlorobenzene or tetrachloroethane with an aqueous ammonia solution at low temperature to convert the compounds into amides as shown in Examples 1–4 of Japanese Patent Kokoku No. 47-45636; aging of an aqueous solution mainly composed of amidophosphazene compound and ammonium chloride which is obtained by dissolving chlorophosphazene obtained from phosphorus pentachloride and ammonium chloride in monochlorobenzene, reacting the solution with diethylamine under cooling, blowing ammonia gas thereinto, adding a neutral, alkaline or acidic aqueous solution of amidophosphazene compound enumerated hereabove to the resulting mixed precipitate of amidophosphazene compound and by-produced ammonium chloride synthesized in the monochlorobenzene solution, stirring and separating the mixture into layers.

Figure 2:
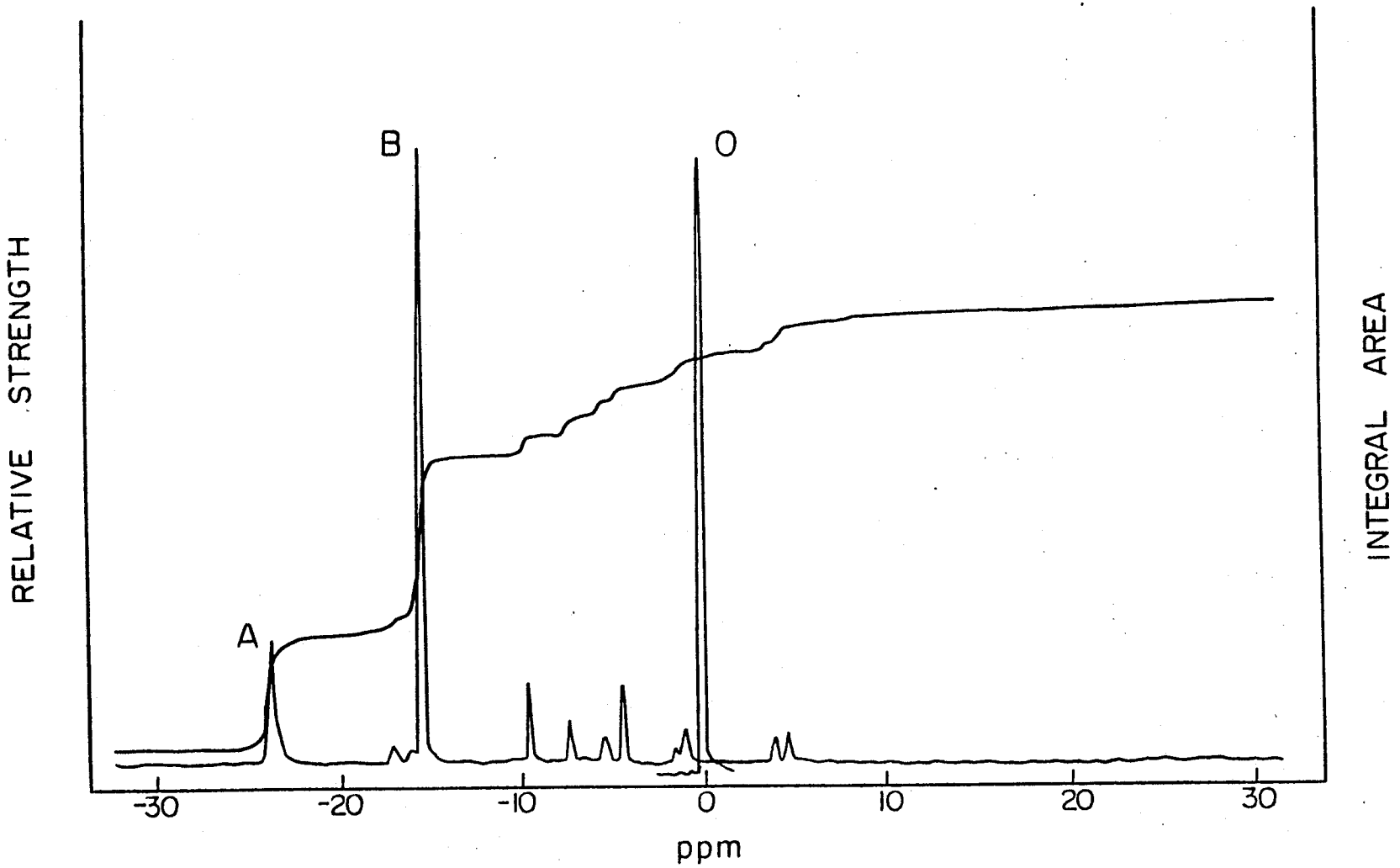
Figure 3:
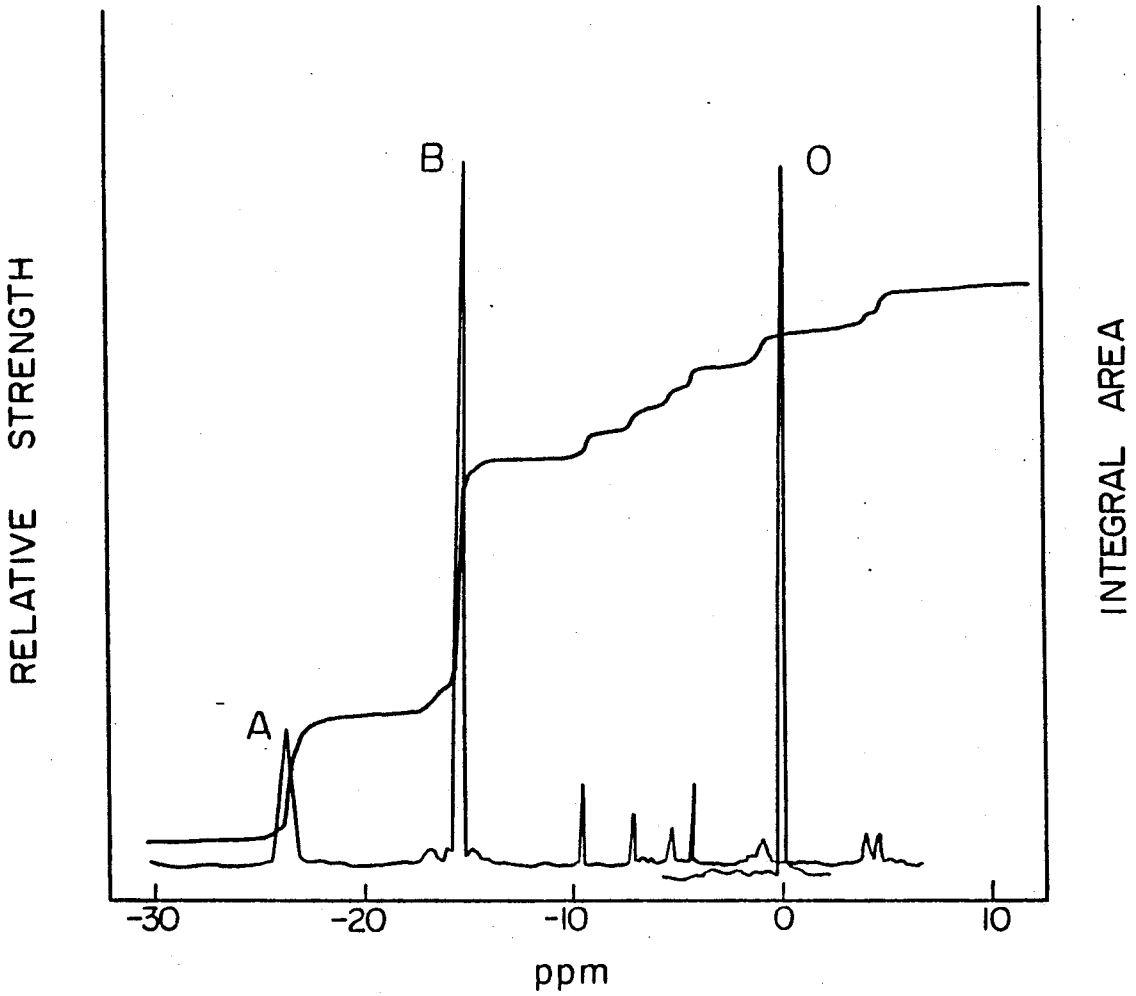

Aging of aqueous solution of phosphorus amide compound or amidophosphazene compound results in change of NMR curve of 31P of the aqueous solution. Typical examples of the change in NMR curve of aqueous solution of phosphorus amide compound are shown in FIGS. 1–3 and those of aqueous solution of amidophosphazene compound are shown in FIGS. 13–17.

Figure 4:
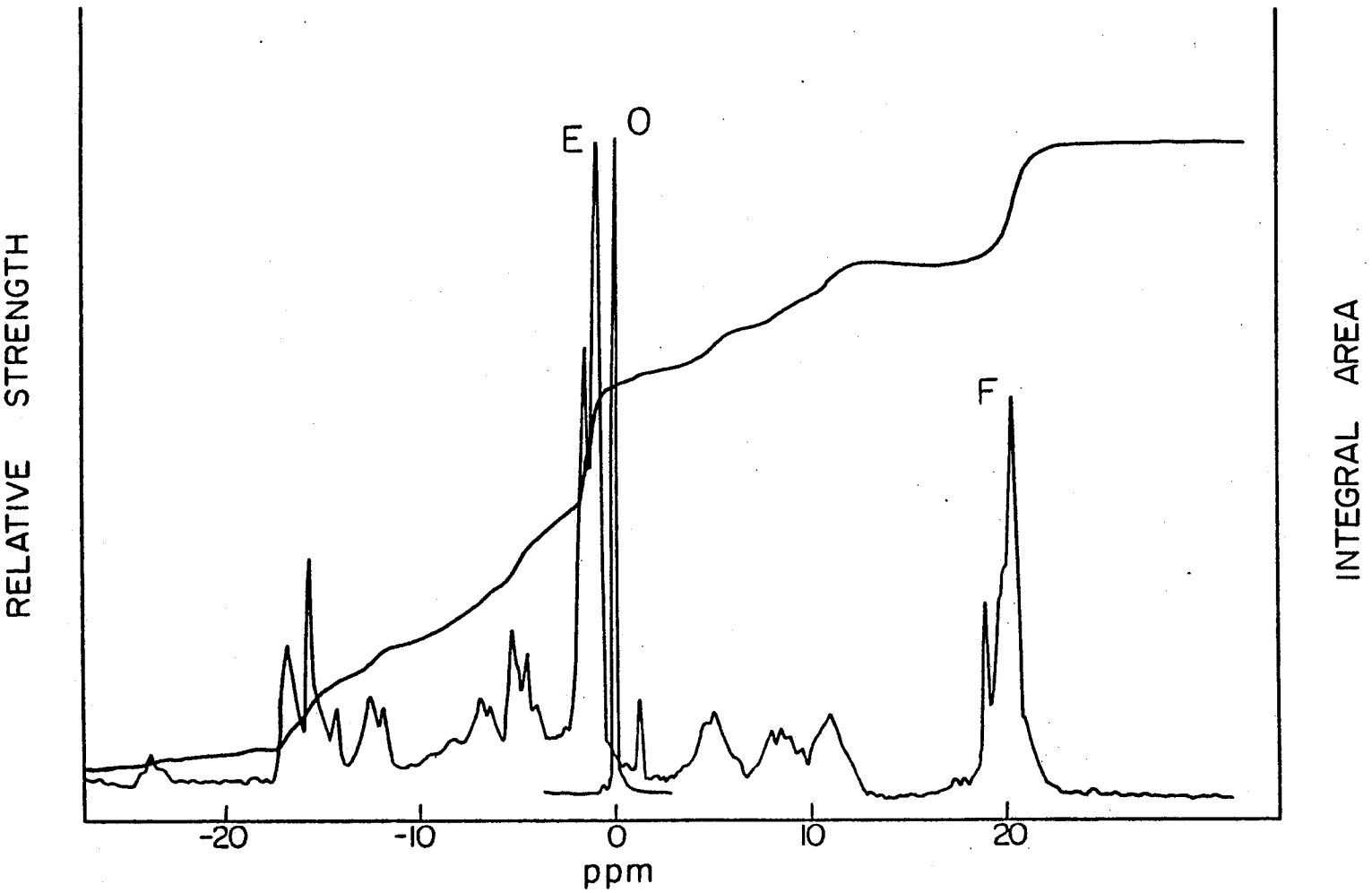
Figure 5:
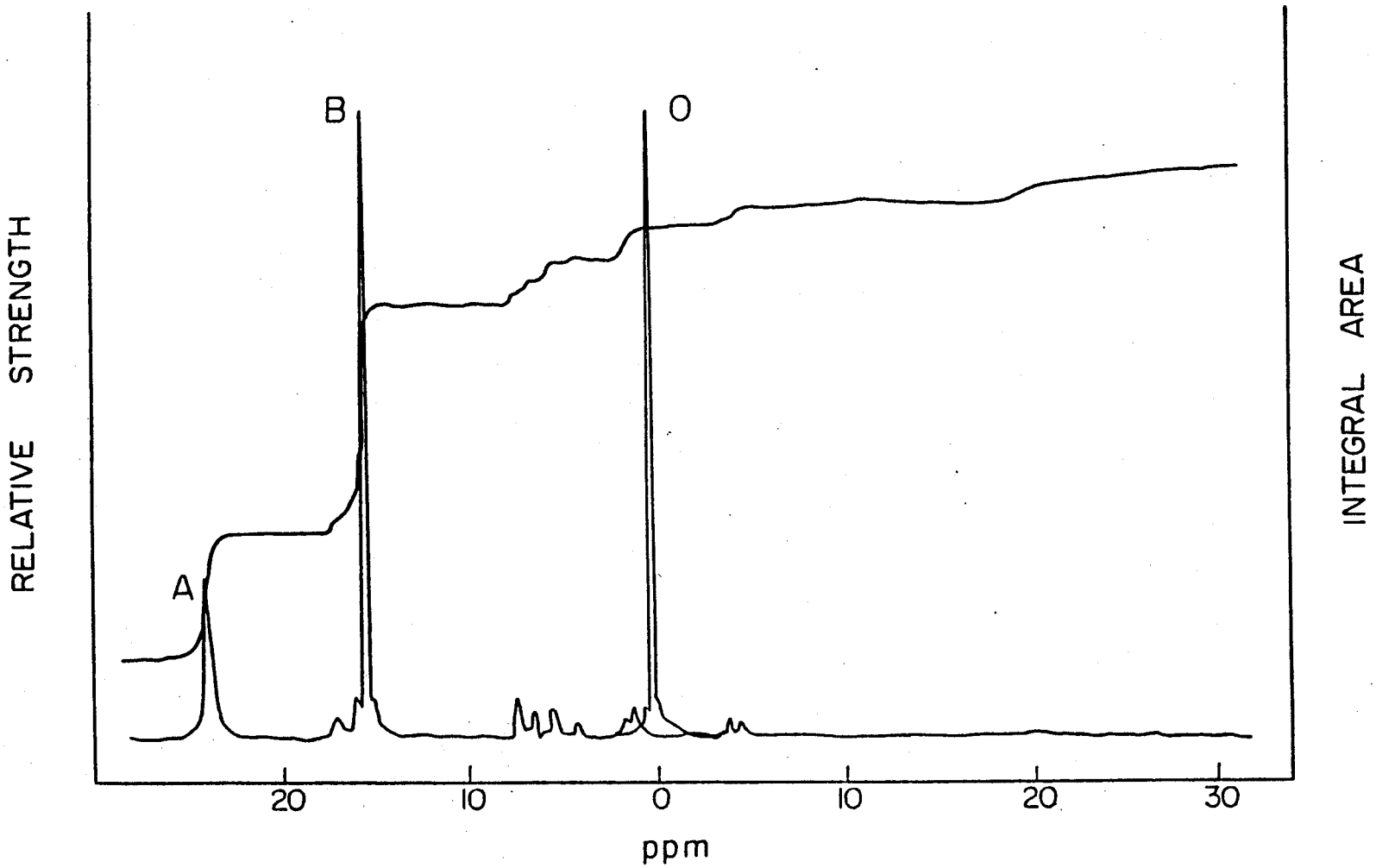
Figure 6:
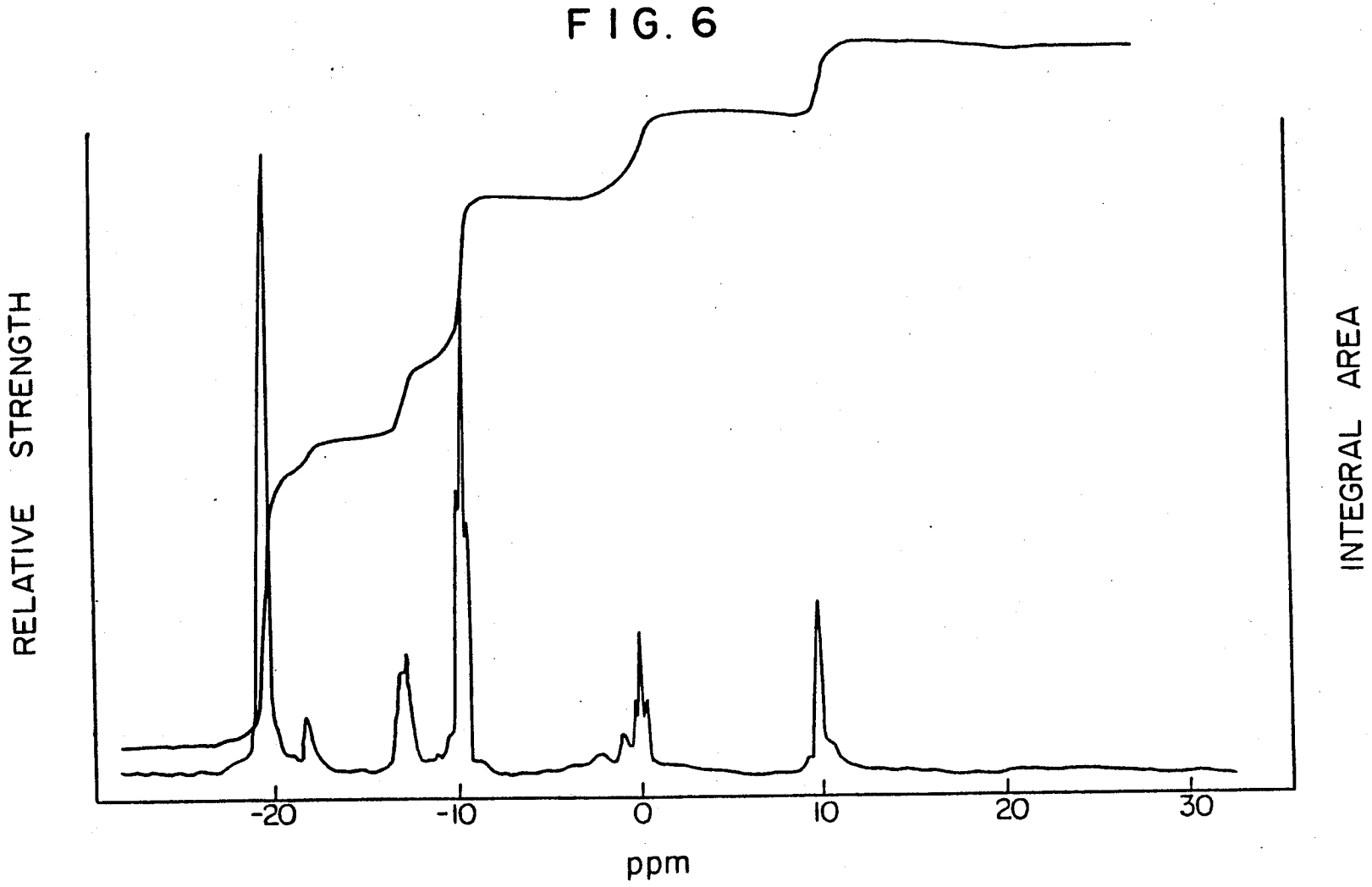
Figure 7:
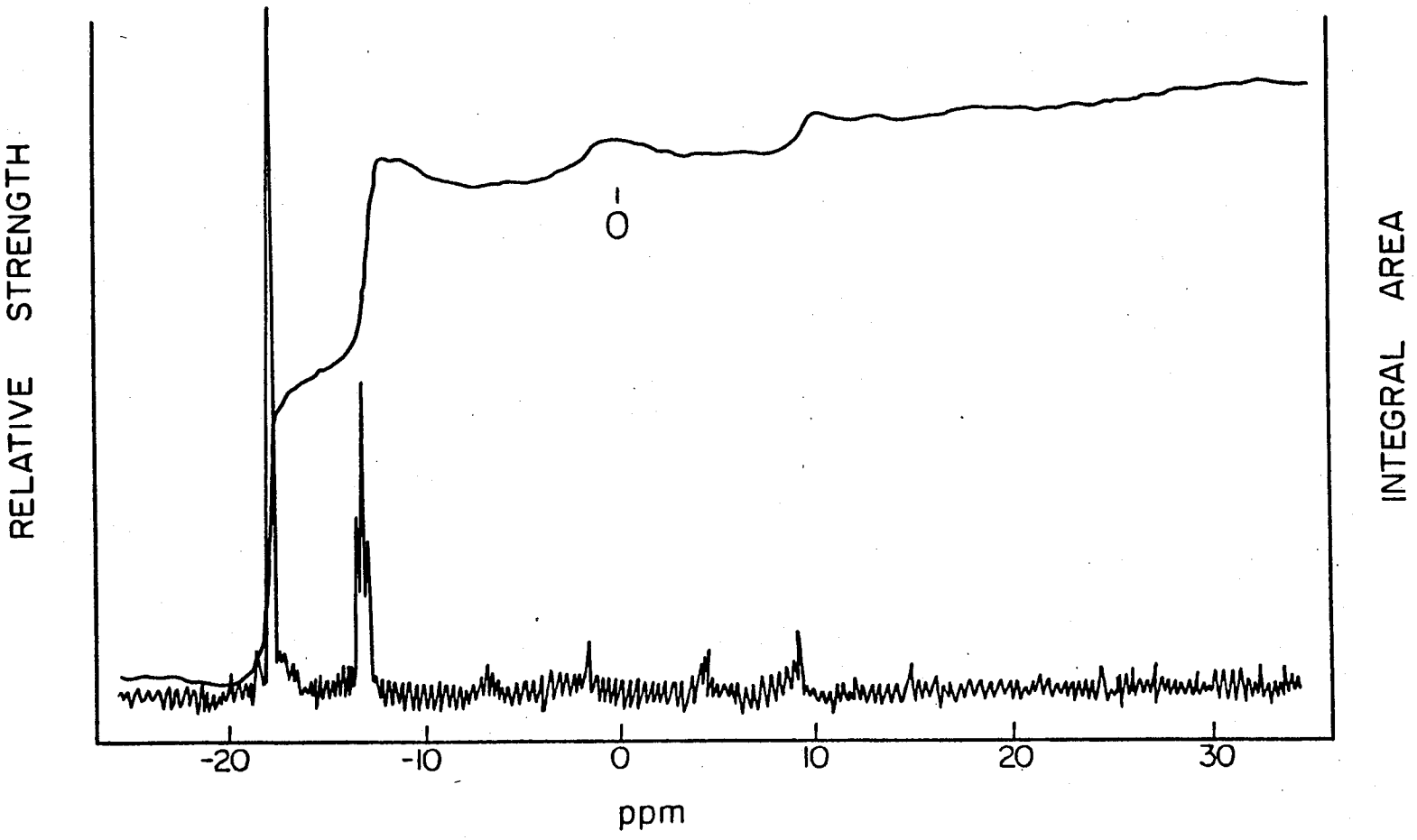

FIG. 1 shows NMR curve of 31P of unaged crude phosphorus amide compound (Lot No. GL-08 manufactured by Nippon Soda Co., Ltd., purity: 36.6% and ammonium chloride: about 63%). Peak D and peak E are peaks of main components of said compound. FIG. 2 shows NMR curve of 31P of an aqueous solution which was prepared by dissolving the same crude phosphorus amide compound as used for FIG. 1 in 10% aqueous ammonia solution at a concentration of crude phosphorus amide compound of 400 g/l and was aged at 50° C. for 50 hours. Surprisingly, peaks D and E disappeared in FIG. 2 and the compound mostly changed to compositions shown by peaks A and B which are not seen in FIG. 1. FIG. 3 shows NMR curve of 31P of an aqueous solution which was prepared by dissolving the same crude phosphorus amide compound as used for FIG. 1 in 5% aqueous ammonia solution at a concentration of 400 g/l and was aged at 50° C. for 60 hours. Peaks D and E disappeared in FIG. 3 and the compound mostly changed to compositions shown by peaks A and B which are not seen in FIG. 1. FIG. 4 shows NMR curve of 31P of unaged purified phosphorus amide compound (Lot No. HA-11 manufactured by Nippon Soda Co., Ltd., purity: 96.4% and ammonium chloride: about 4%) which is different from that used for FIG. 1. Peaks E and F are peaks of main components of the compound. FIG. 5 shows NMR curve of 31P of an aqueous solution prepared by dissolving the same purified phosphorus amide compound as used for FIG. 4 in 1% aqueous ammonia solution at a concentration of 400 g/l and aged at 50° C. for 1 hour and additionally at 20° C. for 10 days. Peaks E and F disappeared in FIG. 5 and the compound mostly changed to compositions shown by peaks A and B which are seen in FIG. 4. FIG. 6 shows NMR curve of 31P of unaged crude phosphorus amide compound a part of amido groups of which was substituted with diethylamino group [$—N(C_2H_5)_2$] (Lot No. GK-25; purity: 40.9% and ammonium chloride: about 59%). FIG. 7 shows NMR curve of 31P of an aqueous solution which was prepared by dissolving the same crude phosphorus amide compound as used for FIG. 6 in 10% aqueous ammonia solution at a concentration of 20 g/l and aged at 50° C. for 24 hours. It can be seen that many peaks seen in the unaged compound disappeared.

Figure 8:
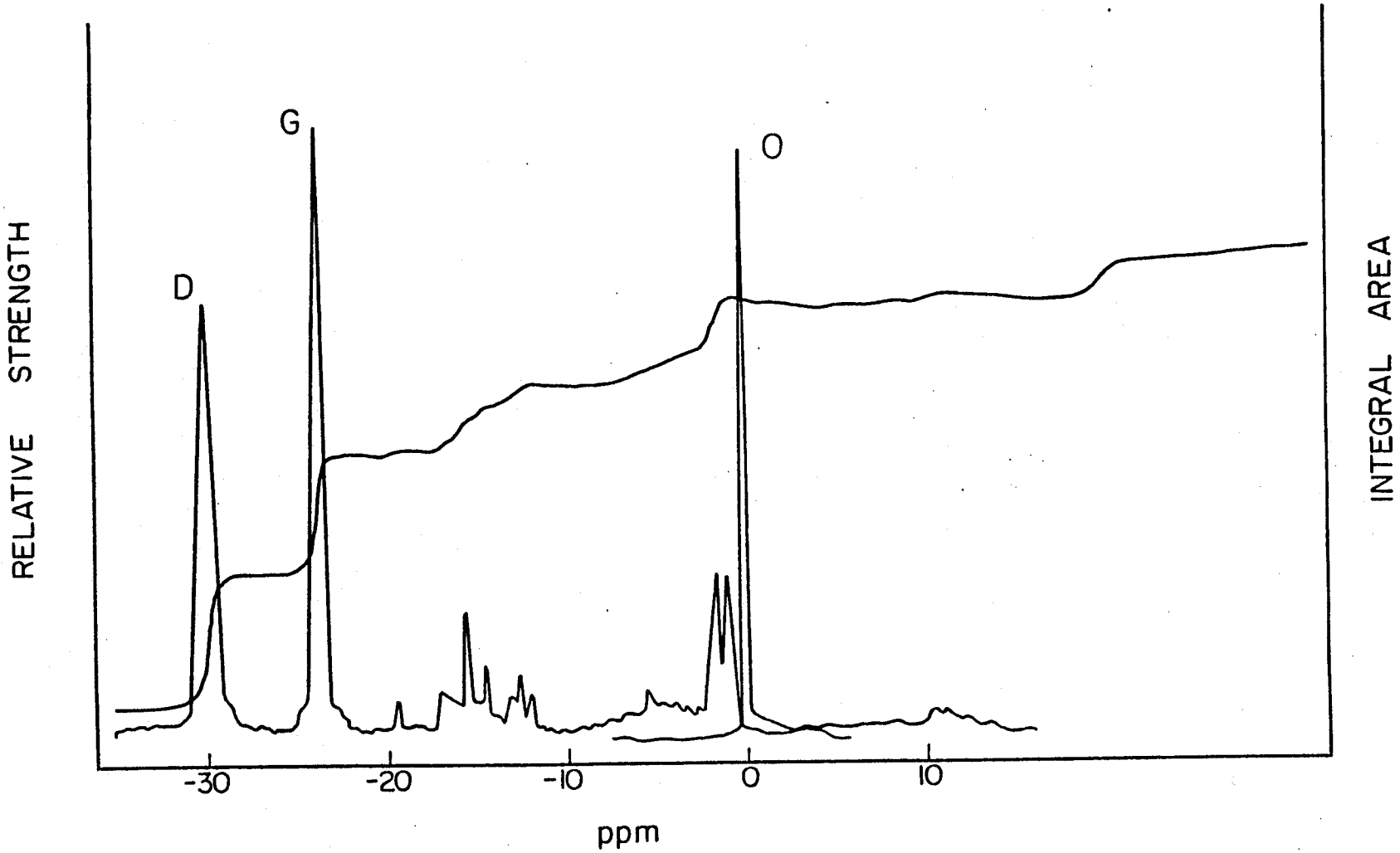

FIG. 8 shows NMR curve of 31P of unaged crude phosphorus amide compound (Lot No. HA-019 manufactured by Nippon Soda Co., Ltd.; purity: 35.8% and ammonium chloride: about 64%) and peaks D and E are peaks of main components of the compound. FIGS. 9-12 show NMR curves of 31P of aqueous solution of phosphorus amide compound which was prepared by dissolving the same phosphorus amide compound as used in FIG. 8 in respective solutions to a concentration of 400 g/l and which was aged under respective conditions.

Figure 9:
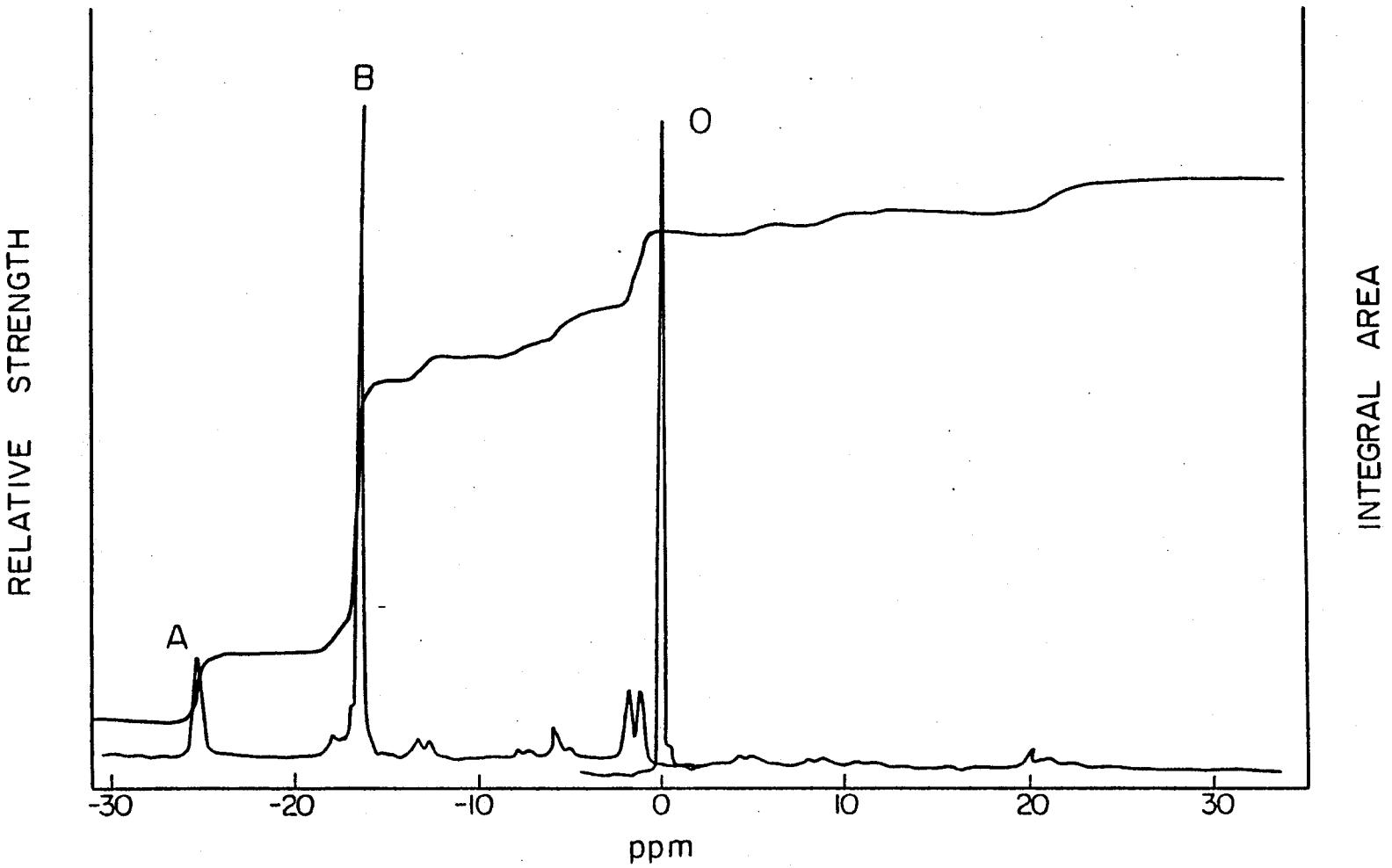
Figure 10:
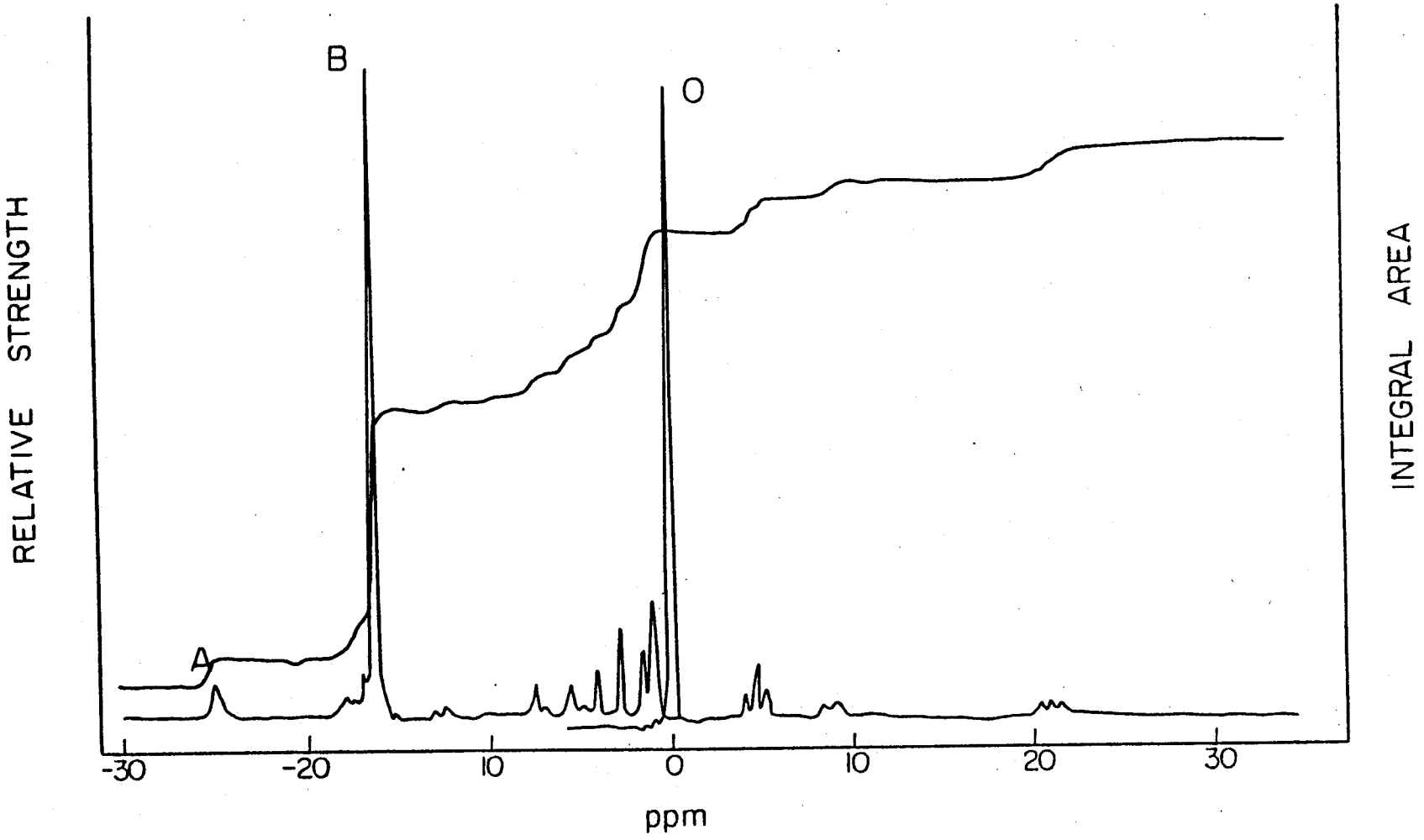
Figure 11:
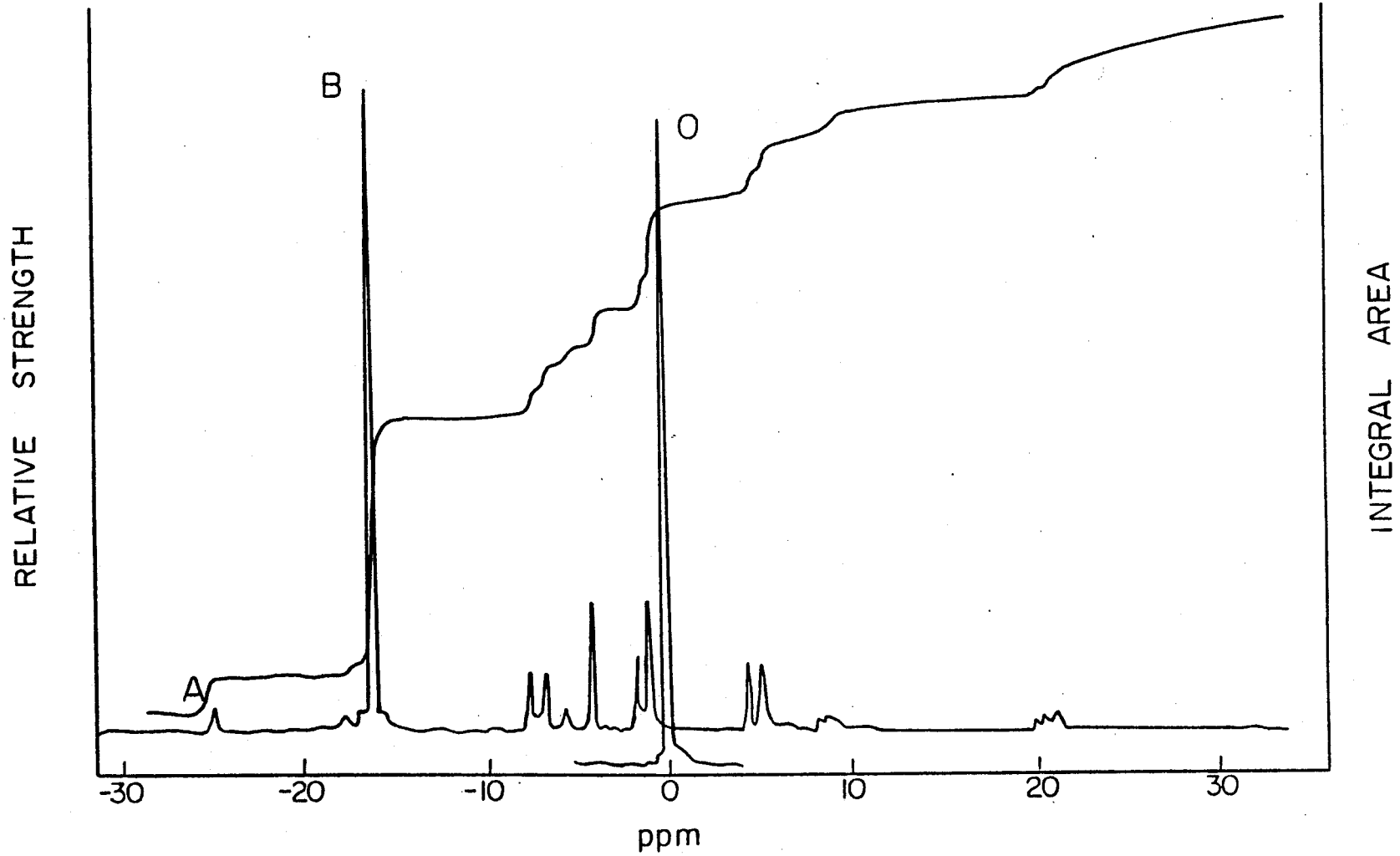
Figure 12:
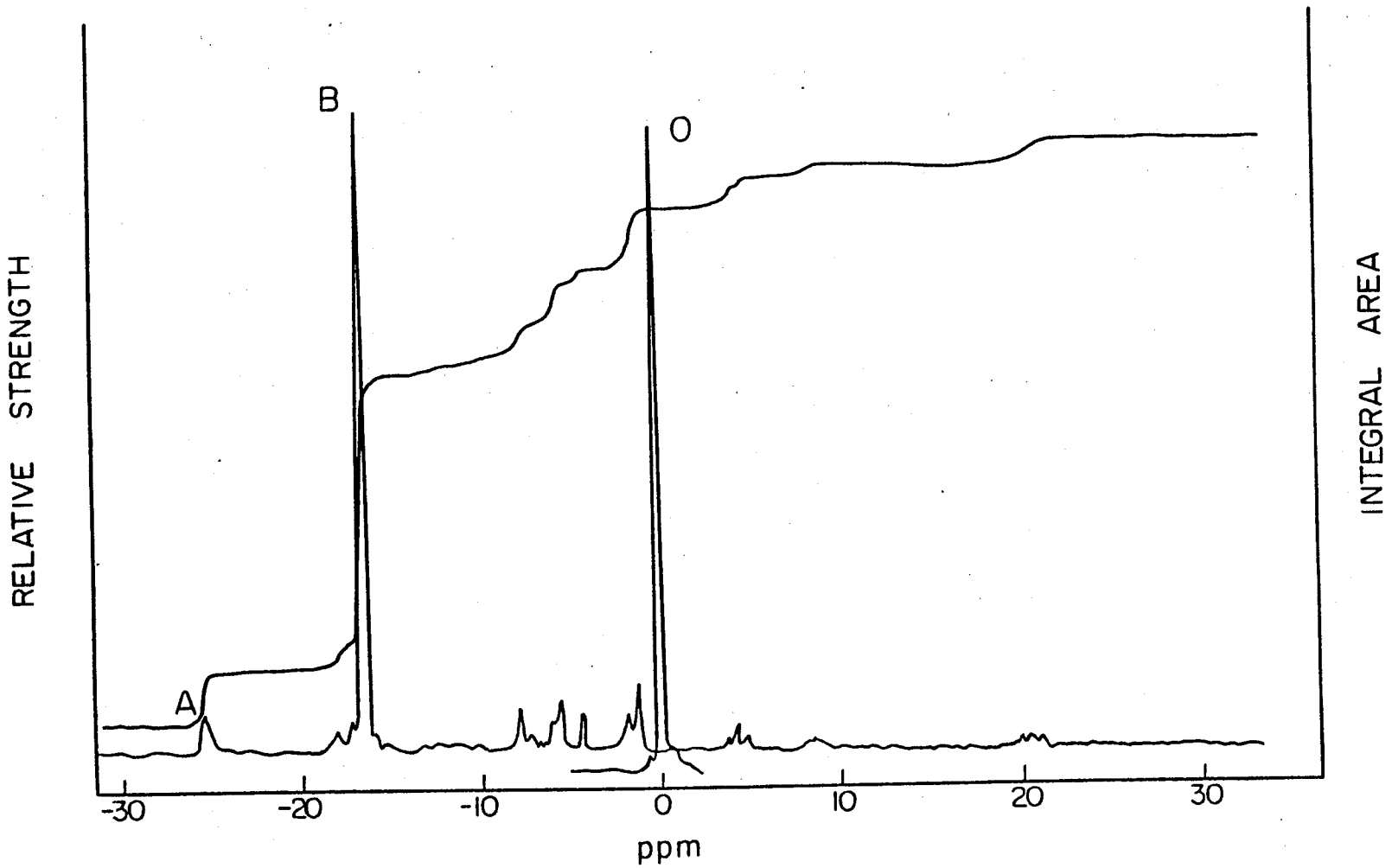

FIG. 9 shows NMR curve where the phosphorus amide compound was dissolved in water and the aqueous solution was aged at 20° C. for 2 days. FIG. 10 shows NMR curve where the phosphorus amide compound was dissolved in 1% aqueous phosphoric acid solution and this was aged at 20° C. for 5 days. FIG. 11 shows NMR curve where the phosphorus amide compound was dissolved in 1% aqueous diammonium hydrogen phosphate solution and this was aged at 40° C. for 15 hours. FIG. 12 shows NMR curve where the phosphorus amide compound was dissolved in 0.5% aqueous sodium hydroxide solution and this was aged at 60° C. for 15 hours.

Figure 13:
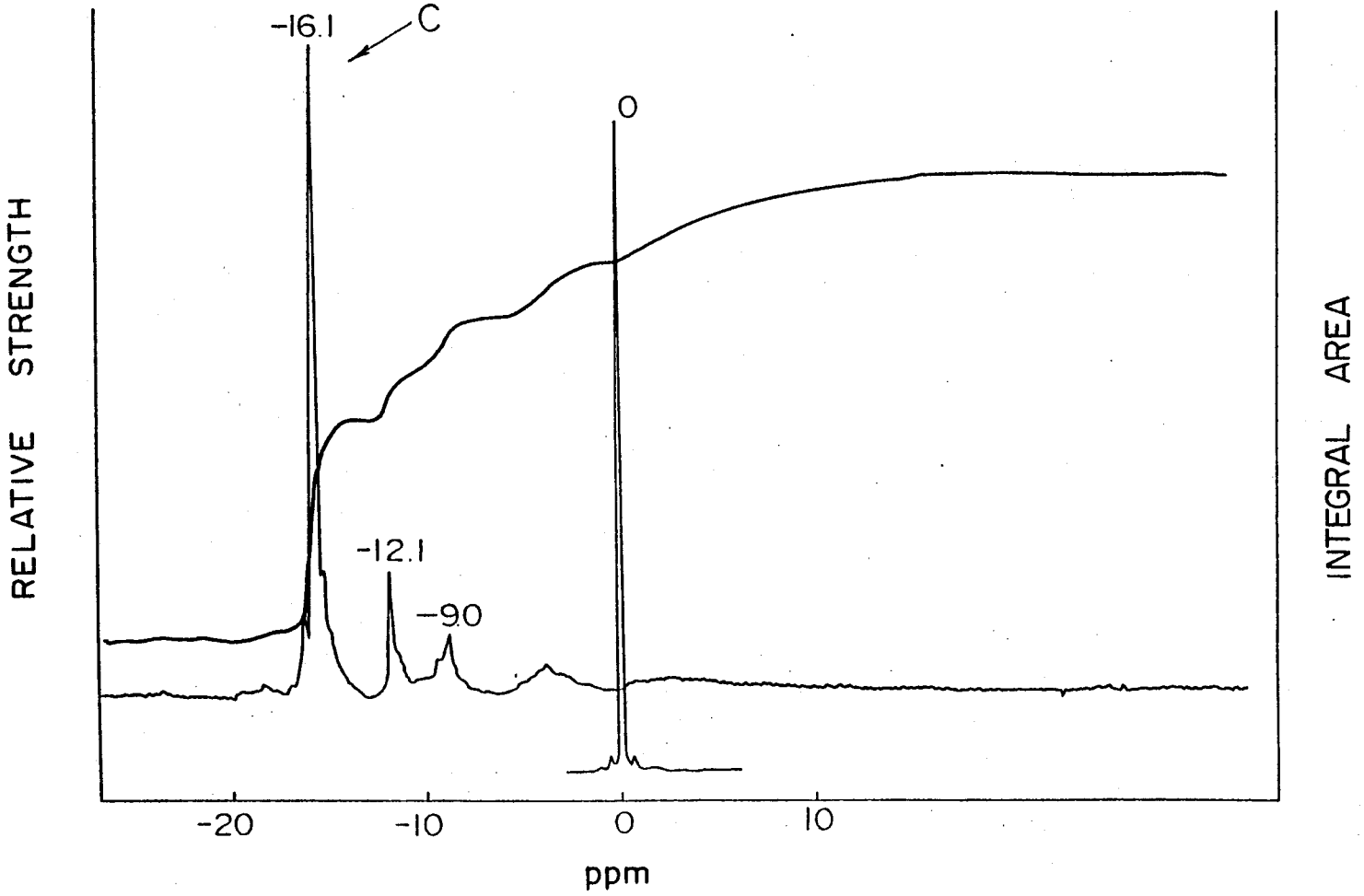

FIG. 13 shows NMR curve of 31P of unaged crude amidophosphazene compound (Lot No. GB-003; purity: 41.4% and ammonium chloride: about 58%) and peak C shows a peak of the main component of the compound.

Figure 14:
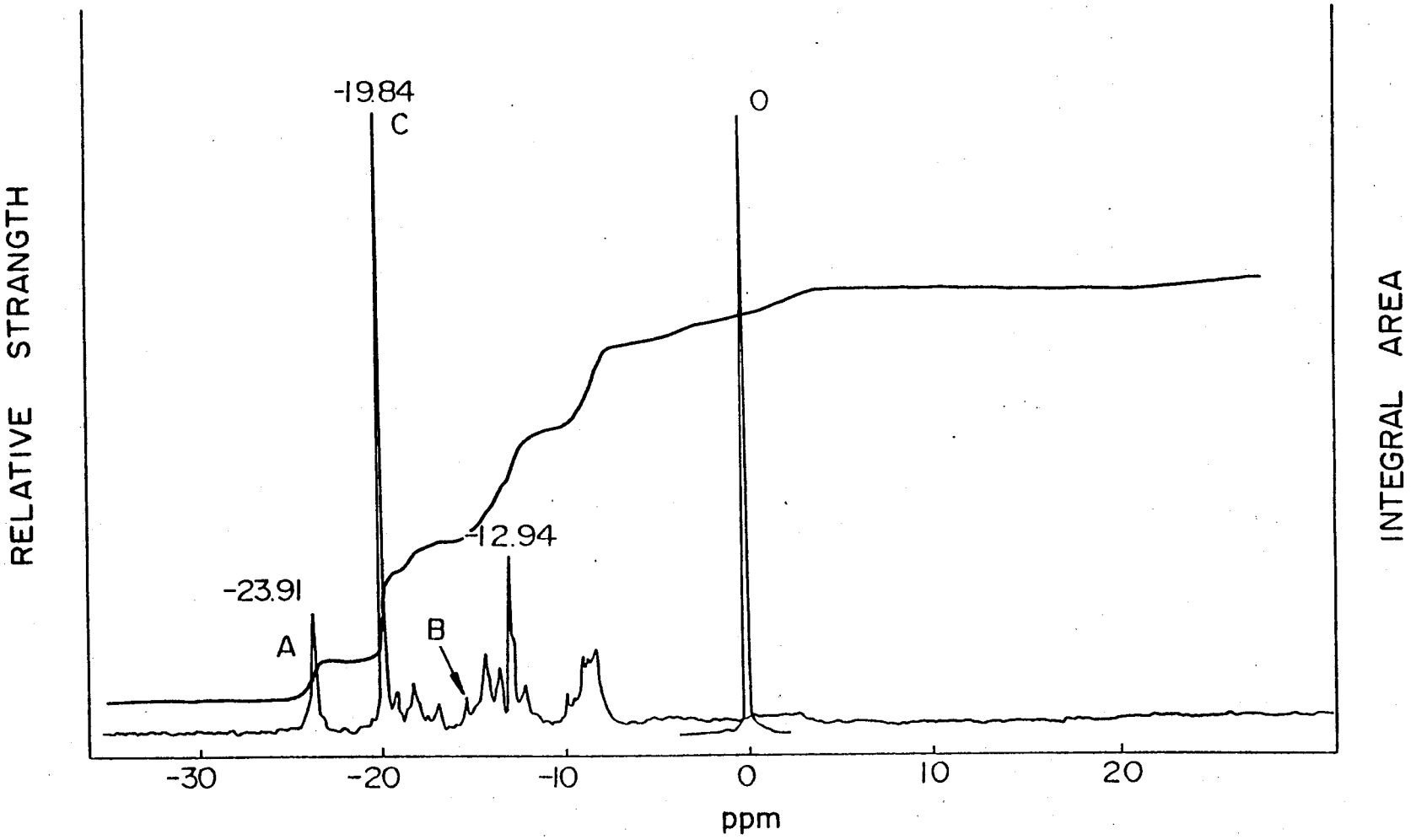
Figure 15:
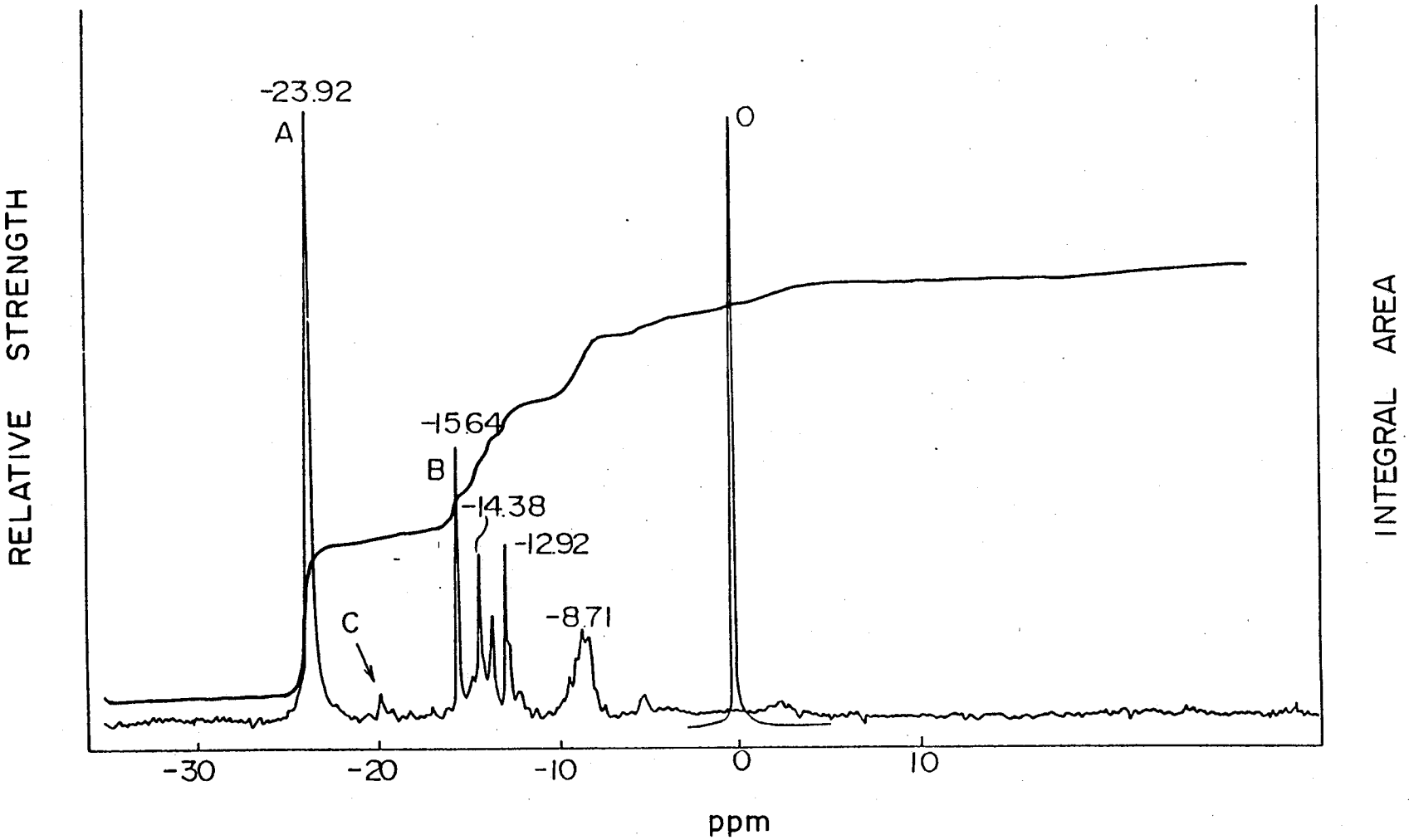
Figure 16:
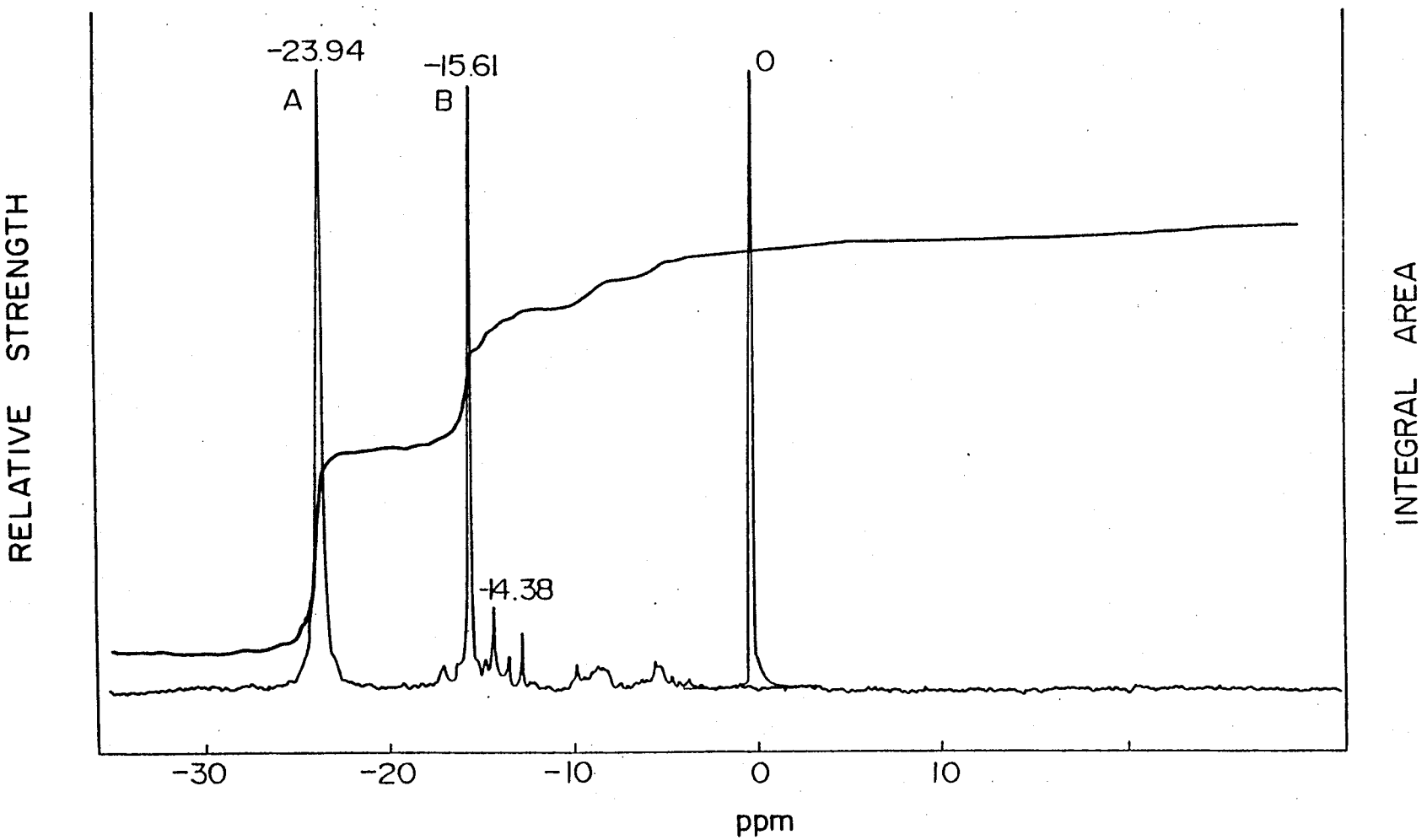
Figure 17:
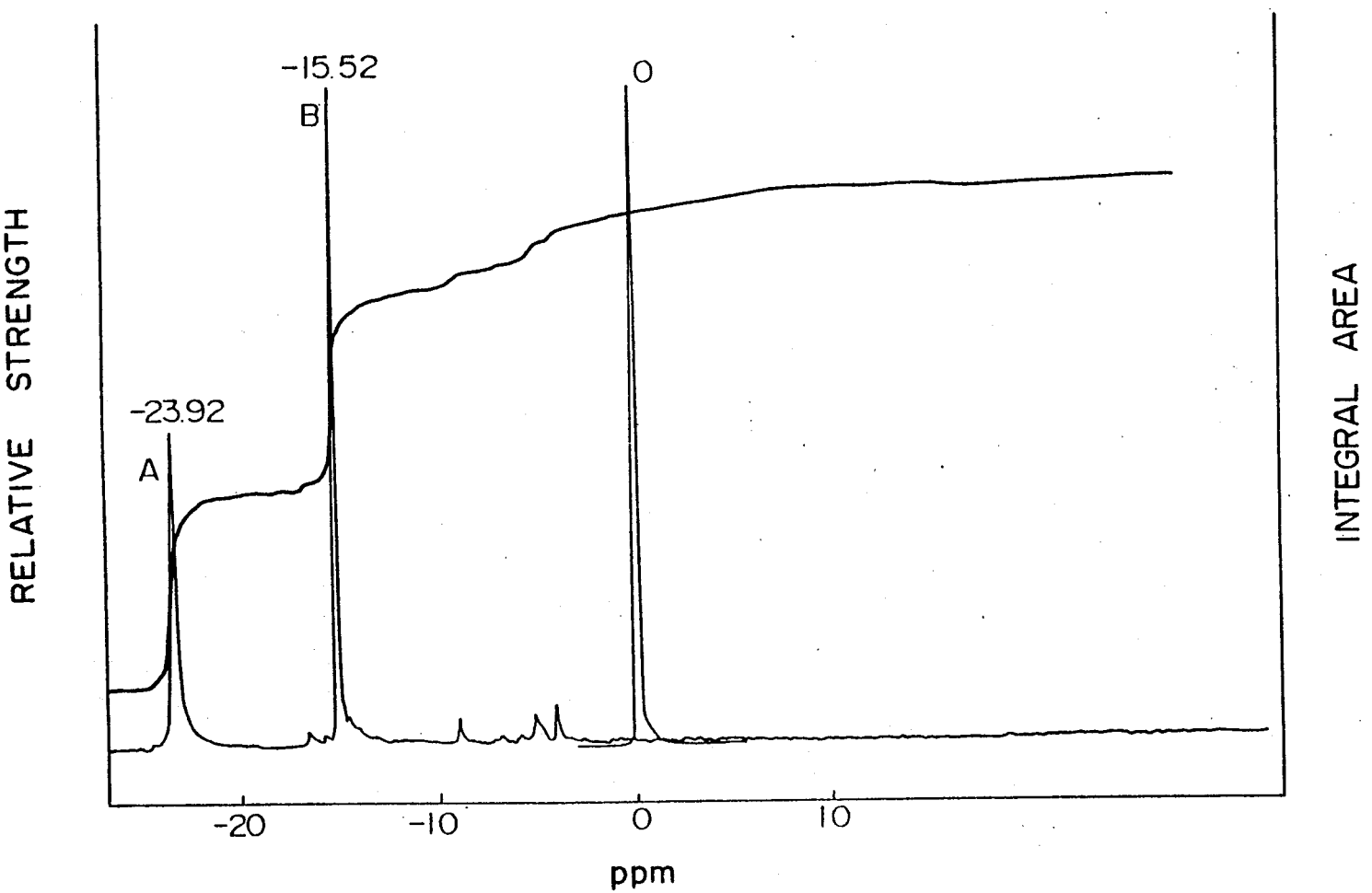

FIG. 14 shows NMR curve of 31P of an aqueous solution of amidophosphazene compound which was prepared by dissolving the same amidophosphazene compound as used for FIG. 13 in a 14% aqueous ammonia solution at a concentration of 400 g/l and which was aged at 50° C. for 1 hour. There appear peaks A and B which are not seen for the unaged compound. FIG. 15 shows NMR curve of 31P of the same aqueous solution of the amidophosphazene compound as used for FIG. 14 which was aged at 50° C. for 6 hours. It can be seen that peaks A and B grew and peak C nearly disappeared. FIG. 16 shows NMR curve of 31P of the same aqueous solution as used for FIG. 14 which was aged at 50° C. for 12 hours and it can be seen that peaks A and B further grew and peak C disappeared. FIG. 17 shows NMR curve of 31P of the same aqueous solution as used for FIG. 14 which was aged at 50° C. for 24 hours and it can be seen that the compound mostly changed to the composition shown by peaks A and B.

Figure 18:
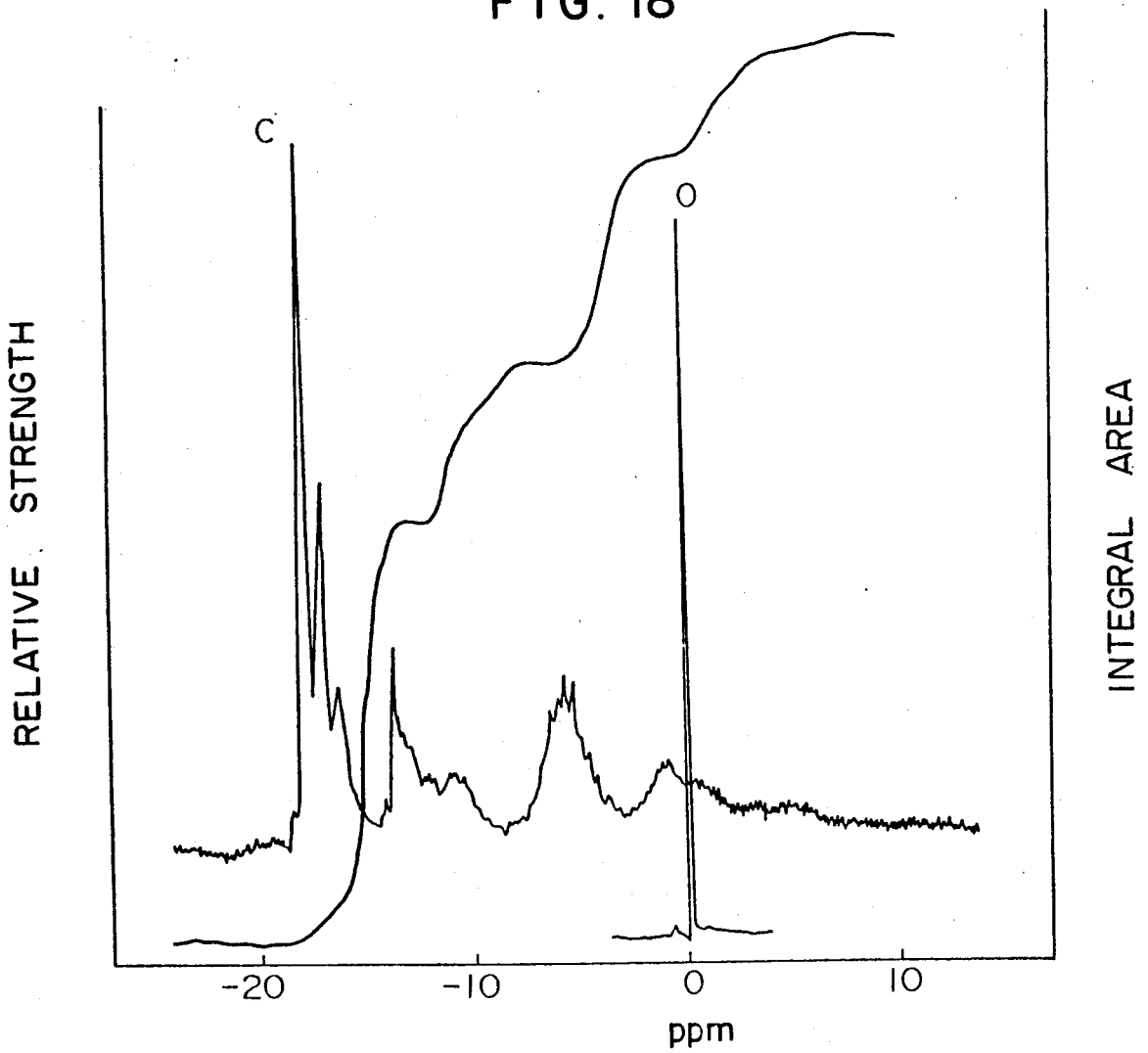

FIG. 18 shows NMR curve of 31P of unaged crude amidophosphazene compound (Lot No. FC-028; purity: about 42% and ammonium chloride: about 58%) different in Lot No. from that used for FIG. 13 and peak C is a peak of the main component of the compound.

FIGS. 19-27 show NMR curves of 31P of aqueous solution of amidophosphazene compound which was prepared by dissolving the same amidophosphazene compound as used in FIG. 18 in respective aqueous solutions at a concentration of 400 g/l and which was aged under respective conditions.

Figure 19:
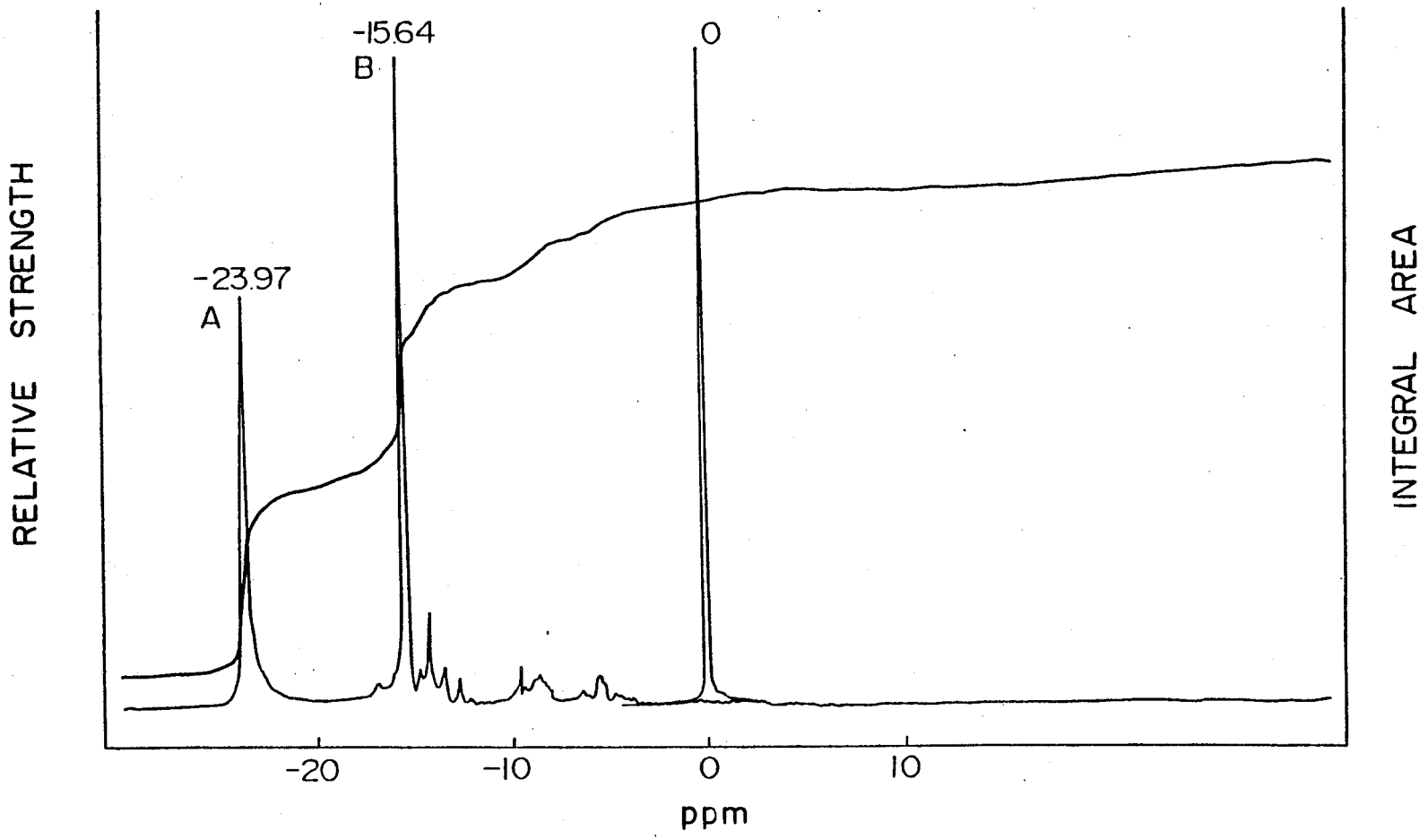
Figure 20:
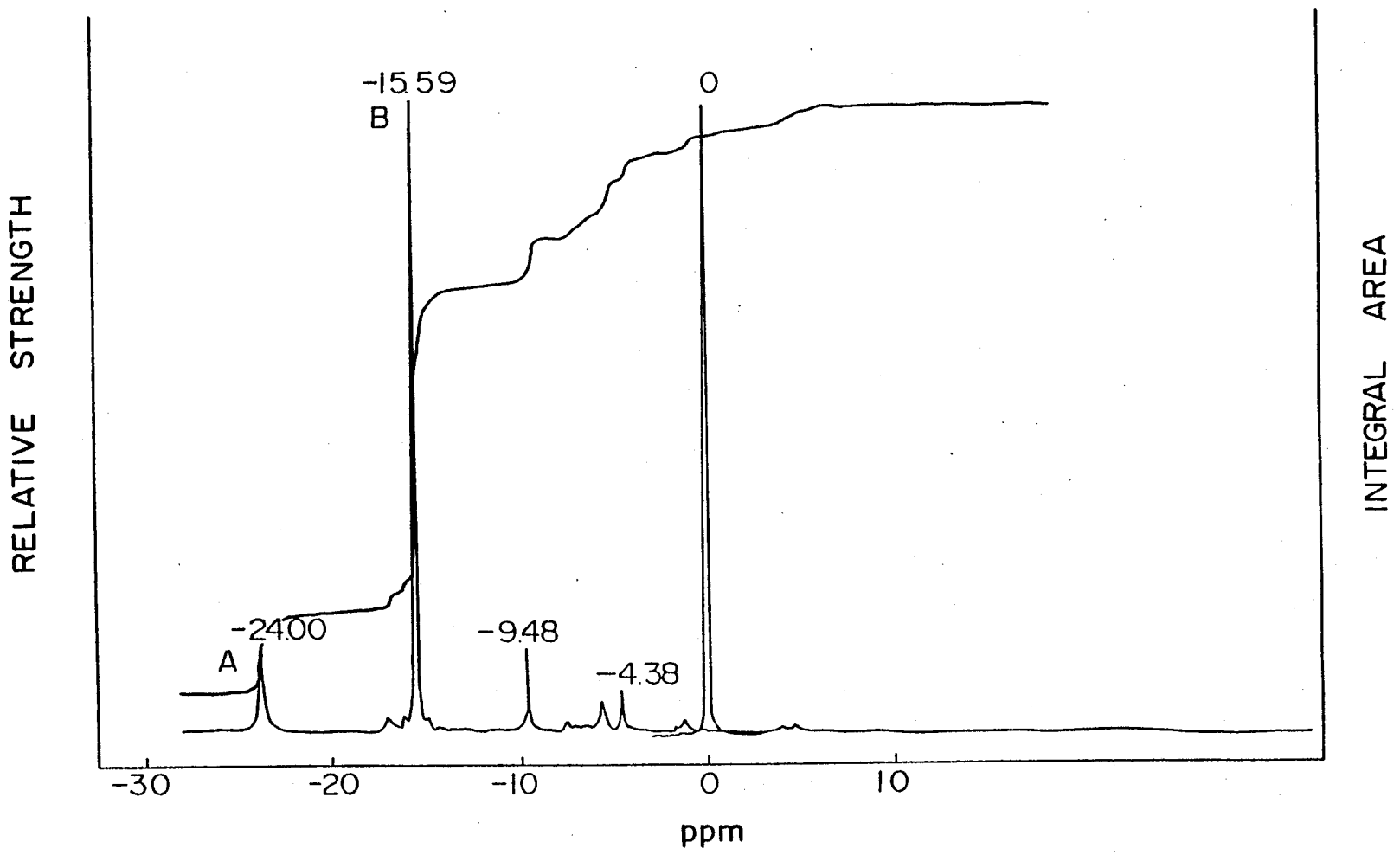
Figure 21:
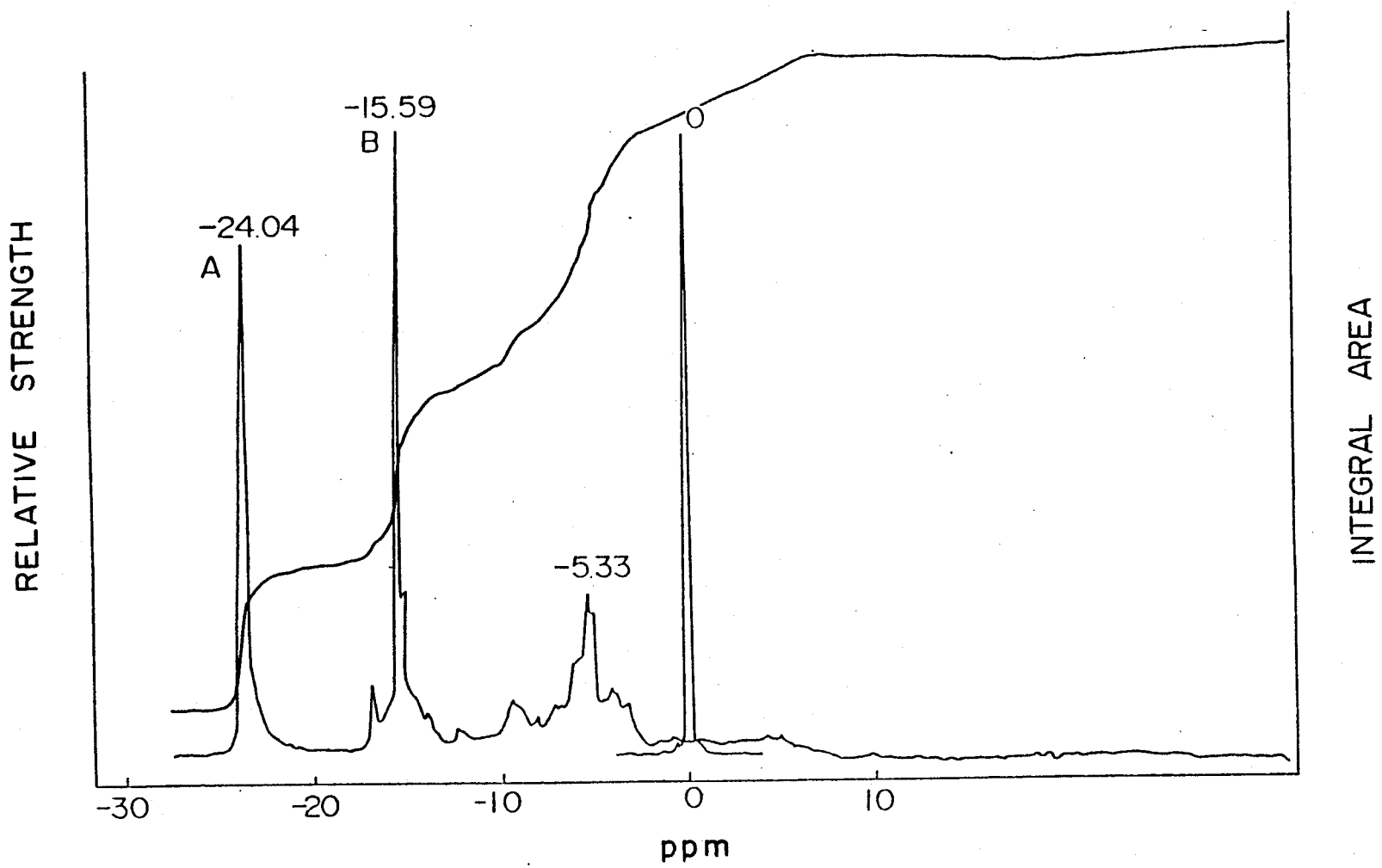
Figure 22:
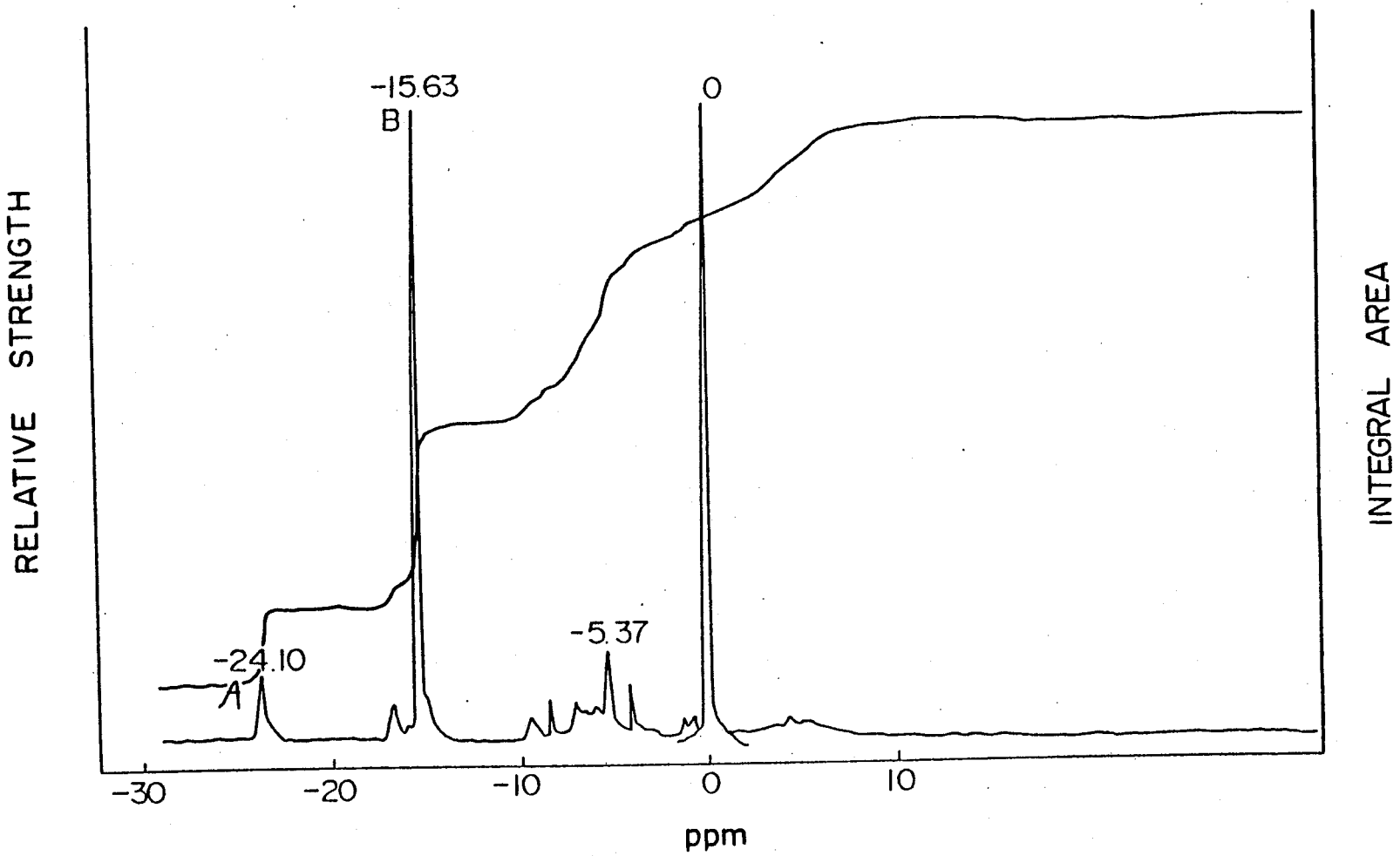
Figure 23:
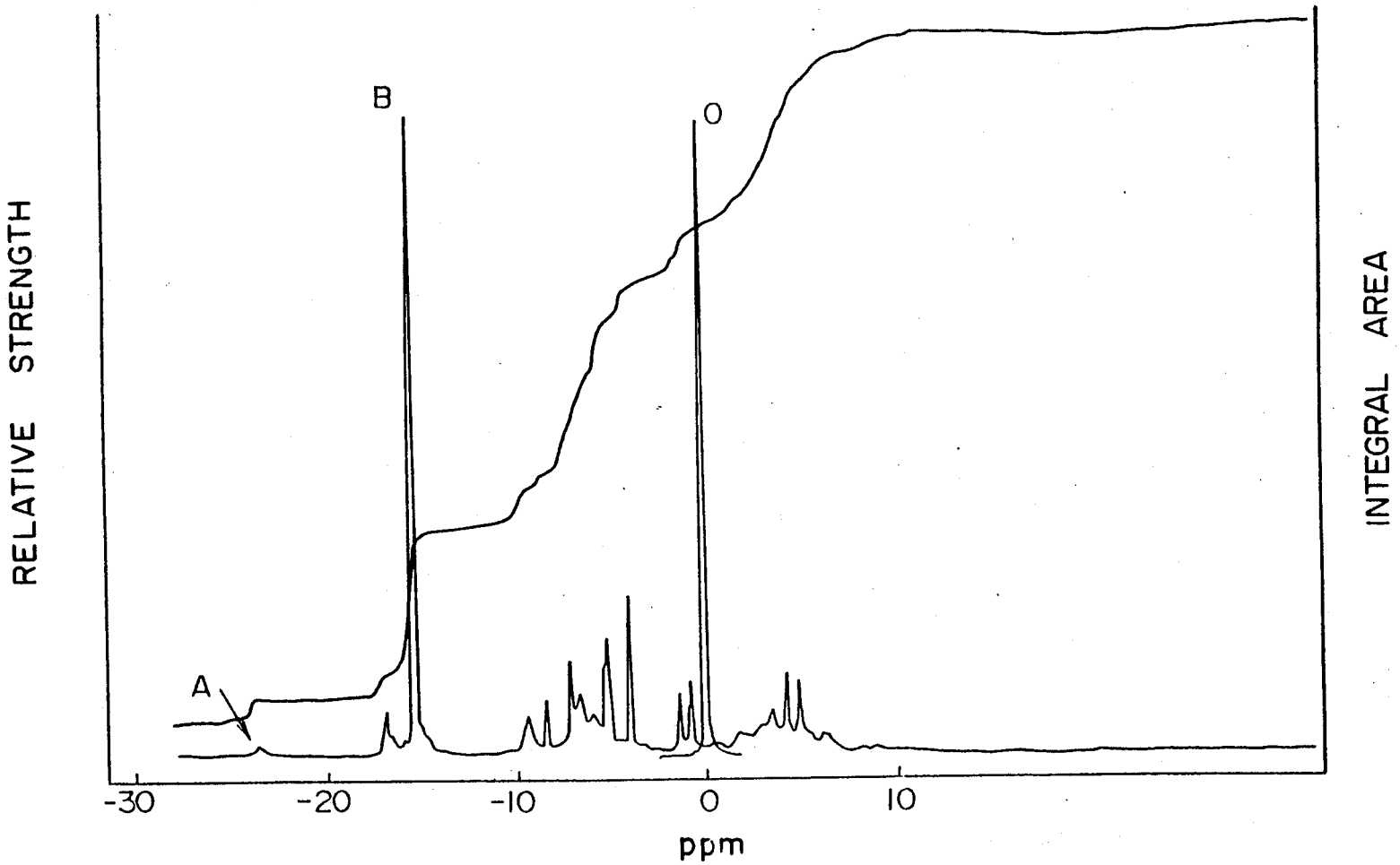
Figure 24:
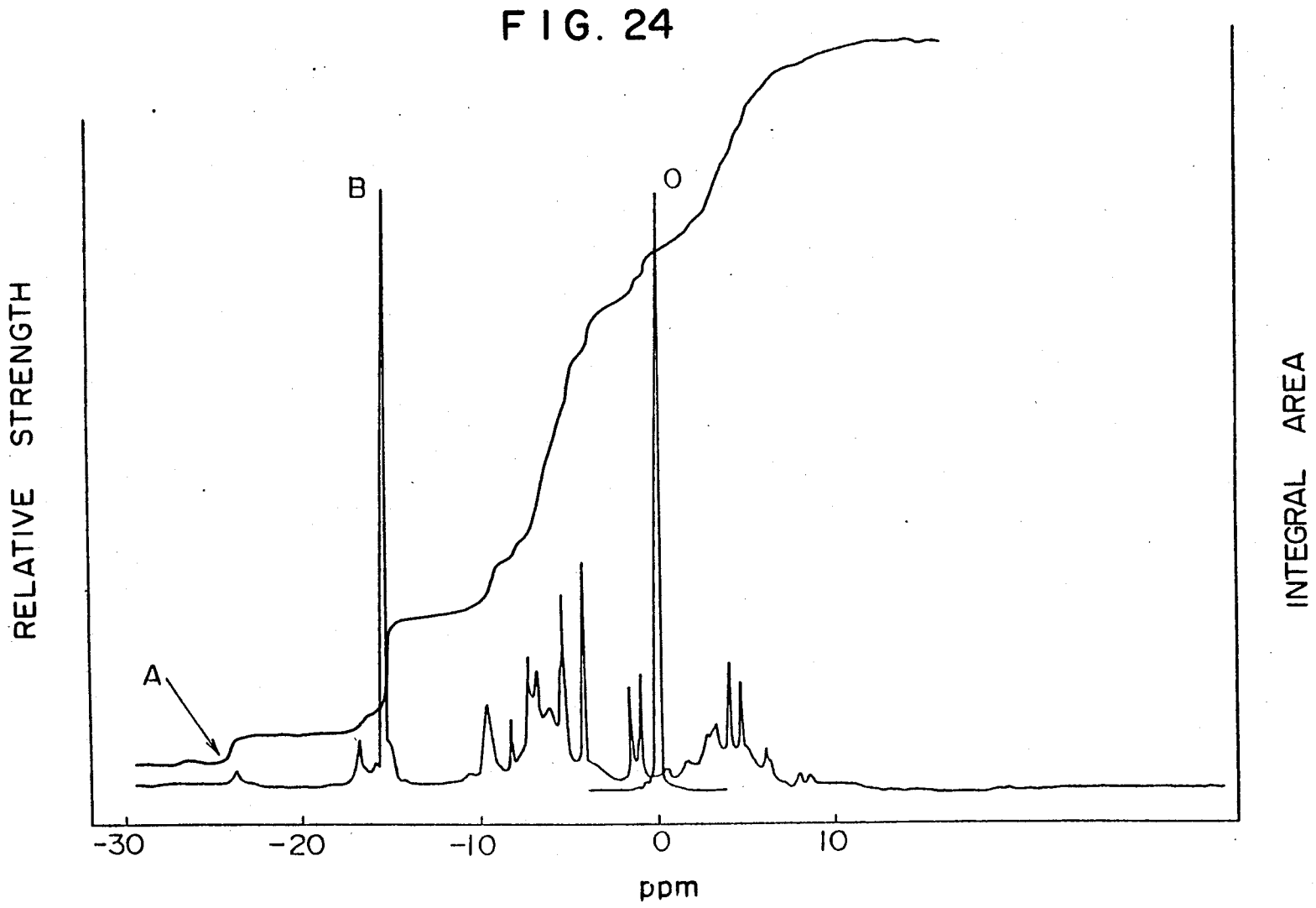
Figure 25:
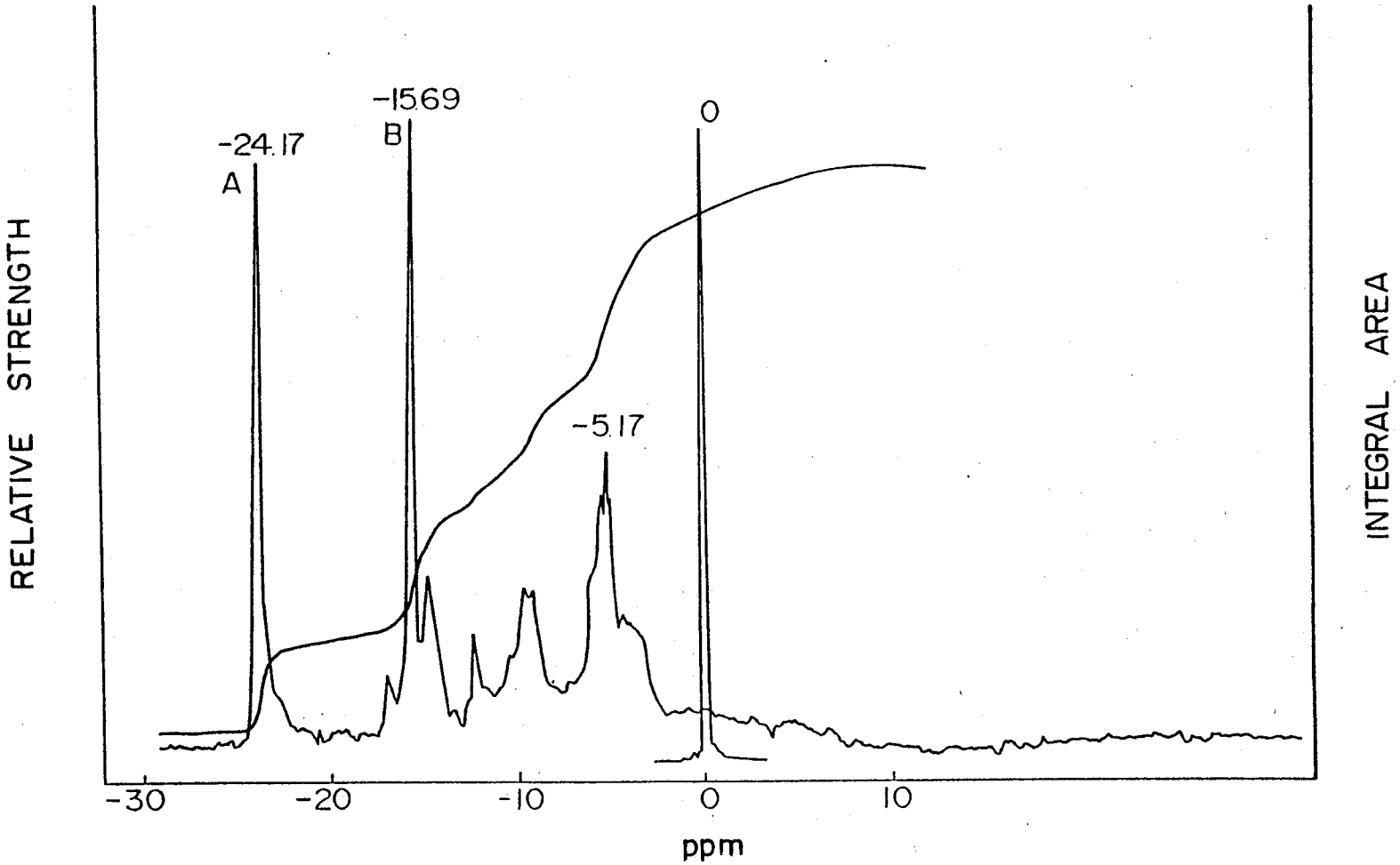
Figure 26:
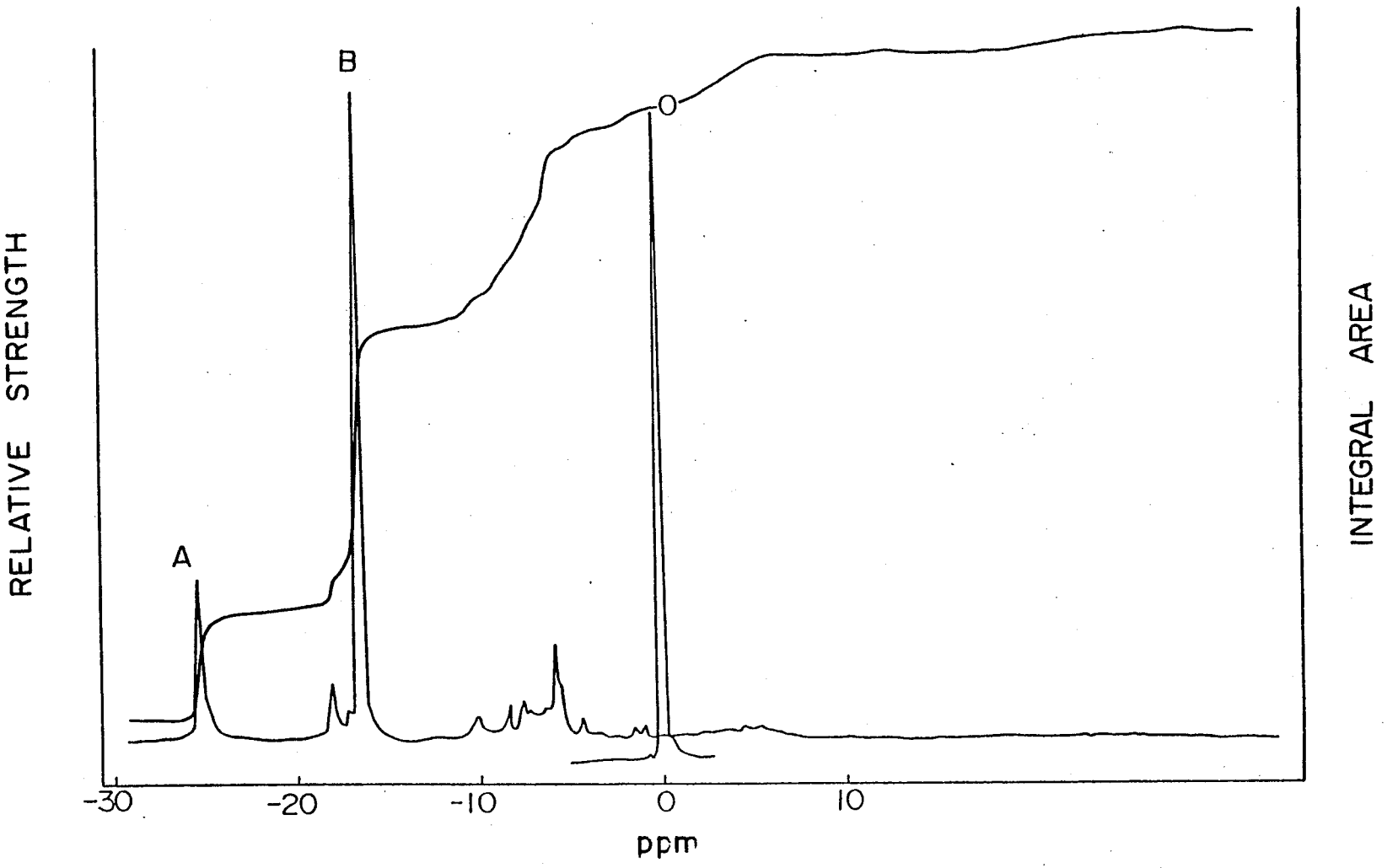
Figure 27:
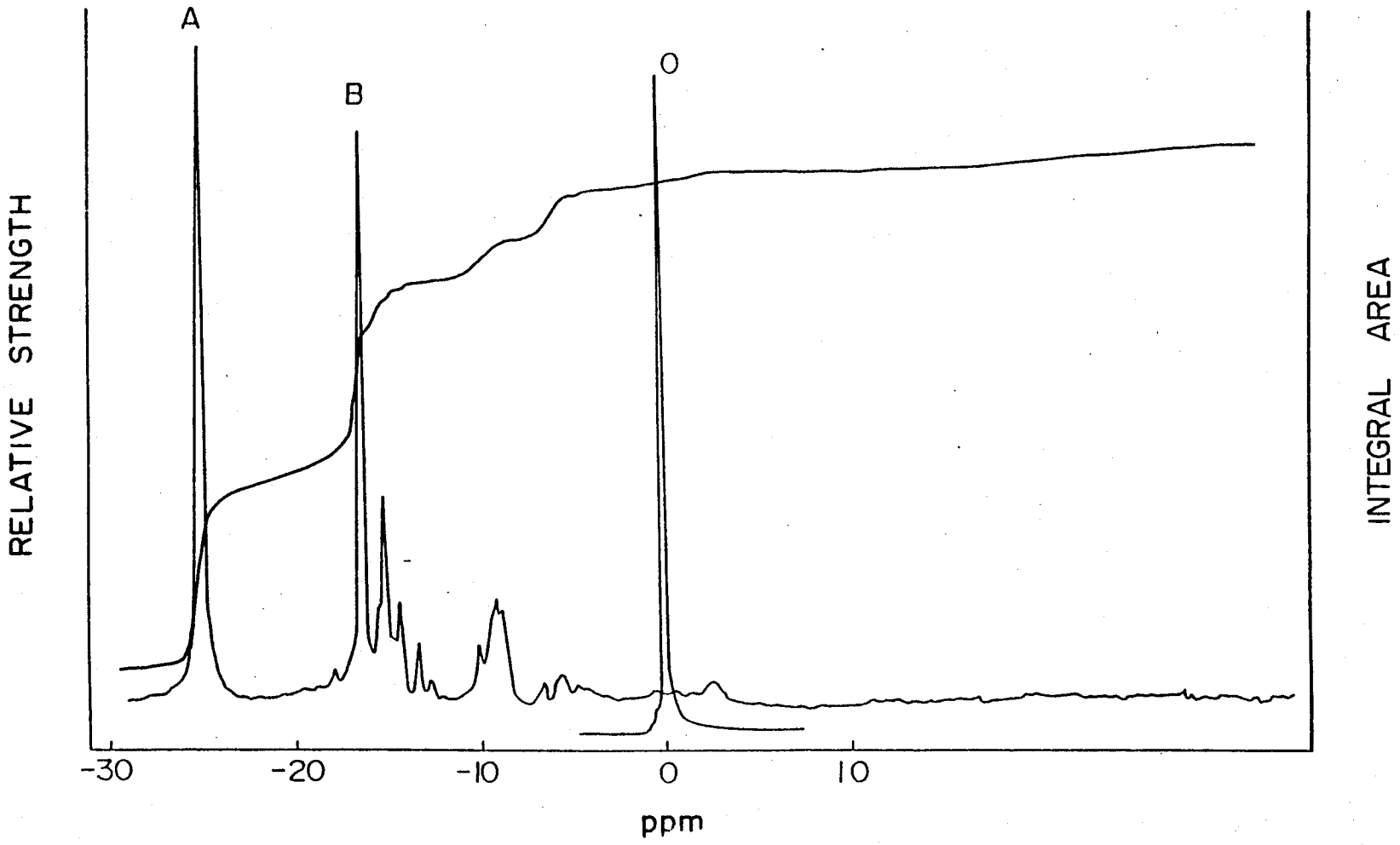

FIG. 19 shows NMR curve where the amidophosphazene compound was dissolved in 10% aqueous ammonia solution and the solution was aged at 50° C. for 24 hours. FIG. 20 shows NMR curve where the amidophosphazene compound was dissolved in 5% aqueous ammonia solution and the solution was aged at 50° C. for 85 hours. FIG. 21 shows NMR curve where the amidophosphazene compound was dissolved in 1% aqueous ammonia solution and the solution was aged at 50° C. for 23 hours. FIG. 22 shows NMR curve where the amidophosphazene compound was dissolved in 1% aqueous ammonia solution and the solution was aged at 50° C. for 69 hours. FIG. 23 shows NMR curve where the amidophosphazene compound was dissolved in 0.1% aqueous ammonia solution and the solution was aged at 50° C. for 85 hours. FIG. 24 shows NMR curve where the amidophosphazene compound was dissolved in 1% aqueous phosphoric acid solution and the resulting solution was aged at 50° C. for 60 hours. FIG. 25 shows NMR curve where the amidophosphazene compound was dissolved in water and the solution was aged at 50° C. for 36 hours. FIG. 26 shows NMR curve where the amidophosphazene compound was dissolved in 1% aqueous ammonia solution and the solution was aged at 60° C. for 15 hours and then further aged at 20° C. for 10 days. FIG. 27 shows NMR curve where the amidophosphazene compound was dissolved in 10% aqueous ammonia solution and the solution was aged at 20° C. for 20 hours.

Figure 28:
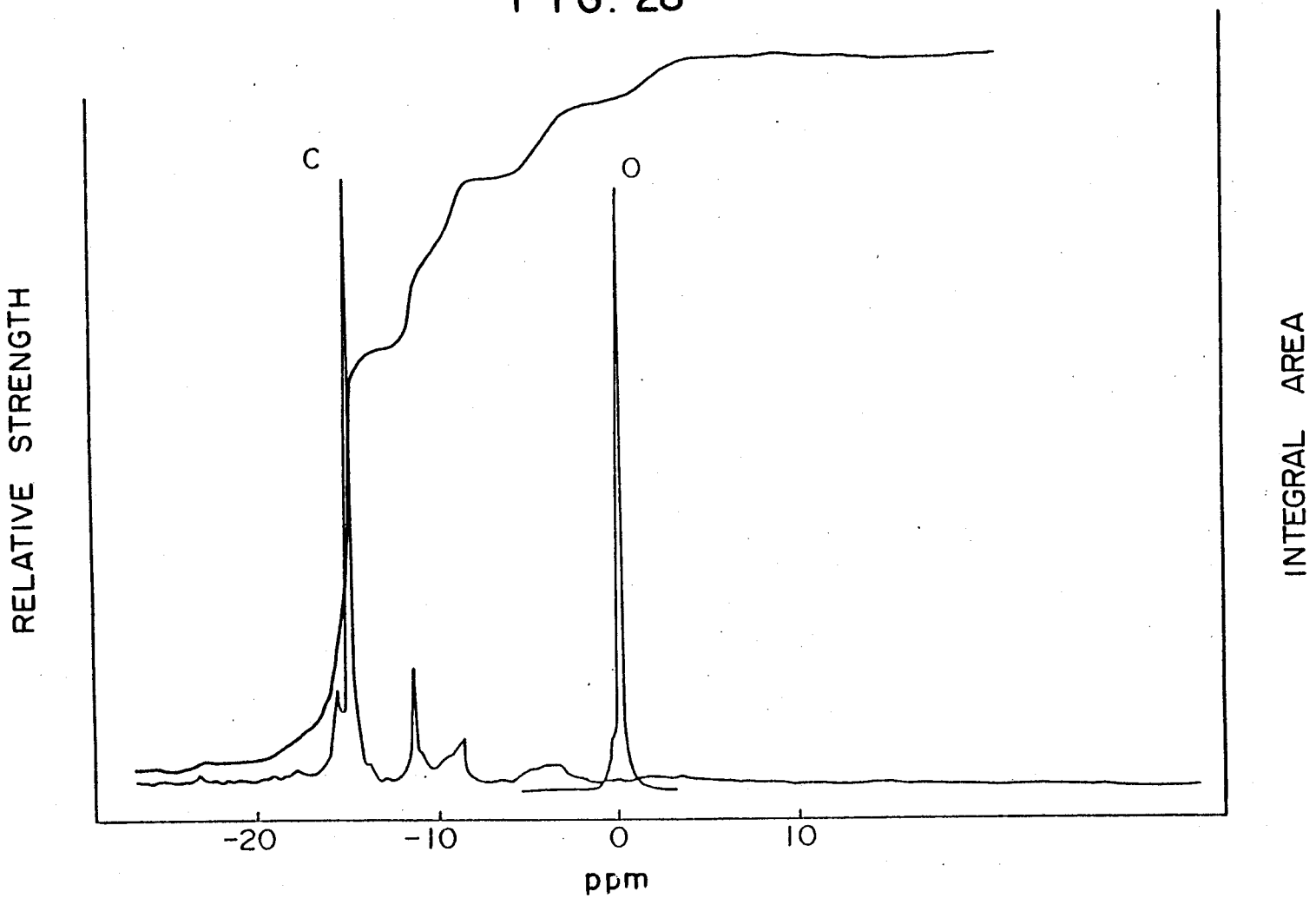

FIG. 28 shows NMR curve of 31P of unaged amidophosphazene compound (Lot No. GH-605; purity: 41.7% and ammonium chloride: about 58%) different in Lot. No. from those used for FIGS. 13 and 18. Peak C is a peak of the main component of the compound.

Figure 29:
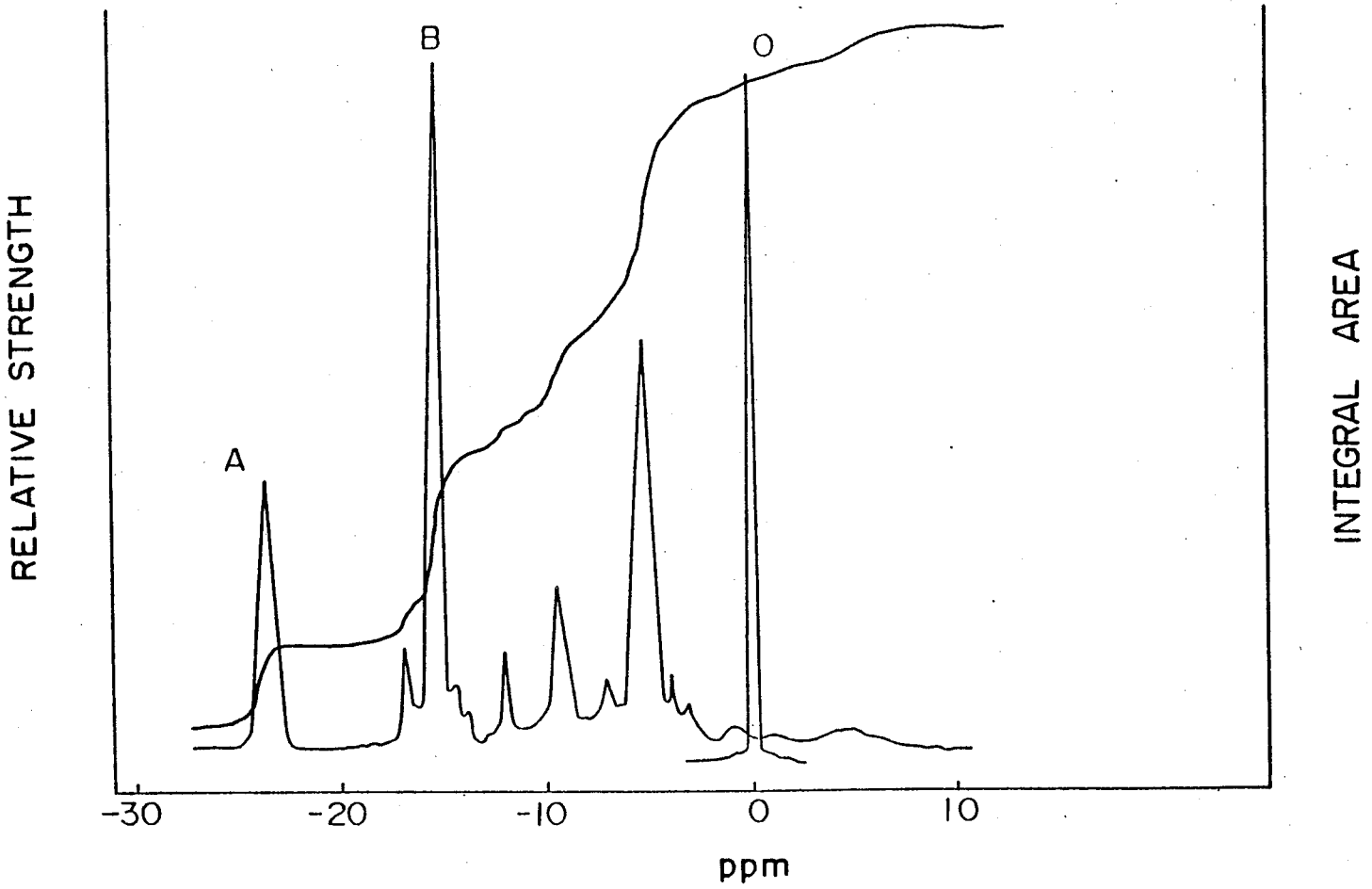
Figure 30:
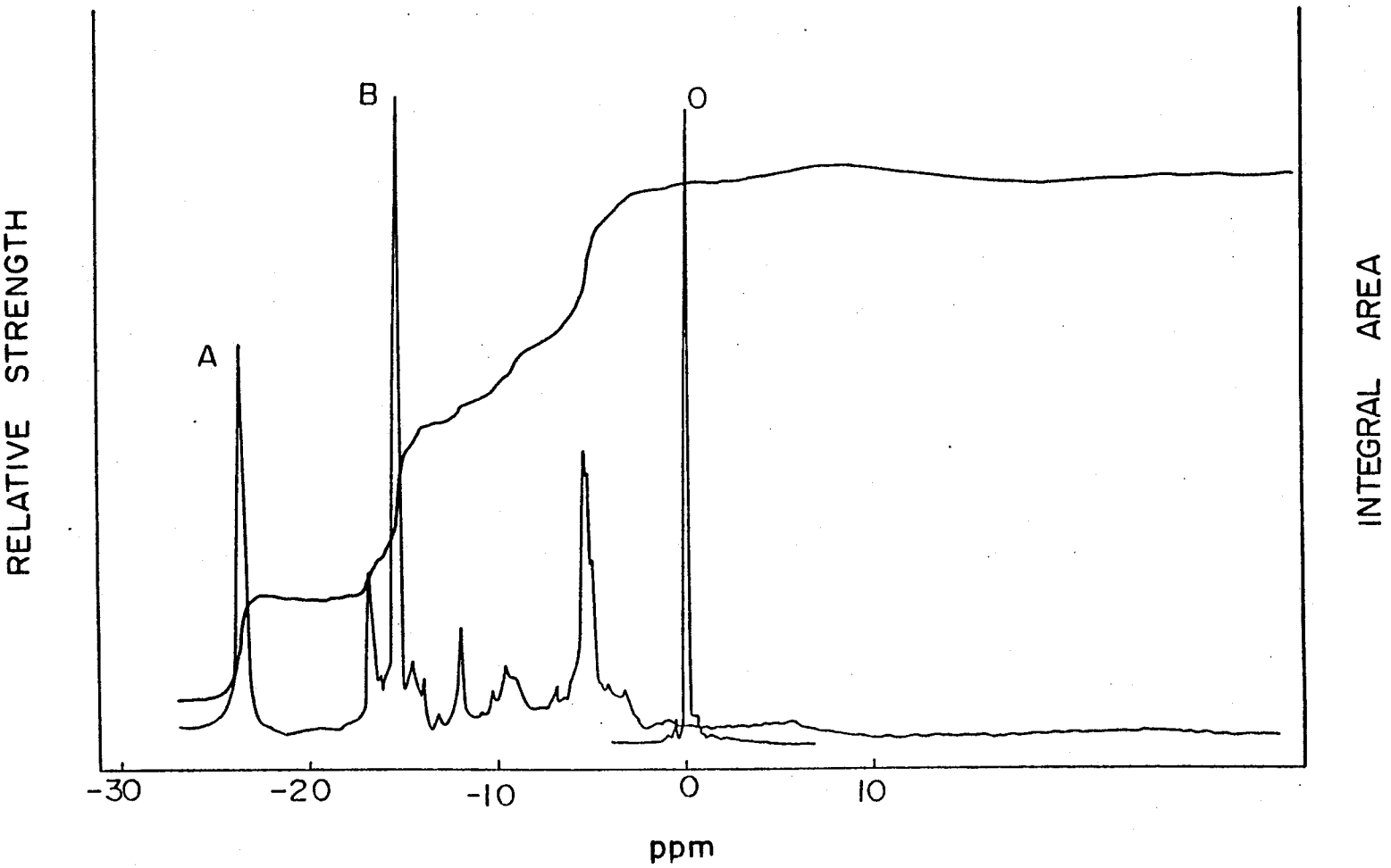
Figure 31:
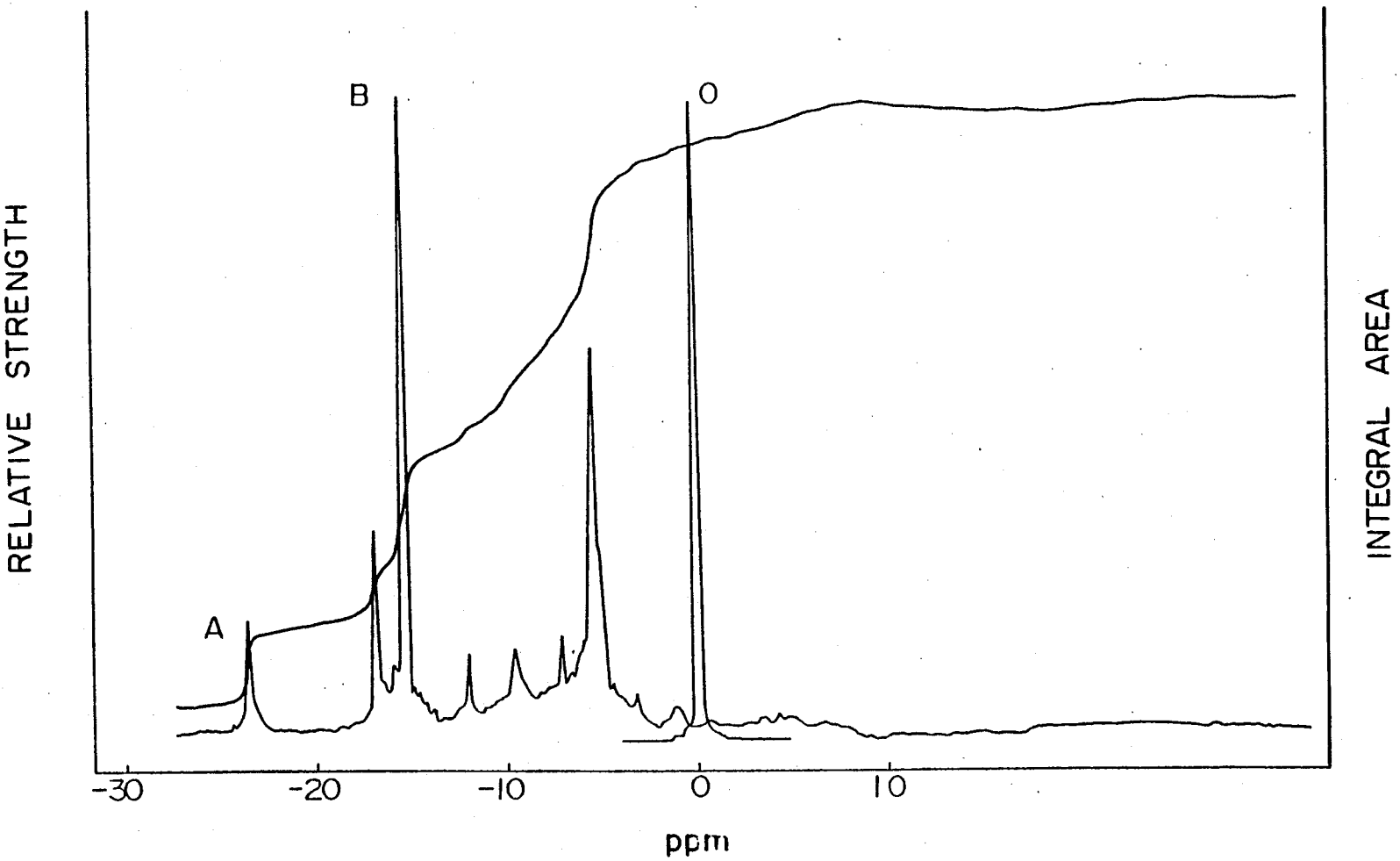

FIGS. 29-31 show NMR curves of 31P of aqueous solution of amidophosphazene compound which was prepared by dissolving the same amidophosphazene compound as used in FIG. 28 in respective aqueous solutions at a concentration of 400 g/l and which was aged under respective conditions. FIG. 29 shows NMR curve where the amidophosphazene compound was dissolved in 1% aqueous diammonium hydrogenphosphate solution and the resulting solution was aged at 40°

C. for 16 hours. FIG. 30 shows NMR curve where the amidophosphazene compound was dissolved in 1% aqueous sodium hydroxide solution and the resulting solution was aged at 40° C. for 16 hours and was further aged at 20° C. for 3 days. FIG. 31 shows NMR curve where the amidophosphazene compound was dissolved in 1% aqueous oxalic acid solution and the resulting solution was aged at 45° C. for 20 hours.

Figure 32:
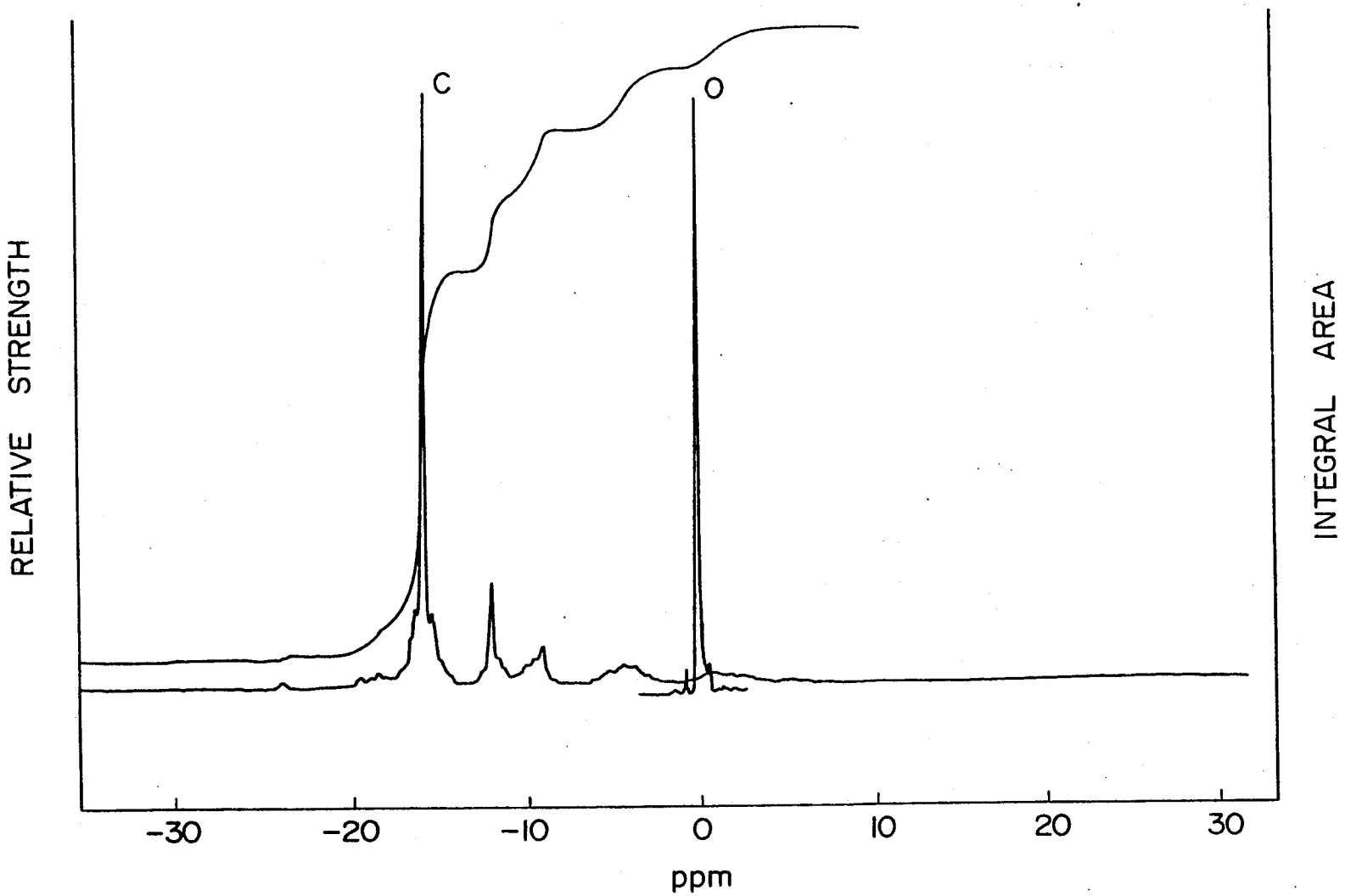
Figure 33:
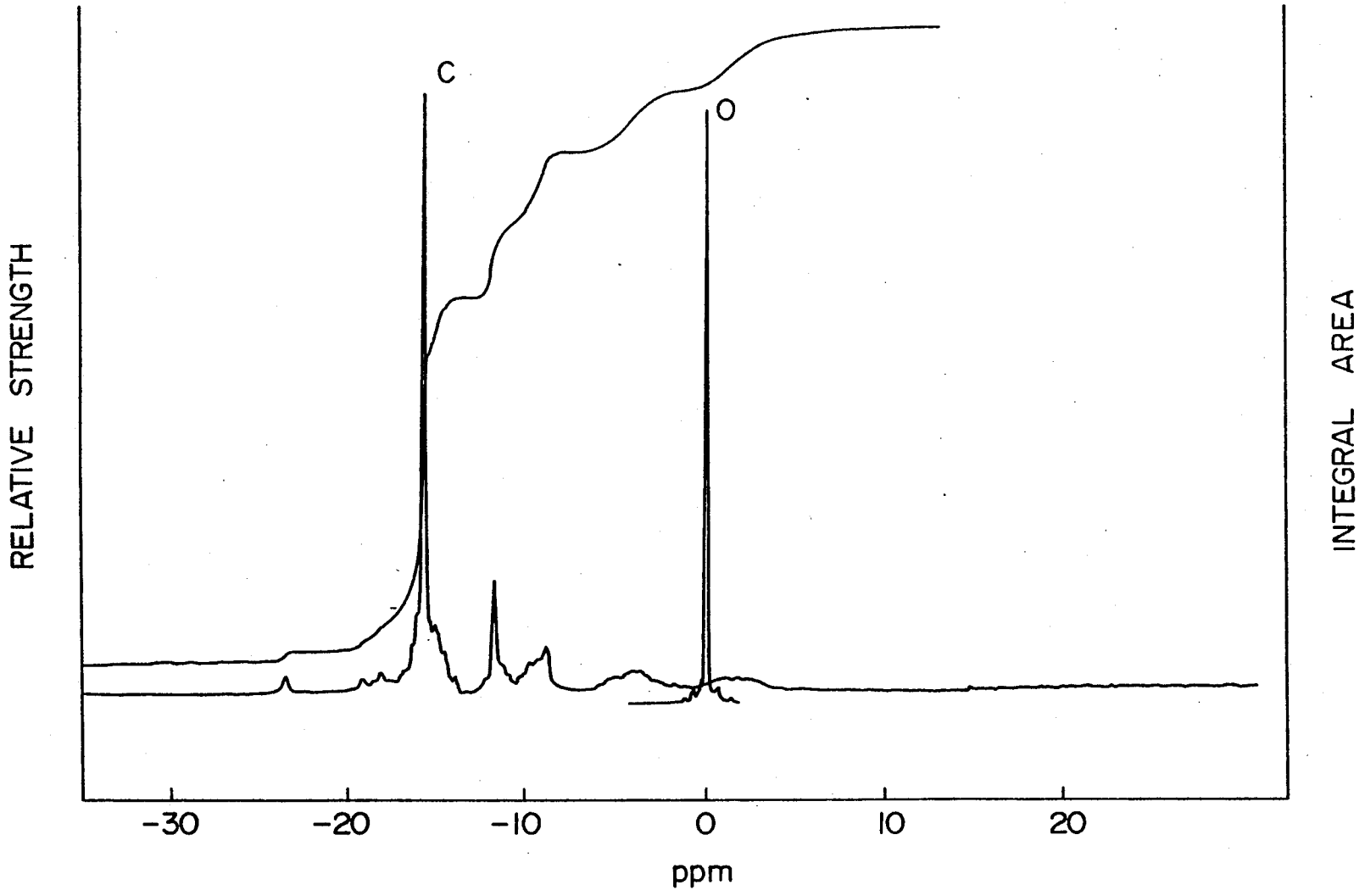
Figure 34:
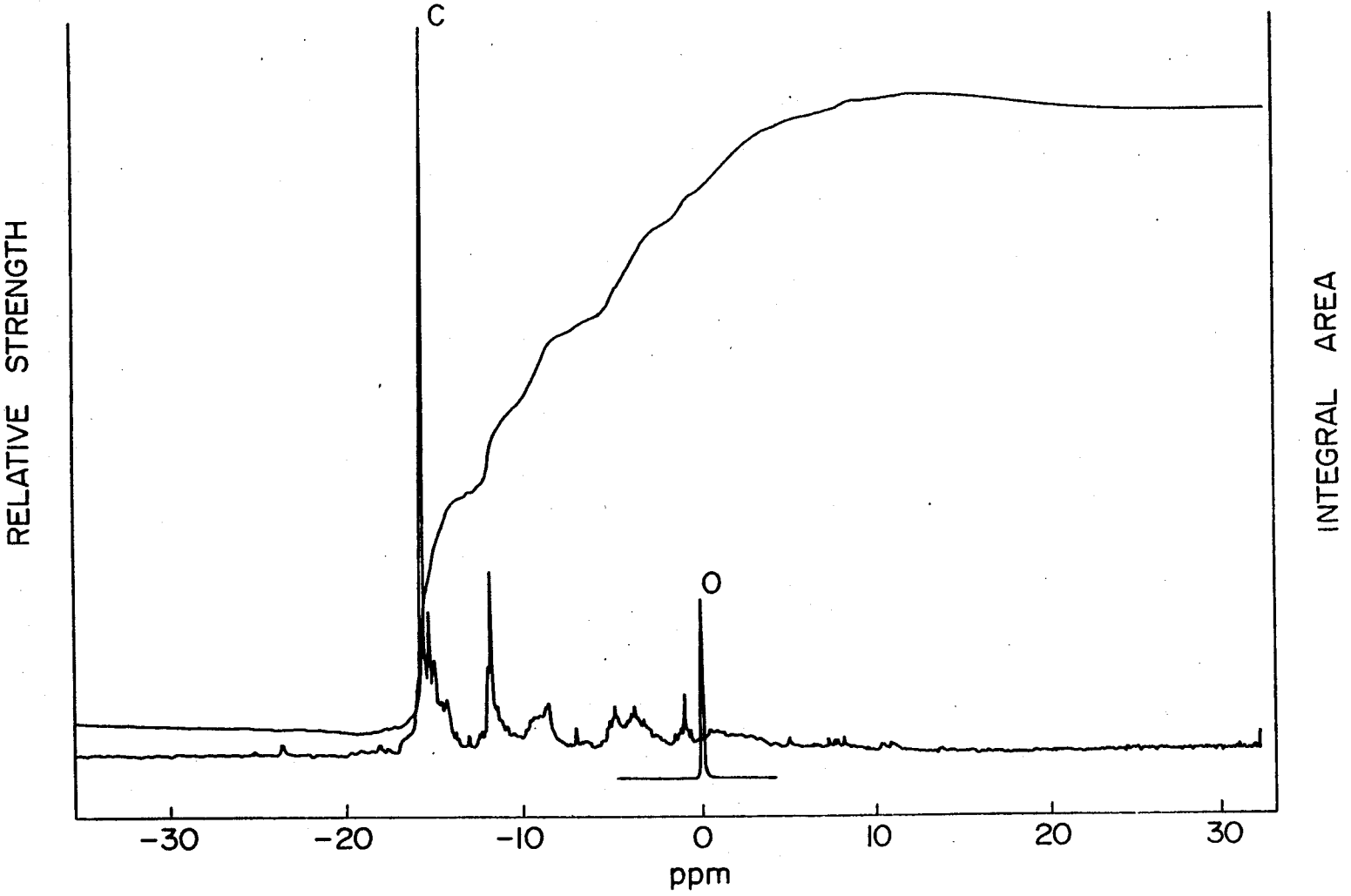
Figure 35:
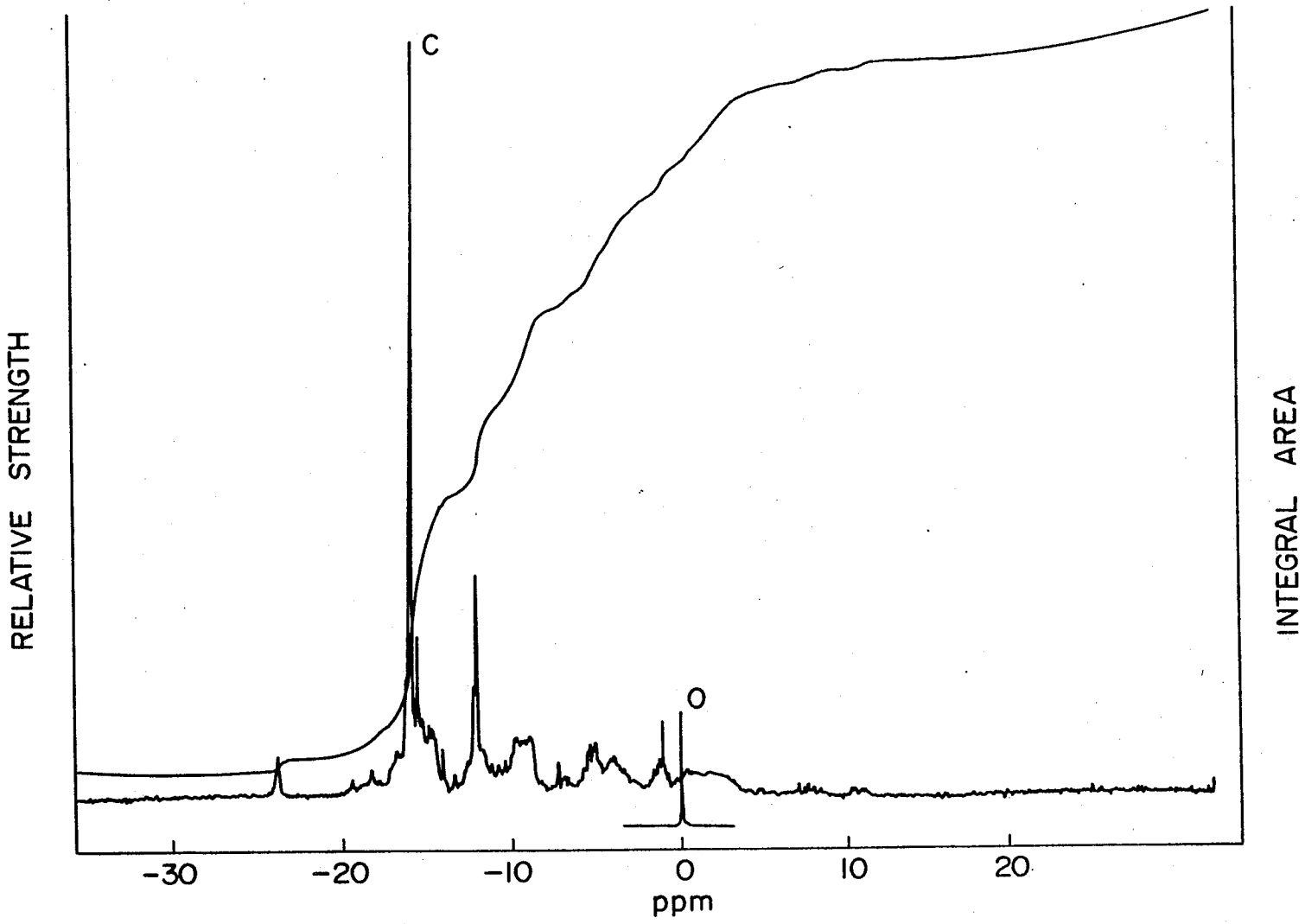
Figure 36:
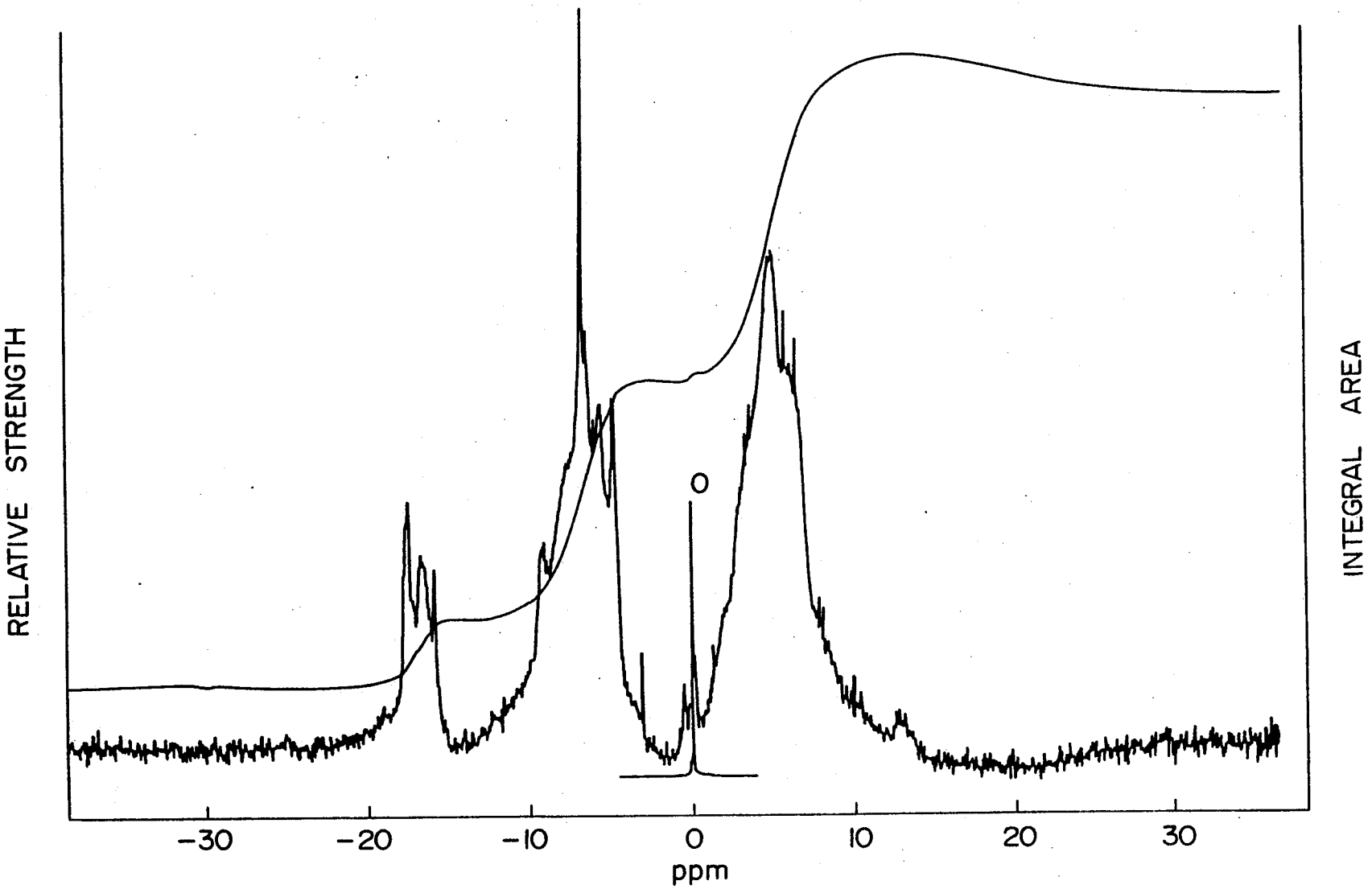
Figure 37:
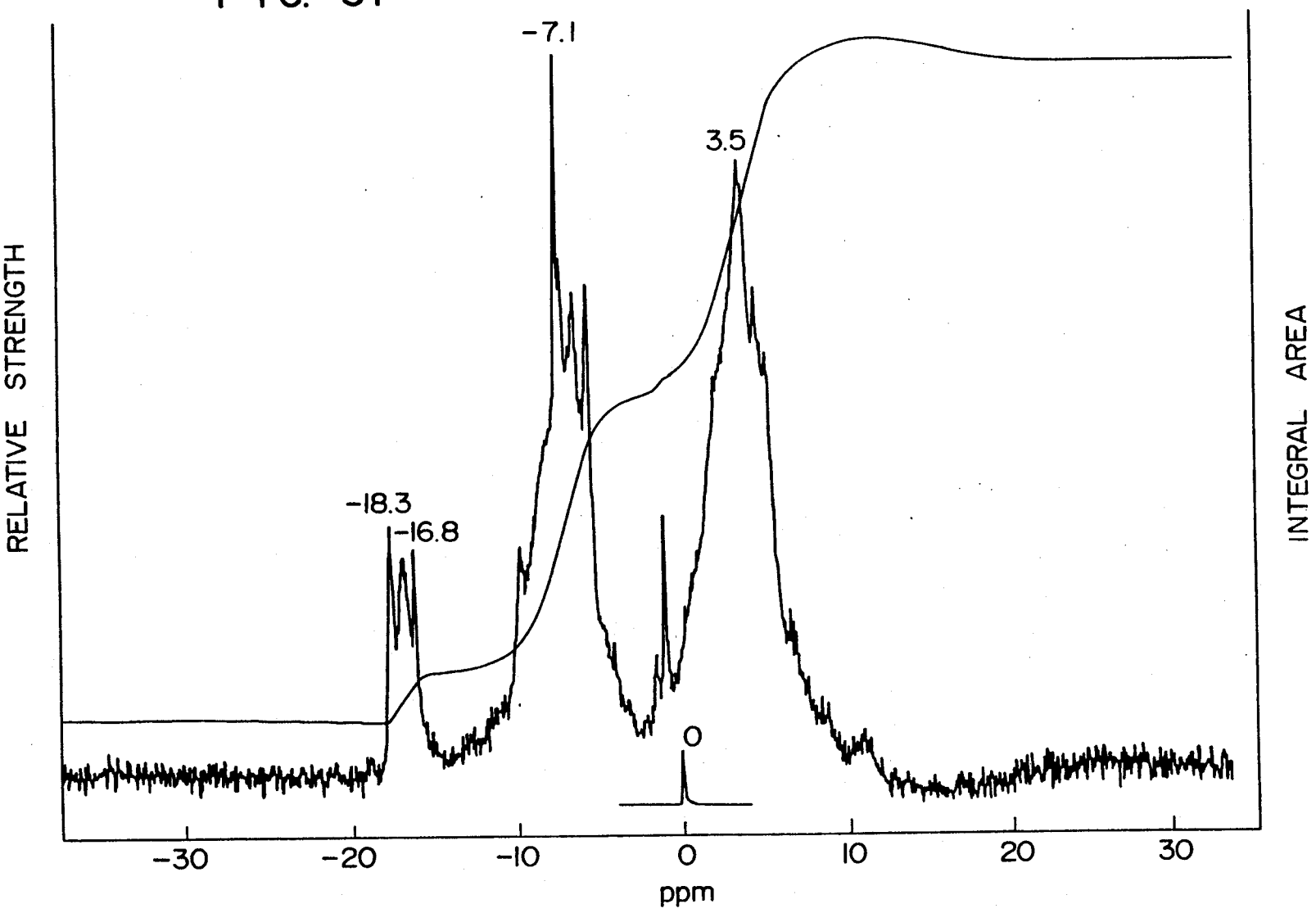
Figure 38:
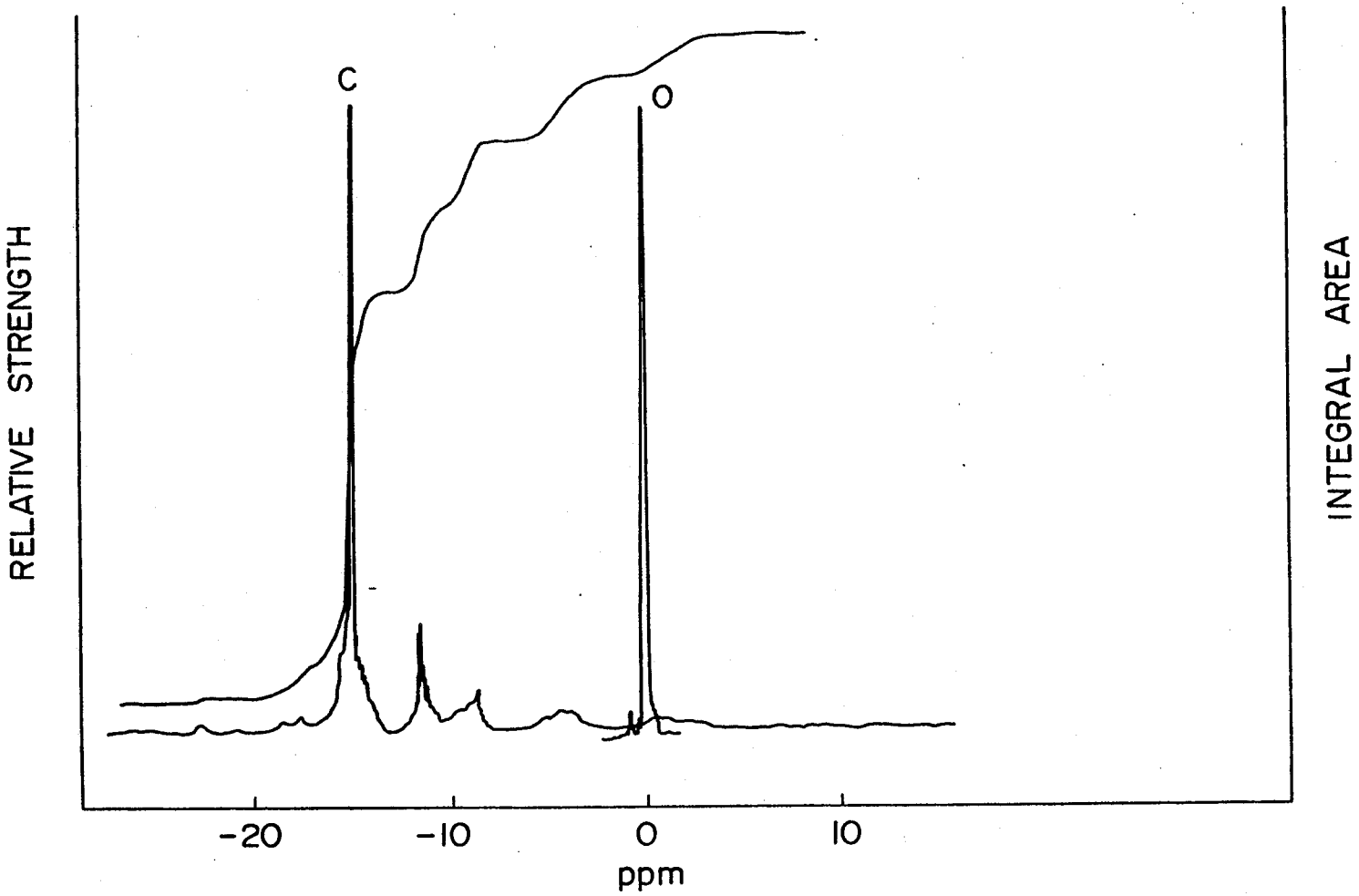
Figure 39:
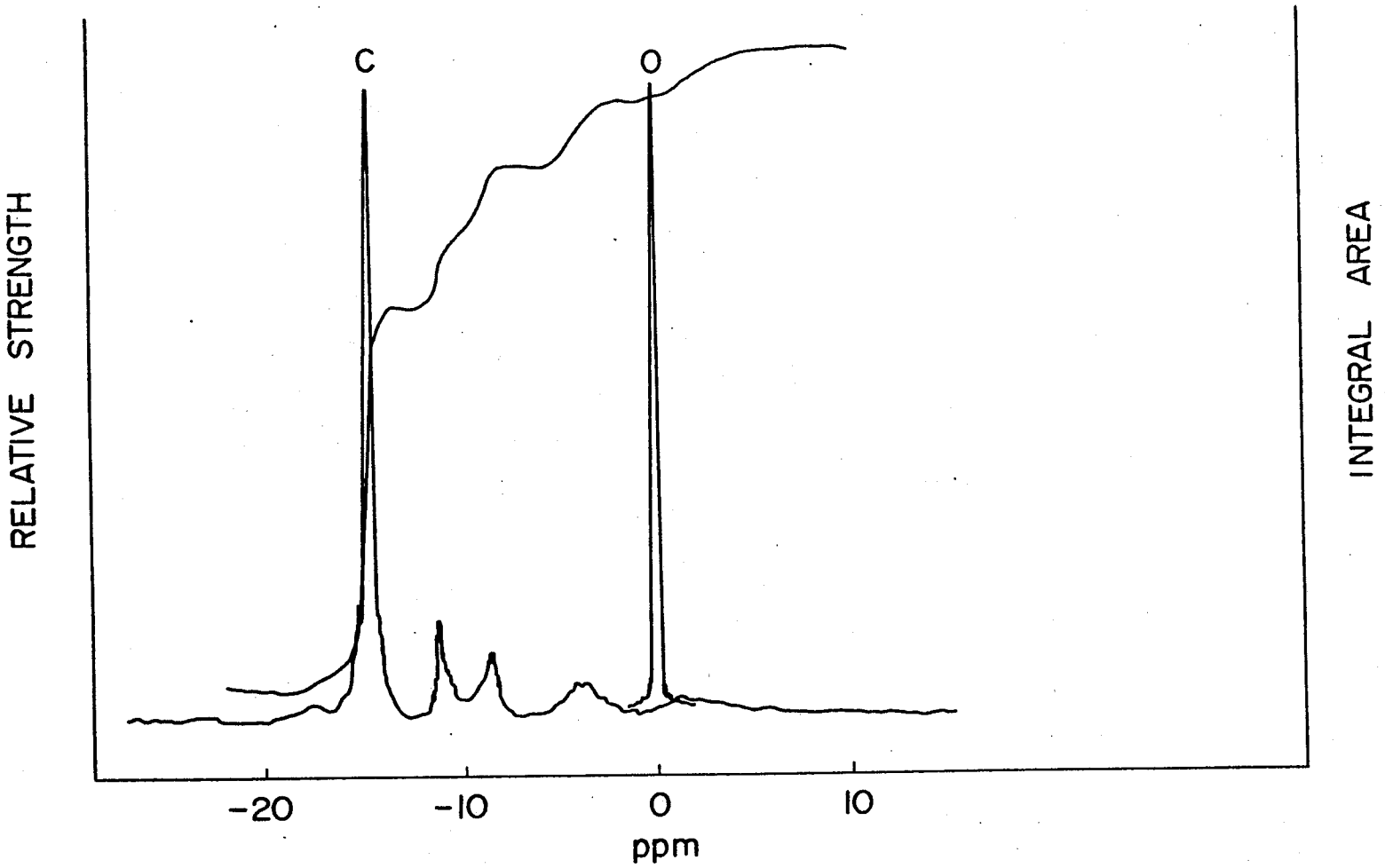

FIG. 32–FIG. 37 show that absorptions at peak A and peak B of NMR absorption spectrum do not occur if in general resin treatment, treating solution is kept within the general longest time of 10 hours of from preparation to use thereof. In the case of FIG. 32, amidophosphazene compound (Lot No. GB-0345 manufactured by Nippon Soda Co., Ltd.) was dissolved in water at a concentration of 400 g/l and immediately subjected to measurement. Peak A and peak B are not seen. In the case of FIG. 33, amidophosphazene compound (Lot No. GB-0345 manufactured by Nippon Soda Co., Ltd.) was dissolved in water at a concentration of 400 g/l and the solution was left to stand for 3 hours at 26° C. and then was subjected to the measurement. Peak A and peak B are not seen. In the case of FIG. 34, amidophosphazene compound (Lot No. GB-0345 manufactured by Nippon Soda Co., Ltd.) was stored for 2 years, then dissolved in water at a concentration of 400 g/l and immediately subjected to the measurement. Peak A and peak B are not seen. In the case of FIG. 35, amidophosphazene compound (Lot NO. GB-0345 manufactured by Nippon Soda Co., Ltd.) was dissolved in water at a concentration of 400 g/l and the solution was left to stand for 10 hours at 26° C. and then subjected to the measurement. Peak A and peak B are not seen. Peak C seen in FIG. 32–FIG. 35 is a peak of trimer of amidophosphazene and is reduced by aging, being different from peak B. In the case of FIG. 36, phosphorus amide compound (Lot No. HE-125 manufactured by Nippon Soda Co., Ltd.) was dissolved in water at a concentration of 400 g/l and immediately subjected to the measurement. Peak A and peak B are not seen. In the case of FIG. 37, phosphorus amide compound (Lot No. HE-125 manufactured by Nippon Soda Co., Ltd.) was dissolved in water at a concentration of 400 g/l and the solution was left to stand for 10 hours at 26° C. and then subjected to measurement. Peak A and peak B are not seen. That is, from the fact that peak A and peak B are not seen in all of FIG. 32–FIG. 37, it can be seen that the aging of the present invention is not performed both when amidophosphazene compound or phosphorus amide compound is merely left to stand as it is and when it is dissolved in water and is left to stand for 10 hours at 26° C. FIG. 38–FIG. 42 are NMR curves of unaged amidophosphazene compound and unaged phosphorus amide compound. In the case of FIG. 38, amidophosphazene compound (Lot No. AA-1000AGB-0345 manufactured by Nippon Soda Co., Ltd.) was dissolved in water at a concentration of 400 g/l and immediately subjected to the measurement. In the case of FIG. 39, amidophosphazene compound (Lot No. AA-1000AGJ-006 manufactured by Nippon Soda Co., Ltd.) was dissolved in water at a concentration of 400 g/l and immediately subjected to the measurement. In the case of FIG. 39, amidophosphazene compound (Lot No. AA-1000AGJ-006 manufactured by Nippon Soda Co., Ltd.) was dissolved in water at a concentration of 400 g/l and immediately subjected to the measurement. In the case of FIG. 41, amidophosphazene compound (Lot No. AA-1000AGJ-007 manufactured by Nippon Soda Co., Ltd.) was dissolved in water at a concentration of 400 g/l and immediately subjected to the measurement. In the case of FIG. 42, phosphorus amide compound (Lot No. HC-15 manufactured by Nippon Soda Co., Ltd.) was dissolved in water at a concentration of 400 g/l and immediately subjected to the measurement. Peak A and peak B are not seen in FIGS. 38–42.

Aging conditions are those under which peak A or/and peak B are formed (Resonance magnetic field of compounds in which amido group is substituted with other substituent is different from that of those having no such substituent, but there is no difference in effect. See, for example, FIGS. 2 and 7.). Preferred aging temperature is 10°–60° C. Preferred aging time is 6 hours–10 days. These aging temperature and time vary depending on solvent and catalyst added. For example, when phosphorus amide compound or amidophosphazene compound is dissolved in 14% aqueous ammonia and 50° C. is employed, the aging can be performed within 10 hours. Further, when it is dissolved in only water, the aging can be performed at 20° C. for 2 days. When it is dissolved in only water, the aging cannot be attained within 10 hours.

Preferred aqueous solution is aqueous ammonia solution.

With reference to FIGS. 1–42, contents (%) of peak A and peak B of respective graphs and total content thereof are shown in the following Table 1.

TABLE 1

Contents (%) of peak A and peak B and total content thereof

| | FIG. 1 | FIG. 2 | FIG. 3 | FIG. 4 | FIG. 5 | FIG. 6 | FIG. 7 | FIG. 8 | FIG. 9 | FIG. 10 | FIG. 11 | FIG. 12 | FIG. 13 | FIG. 14 |
|---|---|---|---|---|---|---|---|---|---|---|---|---|---|---|
| Content of peak A (%) | 0 | 25 | 22 | 0 | 26 | 0 | 0 | 0 | 12 | 5 | 6 | 9 | 0 | 9 |
| Content of peak B (%) | 0 | 38 | 42 | 0 | 42 | 0 | 0 | 0 | 44 | 38 | 37 | 50 | 0 | 1 |
| Content of peak A + peak B (%) | 0 | 63 | 64 | 0 | 68 | 0 | 0 | 0 | 56 | 43 | 43 | 59 | 0 | 10 |

| | FIG. 15 | FIG. 16 | FIG. 17 | FIG. 18 | FIG. 19 | FIG. 20 | FIG. 21 | FIG. 22 | FIG. 23 | FIG. 24 | FIG. 25 | FIG. 26 | FIG. 27 | FIG. 28 |
|---|---|---|---|---|---|---|---|---|---|---|---|---|---|---|
| Content of peak A (%) | 37 | 43 | 37 | 0 | 33 | 13 | 21 | 13 | 3 | 4 | 15 | 15 | 27 | 0 |
| Content of peak B (%) | 7 | 22 | 36 | 0 | 24 | 53 | 21 | 29 | 21 | 14 | 14 | 36 | 25 | 0 |
| Content of peak A + peak B (%) | 44 | 65 | 73 | 0 | 57 | 66 | 42 | 42 | 24 | 18 | 29 | 51 | 52 | 0 |

TABLE 1-continued

Figure 40:
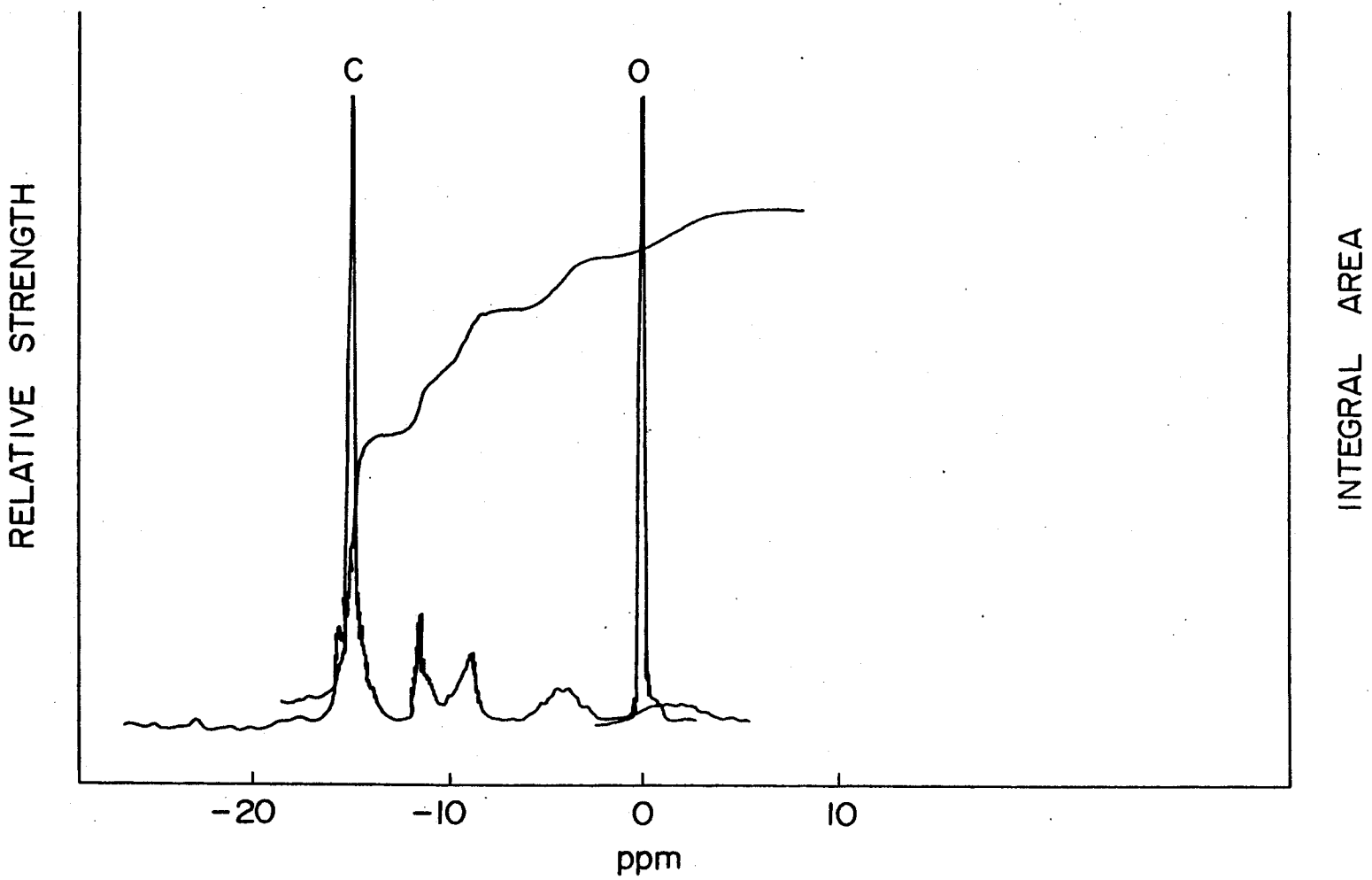
Figure 41:
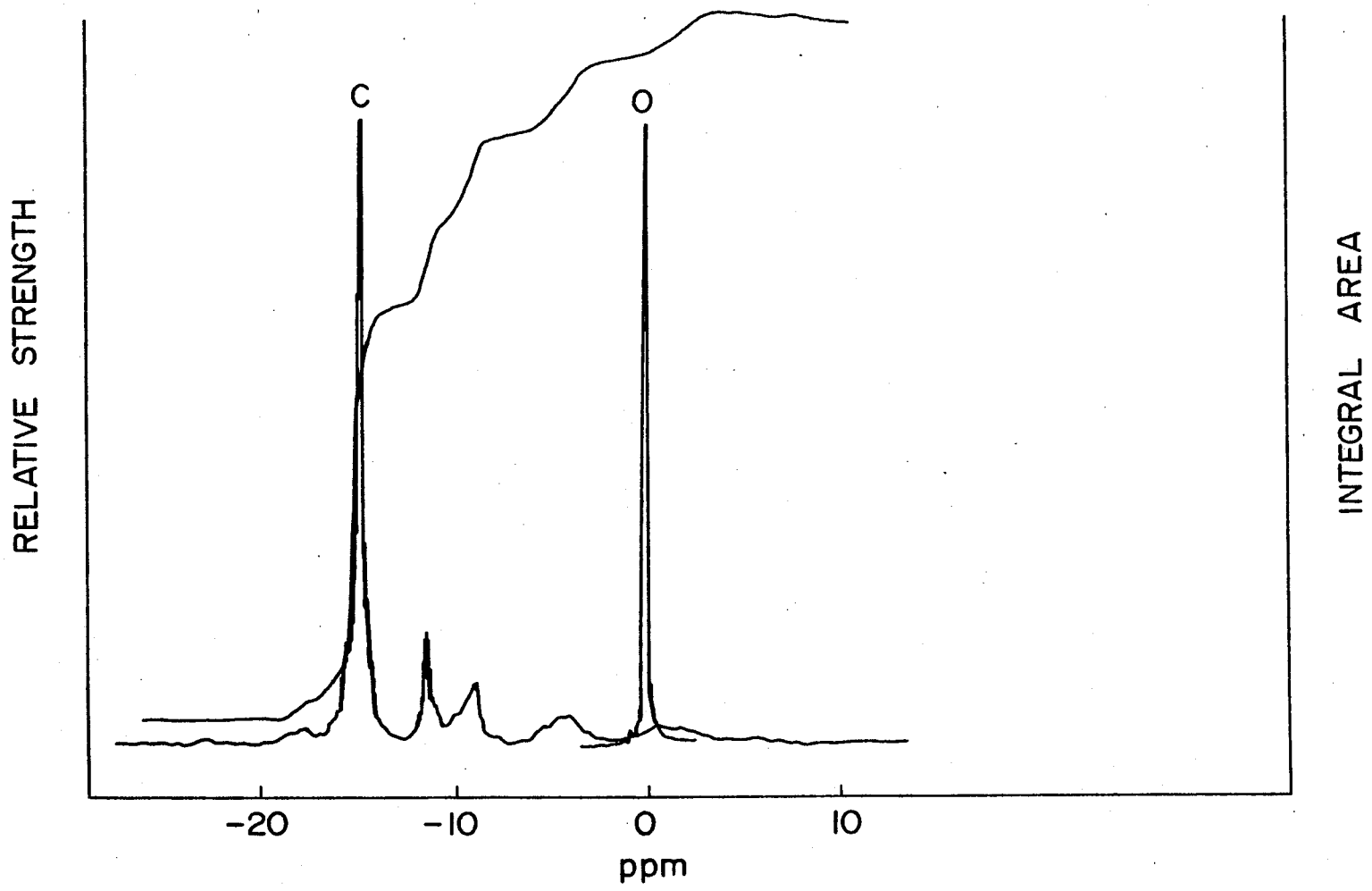
Figure 42:
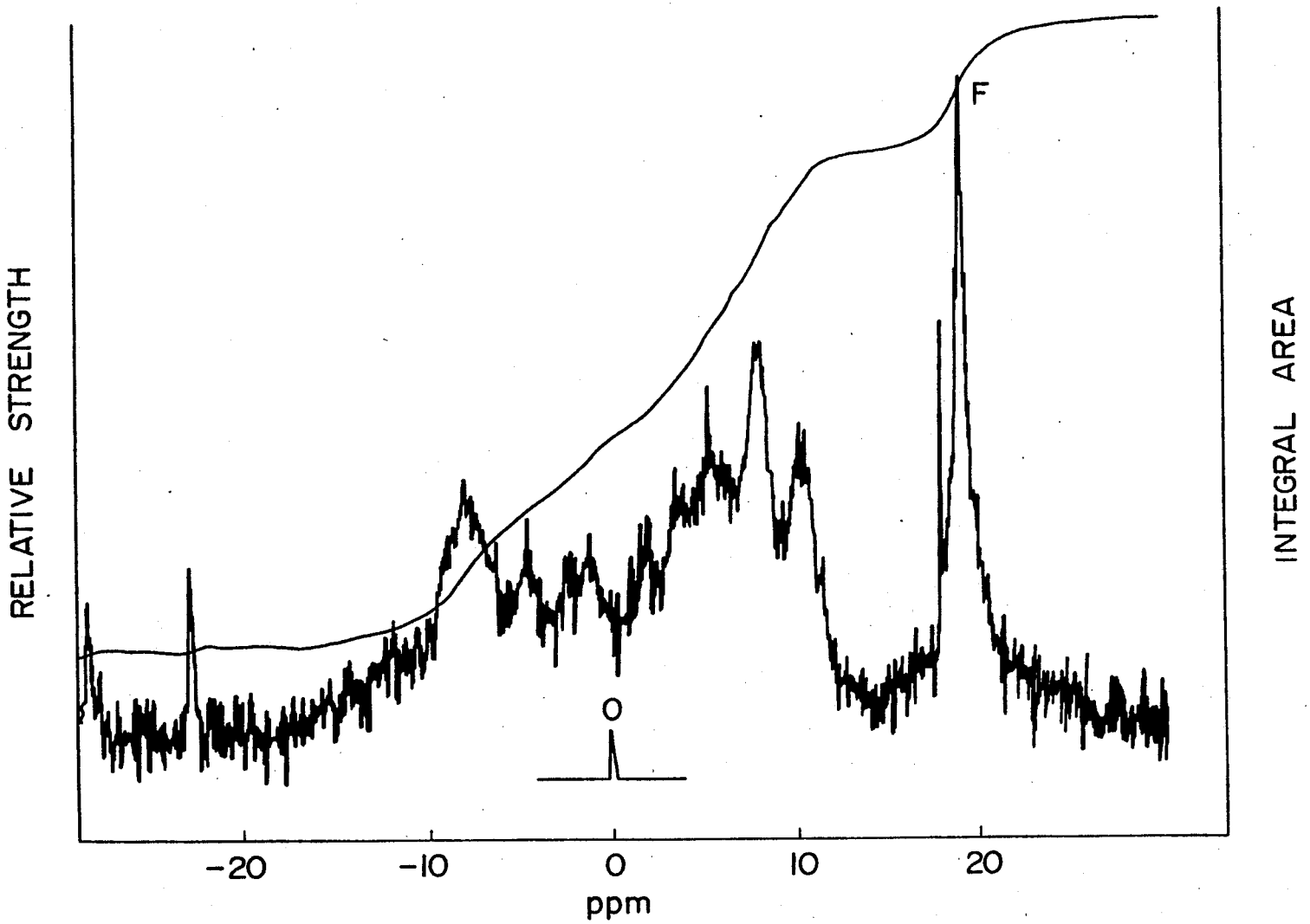

| | Contents (%) of peak A and peak B and total content thereof | | | | | | | | | | | | | |
|---|---|---|---|---|---|---|---|---|---|---|---|---|---|---|
| | FIG. 29 | FIG. 30 | FIG. 31 | FIG. 32 | FIG. 33 | FIG. 34 | FIG. 35 | FIG. 36 | FIG. 37 | FIG. 38 | FIG. 39 | FIG. 40 | FIG. 41 | FIG. 42 |
| Content of peak A (%) | 11 | 20 | 11 | 0 | 0 | 0 | 0 | 0 | 0 | 0 | 0 | 0 | 0 | 0 |
| Content of peak B (%) | 22 | 21 | 18 | 0 | 0 | 0 | 0 | 0 | 0 | 0 | 0 | 0 | 0 | 0 |
| Content of peak A + peak B (%) | 33 | 41 | 29 | 0 | 0 | 0 | 0 | 0 | 0 | 0 | 0 | 0 | 0 | 0 |

According to this invention, a treating agent mainly composed of the aged aqueous solution of phosphorus amide compound or amidophosphazene compound as explained hereabove (referred to as "treating agent" hereinafter) is allowed to adhere to a fabric. The treating agent may be used alone, but there may be added as auxiliary components an acidic catalyst such as diammonium phosphate, ammonium chloride, organic amine hydrochloride, zinc chloride, magnesium chloride, zinc nitrate, zinc borofluoride, hydrochloric acid or phosphoric acid and a small amount of conventionally used resin treating agent, softening agent, penetrant, water repellant and/or cellulose crosslinking agent.

The treating agent may be allowed to adhere (attach) to fabric by a method of dipping a fabric in the aqueous solution and then squeezing the fabric as it is or by roll or mangle, a method of spraying or coating the aqueous solution to a fabric and the like.

Amount of the treating agent to be allowed to adhere (attach) to fabric is preferably such that the weight gain of the treating agent is 2–7% by weight of the starting cellulosic material. If this amount is too small, shrink proofing effect is low and if it is too much, strength may decrease for some materials of the fabric.

Basic materials for cellulosic materials to be treated in accordance with this invention are cellulosic fibers. As examples thereof, mention may be made of viscose rayon filaments, viscose rayon staples, high-tenacity viscose rayon filaments, high-tenacity viscose rayon staples, polynosics, cuprammonium filaments, cuprammonium staples, cotton, ramie and linene. Furthermore, the basic materials may be blended with a small amount of any other fibers, for example, organic synthetic fibers such as polyamide, polyester, polyacrylonitrile, polypropylene and spandex, and inorganic synthetic fibers such as glass fibers, carbon fibers and silicon carbide fibers. In case of fabrics, they may be in any forms such as woven fabrics, knitted fabrics, nonwoven fabrics, resin treated fabrics and sewn products.

After application of the treating agent to fabrics, the fabrics are subjected to heat treatment. For this heat treatment, there may be used any heat sources such as hot air, infrared rays, microwave and steam. The heat treatment may be one heat treatment or two or more heat treatments. Preferred heat treating temperature is 50°–190° C. and preferred heat treating time is 1–30 minutes. These temperature and time may be suitably selected from those which do not damage the fabrics. By this heat treatment, the treating agent becomes sparingly soluble in water and is fixed on the fabrics. After the heat treatment, it is preferred to subject the fabrics to washing with warm water or the like to remove water-soluble components in the fabrics.

In the fabric obtained by the method of treatment according to this invention, amount of phosphorus itself in the treating agent which adheres to the fabric after treatment is preferably 0.3–2.0% by weight based on the weight of the treated cellulosic material, amount of free formaldehyde in the treated fabric is less than 10 μg/g and washing shrink is less than 4%.

Phosphorus content, amount of free formaldehyde, wear resistance, shrink after washings of 45 times, whiteness and bending characteristic are measured in the following manners.

(1) Measurement of phosphorus content (% by weight):

The phosphorus content (% by weight) in fabric is measured by the sulfuric acid decomposition-colorimetric method explained below.

Reagents:

1. Sulfuric acid for accurate analysis (special grade, 98%)

2. 60% Perchloric acid

3. Ammonium molybdate solution: This is prepared by dissolving 17.7 g of ammonium molybdate (first class grade) in water to obtain 500 ml of the solution.

4. Ammonium metavanadate solution: This is prepared by dissolving 0.6 g of ammonium metavanadate (first class garde) in water, adding thereto 100 ml of 60% perchloric acid and diluting with water to 500 ml.

Measuring apparatuses:

Chemical balance, 50 ml Kjeldahl flask, 10 ml pipette, 5 ml pipette, Kjeldahl heat decomposition stand, 25 ml measuring flask, 50 ml measuring flask, 50 ml measuring cylinder, 500 ml measuring flask, 100 ml measuring cylinder, zeolite, spectrophotometer.

Procedure:

1. Decomposition treatment of sample:

200–300 mg of an oven-dried sample is accurately weighed by a chemical balance and taken in a 50 ml Kjeldahl flask. Thereto are added 5 ml of water, 5 ml of sulfuric acid and several particles of zeolite (made of glass) and the flask is set on a Kjeldahl heat decomposition stand and the sample is subjected to heat decomposition. When the sample is carbonized and dissolves in sulfuric acid to turn brown (about 30 minutes after beginning of heating), heating is discontinued, followed by leaving it for 5 minutes for cooling. Then, 3 drops of 60% perchloric acid are added to the sample and heat decomposition is performed again. The operation of heat decomposition—cooling—addition of perchloric acid is repeated until the decomposition liquid becomes colorless and transparent to perform complete decomposition. Then, the decomposition liquid is cooled to room temperature and is washed with water in a 25 ml measuring flask to dilute until the content reaches scale mark.

2. Measurement:

Depending on estimated phosphorus content, the decomposition liquid is weighed in a 50 ml measuring flask and 30 ml of water is added thereto. Thereafter, 5 ml of ammonium molybdate and 5 ml of ammonium metavanadate are added thereto and the content is diluted with water until it reaches scale mark. Simultaneously, a blank test is conducted in the similar manner. After leaving the sample liquid for 30 minutes, absorbance at 400 nm is measured using the blank sample as a control liquid.

| Estimated phosphorus content | Amount of decomposition liquid taken |
|---|---|
| 0.5–15% | 0.5 ml |
| 0.1–3% | 2.5 ml |

3. Calculation:

$$P(\%) = \frac{\frac{25}{\text{Amount of decomposition liquid taken}} \times \frac{50}{1000} \times 11.65 \times \text{Absorbance} \times 100}{\text{Amount of sample taken (mg)}}$$

(11.65 mg/ml = Ab 1.0)

$$= \frac{\frac{125}{\text{Amount of decomposition liquid taken}} \times 11.65 \times \text{Absorbance}}{\text{Amount of sample taken (mg)}}$$

Since phosphorus content in the treated fabric is 3% or less, amount of decomposition liquid of 2.5 ml is applied and calculation is effected as follows:

$$P(\%) = \frac{\text{Absorbance} \times 11.65 \times 50}{\text{Amount of sample taken (mg)}}$$

(2) Measurement of free formaldehyde:

Measurement is conducted in accordance with JIS L 1096-1979, paragraph 6.39.1.2, (1) method B-1.

(3) Measurement of abrasion resistance:

Measurement is conducted in accordance with JIS L 1096-1979, 6.17.1 A-2 method.

(4) Measurement of shrinkage after washings of 45 times:

(a) Collection of sample and preparation of specimen:

A specimen of 40×40 cm is prepared by the method of collection of sample and preparation of specimen mentioned in JIS L-1042-1983: paragraph 7.

(b) Washing:

Washing is carried out in the following manner in accordance with the test method for washing with water specified in the Notice No. 11 of the Fire Defence Board on June 1, 1973 "Standard for washing resistance in connection with flameproofness" (referred to as "Notice No. 11" hereinafter).

(i) Washing is carried out continuously for 75 minutes with liquid of 60° C. According to the method of Notice No. 11, washing time is 15 minutes, but here this is 15 minutes×5 (times)=75 minutes.

Other washing conditions than the washing time are the same as in Notice No. 11. Powder soap (one specified in JIS K3303) is used as detergent in an amount of 1 g for 1 liter of water.

(ii) The washing method of (i) (supply of water of 60° C.→introduction of detergent→introduction of specimen→washing with liquid of 60° C. for 75 minutes→discharge of water·supply of water·rinsing with water of 40° C.×3 times→discharge of water→dehydration for 2 minutes→drying at 60° C.) is repeated 9 times. Since the washing test of (i) is repetition of 5 times of washing, the repetition of 9 times of the method (i) means repetition of totally 45 times.

(c) Measurement:

Measurement is conducted after the washing in accordance with the method mentioned in JIS L-1042-1983: paragraph 9.

(d) Calculation:

Calculation is carried out by the method mentioned in JIS L-1042-1083: paragraph 10. That is, average value of length of three lines in lengthwise and widthwise directions, respectively is obtained and shrink is calculated by the following formula and expressed by average value of three times in lengthwise and widthwise directions, respectively.

$$\text{Progressive shrink (\%)} = \frac{L - L'}{L} \times 100$$

L: Length before washing (mm)

L': Length after washing (mm)

(5) Measurement of whiteness:

This is measured in accordance with the method B in JIS L-1013-1981, paragraph 7.20.

(6) Measurement of bending properties:

B (gf·cm²/cm) and 2HB (gf·cm/cm) are obtained by the method mentioned in "Standardization and analysis of evaluation of handling", the second edition (published from committee for measurement of handling and standardization thereof provided in Japan Society of Textile Machine), pages 27–28.

(7) Evaluation of staining resistance:

Evaluation is effected according to gray scale evaluation method for test of staining in color fastness test of Japanese Standard Society.

(8) Measurement of stiffness:

Measurement is effected according to JIS L 1096-1979, Par. 6.19.3 Method C (Clerk method).

This invention will be explained in more details by the following examples.

EXAMPLE 1

A crude phosphorus amide compound (Lot No. GL-08 manufactured by Nippon Soda Co., Ltd.; phosphorus amide compound: about 36.6% and ammonium chloride: about 63.4%) was dissolved in a 10% aqueous ammonia solution at a crude phosphorus amide compound concentration of 400 g/l. The resulting aqueous solution of phosphorus amide compound was aged at 50° C. for 50 hours (31P NMR curve of this aqueous solution is shown in FIG. 2) and diluted 3.96 times with water. In this diluted solution was dipped a scoured fabric comprising 100% of polynosics and having a basis weight of about 65 g/m². Then, this fabric was squeezed by mangles to obtain a pickup of 110%. Then, this fabric was dried and thereafter was subjected to heat treatment (curing) at 150° C. for 4 minutes. Subsequently, the fabric was washed with warm water and dried. Properties of the resulting fabric of this invention are shown in Table 2.

EXAMPLE 2

A crude phosphorus amide compound (Lot No. GL-08 manufactured by Nippon Soda Co., Ltd.; phosphorus amide compound: about 36.6% and ammonium chloride: about 63.4%) was dissolved in a 1% aqueous ammonia solution at a crude phosphorus amide compound concentration of 400 g/l. The resulting aqueous solution of phosphorus amide compound was aged at 50° C. for 1 hour and at 20° C. for 10 days and diluted 4.07 times with water. In this diluted solution was dipped a scoured fabric comprising 100% of polynosics and having a basis weight of about 65 g/m$^2$. Then, this fabric was squeezed by mangles to obtain a pickup of 109%. Then, this fabric was dried and thereafter was subjected to heat treatment (curing) at 150° C. for 3 minutes. Subsequently, the fabric was washed with warm water and dried. Properties of the resulting fabric of this invention are shown in Table 2.

EXAMPLE 3

A crude phosphorus amide compound (Lot No. GL-08 manufactured by Nippon Soda Co., Ltd.; phosphorus amide compound: about 36.6% and ammonium chloride: about 63.4%) was dissolved in a 1% aqueous ammonia solution at a crude phosphorus amide compound concentration of 400 g/l. The resulting aqueous solution of phosphorus amide compound was aged at 50° C. for 1 hour and at 20° C. for 10 days and diluted 4.88 times with water. In this diluted solution was dipped a scoured fabric comprising 100% of polynosics and having a basis weight of about 65 g/m$^2$. Then, this fabric was squeezed by mangles to obtain a pickup of 107%. Then, this fabric was dried and thereafter was subjected to heat treatment (curing) at 155° C. for 2 minutes. Subsequently, the fabric was washed with warm water and dried. Properties of the resulting fabric of this invention are shown in Table 2.

EXAMPLE 4

A crude phosphorus amide compound (Lot No. GL-08 manufactured by Nippon Soda Co., Ltd.; phosphorus amide compound: about 36.6% and ammonium chloride: about 63.4%) was dissolved in a 5% aqueous ammonia solution at a crude phosphorus amide compound concentration of 400 g/l. The resulting aqueous solution of phosphorus amide compound was aged at 50° C. for 60 hours and diluted 4.44 times with water. In this diluted solution was dipped a scoured fabric comprising 100% of polynosics and having a basis weight of about 65 g/m$^2$. Then, this fabric was squeezed by mangles to obtain a pickup of 108%. Then, this fabric was dried and thereafter was subjected to heat treatment (curing) at 146° C. for 5 minutes. Subsequently, the fabric was washed with warm water and dried. Properties of the resulting fabric of this invention are shown in Table 2.

EXAMPLE 5

A crude phosphorus amide compound (Lot No. GL-08 manufactured by Nippon Soda Co., Ltd.; phosphorus amide compound: about 36.6% and ammonium chloride: about 63.4%) was dissolved in a 5% aqueous ammonia solution at a crude phosphorus amide compound concentration 400 g/l. The resulting aqueous solution of phosphorus amide compound was aged at 50° C. for 60 hours and diluted 3.57 times with water. In this diluted solution was dipped a scoured fabric comprising 100% of polynosics and having a basis weight of about 65 g/m$^2$. Then, this fabric was squeezed by mangles to obtain a pickup of 111%. Then, this fabric was dried and thereafter was subjected to heat treatment (curing) at 146° C. for 5 minutes. Subsequently, the fabric was washed with warm water and dried. Properties of the resulting fabric of this invention are shown in Table 2.

COMPARATIVE EXAMPLE 1

Example 5 was repeated except that aging was not effected. Properties of the resulting fabric are shown in Table 2.

EXAMPLE 6

A crude phosphorus amide compound (Lot No. HC-16 manufactured by Nippon Soda Co., Ltd.; phosphorus amide compound: about 62.8% and ammonium chloride: about 37.2%) was dissolved in water at a crude phosphorus amide compound concentration of 300 g/l. The resulting aqueous solution of phosphorus amide compound was aged at 50° C. for 1 hour and at 20° C. for 20 days and diluted 5.23 times with water. In this diluted solution was dipped a previously fluorescent-treated fabric comprising 100% of cotton and having a basis weight of about 120 g/m$^2$. Then, this fabric was squeezed by mangles to obtain a pickup of 102%. Then, this fabric was dried and thereafter was subjected to heat treatment (curing) at 150° C. for 4 minutes. Subsequently, the fabric was washed with warm water and dried. Properties of the resulting fabric of this invention are shown in Table 2.

COMPARATIVE EXAMPLE 2

Example 6 was repeated except that aging was not effected and the aqueous solution was diluted 4.19 times with water. Properties of the resulting fabric are shown in Table 2.

EXAMPLE 7

A crude phosphorus amide compound (Lot No. HC-18R manufactured by Nippon Soda Co., Ltd.; phosphorus amide compound: about 61% and ammonium chloride: about 39%) was dissolved in a 3% aqueous ammonia solution at a crude phosphorus amide compound concentration of 300 g/l. The resulting aqueous solution of phosphorus amide compound was aged at 50° C. for 24 hours and diluted 5.90 times with water. In this diluted solution was dipped a previously fluorescent-treated fabric comprising 100% of cotton and having a basis weight of about 120 g/m$^2$. Then, this fabric was squeezed by mangles to obtain a pickup of 100%. Then, this fabric was dried and thereafter was subjected to heat treatment (curing) at 160° C. for 1 minutes. Subsequently, the fabric was washed with warm water and dried. Properties of the resulting fabric of this invention are shown in Table 2.

COMPARATIVE EXAMPLE 3

Example 7 was repeated except that aging was not effected and the aqueous solution was diluted 4.16 times with water. Properties of the resulting fabric are shown in Table 2.

EXAMPLE 8

A crude phosphorus amide compound (Lot No. HA 019 manufactured by Nippon Soda Co., Ltd.; phosphorus amide compound: about 35.8% and ammonium chloride: about 64.2%) was dissolved in a 1% aqueous phosphorus solution at a crude phosphorus amide compound concentration of 400 g/l. The resulting aqueous solution of phosphorus amide compound was aged at 20° C. for 5 days (31P NMR curve of this aqueous solution is shown in FIG. 10) and diluted 4.34 times with water. In this diluted solution was dipped a scoured fabric comprising 100% of polynosics and having a basis weight of about 75 g/m$^2$. Then, this fabric was squeezed by mangles to obtain a pickup of 106%. Then, this fabric was dried and thereafter was subjected to heat treatment (curing) at 150° C. for 4 minutes. Subsequently, the fabric was washed with warm water and dried. Properties of the resulting fabric of this invention are shown in Table 2.

EXAMPLE 9

A crude phosphorus amide compound (Lot No. GK-25 manufactured by Nippon Soda Co., Ltd.; phosphorus amide compound: about 41% and ammonium chloride: about 59%) was dissolved in a 5% aqueous ammonia solution at a crude phosphorus amide concentration of 200 g/l. The resulting aqueous solution of phosphorus amide compound was aged at 5° C. for 60 days and diluted 2.41 times with water. In this diluted solution was dipped a scoured fabric comprising 100% of polynosics and having a basis weight of about 75 g/m$^2$. Then, this fabric was squeezed by mangles to obtain a pickup of 105%. Then, this fabric was dried and thereafter was subjected to heat treatment (curing) at 155° C. for 2 minutes. Subsequently, the fabric was washed with warm water and dried. Properties of the resulting fabric of this invention are shown in Table 2.

EXAMPLE 10

A crude phosphorus amide compound (Lot No. HC-15 manufactured by Nippon Soda Co., Ltd.; phosphorus amide compound: about 36% and ammonium chloride: about 64%) was dissolved in a 1% aqueous diammonium hydrogenphosphate solution at a crude phosphorus amide concentration of 300 g/l. The resulting aqueous solution of phosphorus amide compound was aged at 10° C. for 70 days and diluted 3.60 times with water. In this diluted solution was dipped a dyed fabric comprising 100% of ramie and having a basis weight of about 200 g/m$^2$. Then, this fabric was squeezed by mangles to obtain a pickup of 76%. Then, this fabric was dried and thereafter was subjected to heat treatment (curing) at 150° C. for 3 minutes. Subsequently, the fabric was washed with warm water and dried. Properties of the resulting fabric of this invention are shown in Table 2.

COMPARATIVE EXAMPLE 4

Example 10 was repeated except that aging was not effected and the aqueous solution was diluted 2.70 times with water. Properties of the resulting fabric are shown in Table 2.

TABLE 2

| No. | | Phosphorus amide compound used: Purity (%) | Phosphorus amide compound used: Lot No. | Kind of aqueous solution | Concentration of crude phosphorus amide compound in aqueous solution (g/l) | Aging conditions [°C. × (hr)] [°C. × (day)] | Treated fabric | Concentration of phosphorus amide compound in treating solution (g/l) | Pickup | Curing (°C. × minute) | Washing with warm water | Abrasion resistance (Number of bending): Warp direction | Abrasion resistance (Number of bending): Weft direction | Shrinkage after washing of 45 times (%): Warp direction | Shrinkage after washing of 45 times (%): Weft direction |
|---|---|---|---|---|---|---|---|---|---|---|---|---|---|---|---|
| 1 | Example 1 | 36.6 | GL-08 | 10% ammonia | 400 | 50° C. × 50 hr | Scoured fabric comprising 100% of polynosics and having a basis weight of about 65 g/m$^2$ | 37 | 110 | 150° C. × 4 min | Yes | 232 | 229 | 0.7 | 1.0 |
| 2 | Example 2 | " | " | 1% ammonia | 400 | 50° C. × 1 hr +20° C. × 10 days | Scoured fabric comprising 100% of polynosics and having a basis weight of about 65 g/m$^2$ | 36 | 109 | 150° C. × 3 min | No | 203 | 210 | 0.3 | 0.5 |
| 3 | Example 3 | " | " | 1% ammonia | " | 50° C. × 1 hr +20° C. × 10 days | Scoured fabric comprising 100% of polynosics and having a basis weight of about 65 g/m$^2$ | 30 | 107 | 155° C. × 2 min | Yes | 300 | 215 | 0.3 | 0.5 |
| 4 | Example 4 | " | " | 5% ammonia | " | 50° C. × 60 hr | Scoured fabric comprising 100% of polynosics and having a basis weight of about 65 g/m$^2$ | 33 | 108 | 146° C. × 5 min | Yes | 362 | 287 | 0.3 | 0 |
| 5 | Example 5 | " | " | 5% ammonia | " | " | Scoured fabric comprising 100% of polynosics and having a basis weight of about 65 g/m$^2$ | 41 | 111 | 146° C. × 5 min | Yes | 310 | 245 | 0.3 | 0 |
| 6 | Comparative Example 1 | " | " | 5% ammonia | " | unaged | Scoured fabric comprising 100% of polynosics and having a | 41 | 112 | 146° C. × 5 min | Yes | 145 | 133 | 0.7 | 0.5 |

TABLE 2-continued

| | | | | | | | | | | | | | | | |
|---|---|---|---|---|---|---|---|---|---|---|---|---|---|---|---|
| | | | | | | | basis weight of about 65 g/m$^2$ | | | | | | | | |
| 7 | Example 6 | 62.8 | HC-16 | Water | 300 | 50° C. × 1 hr +20° C. × 20 days | Previously fluorescent-treated fabric comprising 100% of cotton and having a basis weight of about 120 g/m$^2$ | 36 | 102 | 150° C. × 4 min | Yes | 650 | 430 | 0 | 0.3 |
| 8 | Comparative Example 2 | " | " | " | " | Unaged | Previously fluorescent-treated fabric comprising 100% of cotton and having a basis weight of about 120 g/m$^2$ | 45 | 105 | " | Yes | 420 | 295 | 0.3 | 0.3 |
| 9 | Example 7 | 61.0 | HC-18R | 3% ammonia | 300 | 50° C. × 24 hr | Previously fluorescent-treated fabric comprising 100% of cotton and having a basis weight of about 120 g/m$^2$ | 31 | 100 | 160° C. × 1 min | Yes | 750 | 431 | 0.3 | 0.3 |
| 10 | Comparative Example 3 | " | " | 3% ammonia | " | Unaged | Previously fluorescent-treated fabric comprising 100% of cotton and having a basis weight of about 120 g/m$^2$ | 44 | 103 | " | Yes | 520 | 371 | 0 | 0.3 |
| 11 | Example 8 | 35.8 | HA-019 | 1% phosphoric acid | 400 | 20° C. × 5 days | Scoured fabric comprising 100% of polynosics and having a basis weight of about 75 g/m$^2$. | 33 | 106 | 150° C. × 4 min | Yes | 399 | 350 | 0.3 | 0.7 |
| 12 | Example 9 | 41 | GK-25 (a part | 5% ammonia | 200 | 5° C. × 60 days | Scoured fabric com- | 34 | 105 | 155° C. × 2 min | Yes | 420 | 400 | 0.7 | 0.7 |

TABLE 2-continued

| | | | | | | | | | | | | | | | |
|---|---|---|---|---|---|---|---|---|---|---|---|---|---|---|---|
| | | | of amido group has been substituted with-$N(C_2H_5)_2$ group) | | | | prising 100% of polynosics and having a basis weight of about 75 g/m$^2$. | | | | | | | | |
| 13 | Example 10 | 36 | HC-15 | 1% di-ammonium hydrogenphosphate | 300 | 10° C. × 70 days | Dyed fabric comprising 100% of ramie and having a basis weight of about 200 g/m$^2$ | 30 | 76 | 150° C. × 3 min | Yes | 175 | 120 | 1.0 | 0.7 |
| 14 | Comparative Example 4 | " | " | 1% di-ammonium hydrogenphosphate | " | Unaged | Dyed fabric comprising 100% of ramie and having a basis weight of about 200 g/m$^2$ | 40 | 78 | " | Yes | 95 | 78 | 1.0 | 1.0 |

| | | | Bending characteristics | | |
|---|---|---|---|---|---|
| | | | B | 2HB | |
| No. | | Whiteness | Average in warp and weft direction | Average in warp and weft direction | Content of phosphorus in treated fabric (%) |
| 1 | Example 1 | 55 | 0.0235 | 0.0105 | 0.9 |
| 2 | Example 2 | 54 | 0.0213 | 0.0111 | 1.2 |
| 3 | Example 3 | 57 | 0.0205 | 0.0095 | 0.8 |
| 4 | Example 4 | 58 | 0.0241 | 0.0115 | 0.9 |
| 5 | Example 5 | 57 | 0.0239 | 0.0103 | 1.0 |
| 6 | Comparative Example 1 | 51 | 0.0412 | 0.0123 | 0.9 |
| 7 | Example 6 | 123 | 0.0458 | 0.0121 | — |
| 8 | Comparative Example 2 | 115 | 0.0671 | 0.0145 | — |
| 9 | Example 7 | 122 | 0.0461 | 0.0125 | 0.9 |
| 10 | Comparative Example 3 | 111 | 0.0652 | 0.0139 | 1.0 |
| 11 | Example 8 | 59 | 0.0233 | 0.0112 | — |
| 12 | Example 9 | 61 | 0.0181 | 0.0105 | — |
| 13 | Example 10 | — | 0.16 | 0.08 | — |
| 14 | Comparative Example 4 | — | 0.23 | 0.14 | — |

EXAMPLE 11

Fabrics treated in Examples 1-5 and these fabrics which were washed 30 times by the washing method (b) referred to herebefore were used as test fabrics. A portion of these test fabrics were dipped in the staining materials shown in Table 4 and taken out therefrom and were suspended and dried at room temperature for 12 hours. The fabrics stained with blood were washed by domestic washing machine in accordance with Domestic Washing Method: JIS L 0217; method 103 under the following conditions. Bath ratio: 1:30; "NEWBEADS" manufactured by Kao Soap Co.: 0.1%, Temperature: 40° C. (5 minutes); Rinsing: twice (2 minutes) at room temperature, with dehydration and drying. Table 3 shows the results of evaluation of staining of the washed fabrics in accordance with gray scale evaluation method for judging degree of staining of Color Fastness Test of Japanese Standard Society.

In case the staining material is a fluorescent dye, the test fabrics were washed 30 times by domestic washing method of JIS L 0217 method 103 using a domestic washing machine under the following conditions; bath ratio: 1:30; fluorescent agent-containing detergent ("NEWBEADS" manufactured by Kao Soap Co.): 0.2%; temperature: 40° C. (5 minutes); rinsing: twice (2 minutes) at room temperature with dehydration and drying. Table 3 also shows the results of evaluation of staining in accordance with gray scale evaluation method for staining of color fastness test of Japan Standard Society.

COMPARATIVE EXAMPLE 5

The scoured fabric used in Example 1 was subjected to the same treatment as in Example 11 and evaluated in the same manner as in Example 11 (twice). The results are also shown in Table 3.

TABLE 3

| Test fabric | | Staining material | | | | |
|---|---|---|---|---|---|---|
| | | Blood Grade | Worcester sauce | Soy sauce | Ketchup | Fluorescent dye |
| Example 11 | Treated fabric of Example 1 | 4 | 5 | 5 | 5 | 4–5 |
| | Treated fabric of Example 2 | 4 | 5 | 5 | 5 | 4–5 |
| | Treated fabric of Example 3 | 4 | 5 | 5 | 5 | 4–5 |
| | Treated fabric of Example 4 | 4 | 5 | 5 | 5 | 4–5 |
| | Treated fabric of Example 1 washed 30 times | 4 | 5 | 5 | 5 | 4 |
| | Treated fabric of Example 2 washed 30 times | 4 | 5 | 5 | 5 | 4 |
| Comparative Example 5 | Scoured fabric of Example 1 | 2 | 3–4 | 3–4 | 3 | 2 |
| | Scoured fabric of Example 1 | 2 | 3–4 | 3 | 3 | 2 |

EXAMPLE 12

An aqueous solution was prepared which contained 120 g/l of crude amidophosphazene compound (AA-1000A Lot No. GB-005 manufactured by Nippon Soda Co., Ltd.; amidophosphazene compound: about 42% and ammonium chloride: about 58%) and 3 g/l of a nonionic penetrant. This aqueous solution was aged at 35° C. for 3 hours. A dyed fabric of 100% polynosics $$\left(\frac{60/1 \times 60/1}{74 \times 74}\right)$$

was dipped in said aqueous solution and squeezed by mangles to obtain a pickup of 120%. This fabric was then dried at 100° C. for 5 minutes and then heat treated at 150° C. for 3 minutes. Thereafter, the fabric was washed with warm water and dried. Properties of the thus treated fabric are shown in Table 4.

EXAMPLE 13

An aqueous solution was prepared which contained 170 g/l of crude amidophosphazene compound (AA-1000A Lot No. GC-403 manufactured by Nippon Soda Co., Ltd.; amidophosphazene compound: about 42% and ammonium chloride: about 58%) and 3 g/l of a nonionic penetrant and this was aged at 30° C. for 5 hours. In this aqueous solution was dipped a dyed muslin of rayon staple yarns $$\left(\frac{30/1 \times 30/1}{65 \times 60}\right)$$

and this fabric was squeezed by mangles to give a pickup of 100%. Then, this fabric was dried at 100° C. for 5 minutes, then heat treated at 150° C. for 4 minutes and washed with warm water and dried. Properties of the treated fabric of this invention are shown in Table 4.

Effect of aging time on stiffness was examined by changing the aging time in the range of 3-8 hours to recognize no significant difference in stiffness with change of aging time.

EXAMPLE 14

An aqueous solution was prepared which contained 130 g/l of crude amidophosphazene compound (AA-1000A Lot No. GB-0345 manufactured by Nippon Soda Co., Ltd.; amidophosphazene compound: about 42% and ammonium chloride: about 58%) and 2 g/l of a nonionic penetrant and this was aged at 15° C. for 9 hours. A dyed fabric of 100% polynosic $$\left(\frac{60/1 \times 60/1}{75 \times 68}\right)$$

was dipped in said aged aqueous solution and squeezed by mangles to give a pickup of 115%. This fabric was then dried at 100° C. for 7 hours and thereafter heat treated at 155° C. for 2.5 minutes. Then, this was washed with warm water and dried. Properties of the treated fabric of this invention are shown in Table 4.

EXAMPLE 15

An aqueous solution was prepared which contained 55 g/l of crude amidophosphazene compound (AA-3000A Lot No. GB-025 manufactured by Nippon Soda Co., Ltd.; amidophosphazene compound: about 97.1% and ammonium chloride: about 2.9%) and 10 g/l of phosphoric acid and this was aged at 45° C. for 2 hours. A dyes fabric of 100% polynosics $$\left(\frac{60/1 \times 60/1}{75 \times 68}\right)$$

was dipped in said aqueous solution and squeezed by mangles to give a pickup of 111%. The fabric was dried at 105° C. for 5 minutes and then heat treated at 160° C. for 2 minutes. Thereafter, the fabric was washed with warm water and dried. Properties of the treated fabric of this invention are shown in Table 4.

COMPARATIVE EXAMPLE 6

Example 12 was repeated except that the aging of aqueous solution was not effected. Properties of the treated fabric are shown in Table 4.

COMPARATIVE EXAMPLE 7

Example 13 was repeated except that the aging was not effected. Properties of the treated fabric are shown in Table 4.

COMPARATIVE EXAMPLE 8

The same muslin of rayon staple yarns as used in Example 13 was dipped in an aqueous solution containing 100 g/, of a commercially available non-formalin type resin treating agent BECKAMINE NF-5 (manufactured by Dainippon Ink & Chemicals Inc.), 40 g/l of catalyst GT (manufactured by Dainippon Ink & Chemicals Inc.) and 3 g/l of a nonionic penetrant and was squeezed by mangles to give a pickup of 95%. This fabric was dried at 100° C. for 5 minutes and then heat treated at 155° C. for 2 minutes. Properties of the treated fabric are shown in Table 4.

COMPARATIVE EXAMPLE 9

Example 14 was repeated except that aging of the aqueous solution was not carried out. Properties of the treated fabric are shown in Table 4.

COMPARATIVE EXAMPLE 10

Example 15 was repeated except that aging of the aqueous solution was not carried out. Properties of the treated fabric are shown in Table 4.

TABLE 4

| | Free formaldehyde (μg/g) | Content of phosphorus (%) | Shrinkage after washing of 40 times (%) | | Stiffness |
|---|---|---|---|---|---|
| | | | Warp direction | Weft direction | Clerk method Bias (mm) |
| Example | | | | | |
| 12 | 1 | 1.5 | 0.5 | 1.0 | 31 |
| 13 | 2 | 1.5 | 2.0 | 2.5 | 38 |
| 14 | 1 | 1.6 | 0.5 | 0.5 | 33 |
| 15 | 2 | 1.7 | 0 | 1.0 | 32 |
| Comparative Example | | | | | |
| 6 | 1 | 1.4 | 0.5 | 0.5 | 35 |
| 7 | 1 | 1.5 | 2.5 | 2.0 | 41 |
| 8 | 3 | — | 6.0 | 3.5 | 45 |
| 9 | 1 | 1.5 | 1.0 | 1.0 | 40 |
| 10 | 1 | 1.5 | 0.5 | 0.5 | 41 |

EXAMPLE 16

A crude amidophosphazene compound (Lot No. FC-028 manufactured by Nippon Soda Co., Ltd.; amidophosphazene compound: about 42% and ammonium chloride: about 58%) was dissolved in a 1% aqueous ammonia solution at a crude amidophosphazene concentration of 400 g/l. The resulting aqueous solution of amidophosphazene compound was aged at 50° C. for 23 hours (31P NMR curve of this aqueous solution is shown in FIG. 9) and diluted 4.42 times with water. In this diluted solution was dipped a scoured fabric comprising 100% of polynosics and having a basis weight of about 70 g/m$^2$. Then, this fabric was squeezed by mangles to obtain a pickup of 112%. Then, this fabric was dried and thereafter was subjected to heat treatment (curing) at 150° C. for 4 minutes. Subsequently, the fabric was washed with warm water and dried. Properties of the resulting fabric of this invention are shown in Table 5.

EXAMPLE 17

A crude amidophosphazene compound (Lot No. FC-028 manufactured by Nippon Soda Co., Ltd.; amidophosphazene compound: about 42% and ammonium chloride: about 58%) was dissolved in a 0.1% aqueous ammonia solution at a crude amidophosphazene concentration of 400 g/l. The resulting aqueous solution of amidophosphazene compound was aged at 50° C. for 24 hours and diluted 4.42 times with water. In this diluted solution was dipped a scoured fabric comprising 100% of polynosics and having a basis weight of about 70 g/m$^2$. Then, this fabric was squeezed by mangles to obtain a pickup of 114%. Then, this fabric was dried and thereafter was subjected to heat treatment (curing) at 150° C. for 3 minutes. Subsequently, the fabric was washed with warm water and dried. Properties of the resulting fabric of this invention are shown in Table 5.

EXAMPLE 18

A crude amidophosphazene compound (Lot No. FC-028 manufactured by Nippon Soda Co., Ltd.; amidophosphazene compound: about 42% and ammonium chloride: about 58%) was dissolved in a 1% aqueous sodium carbonate solution at a crude amidophosphazene concentration of 400 g/l. The resulting aqueous solution of amidophosphazene compound was aged at 50° C. for 24 hours and diluted 4.42 times with water. In this diluted solution was dipped a scoured fabric comprising 100% of polynosics and having a basis weight of about 70 g/m$^2$. Then, this fabric was squeezed by mangles to obtain a pickup of 111%. Then, this fabric was dried and thereafter was subjected to heat treatment (curing) at 155° C. for 3 minutes. Subsequently, the fabric was washed with warm water and dried. Properties of the resulting fabric of this invention are shown in Table 5.

EXAMPLE 19

A crude amidophosphazene compound (Lot No. FC-028 manufactured by Nippon Soda Co., Ltd.; amidophosphazene compound: about 42% and ammonium chloride: about 58%) was dissolved in water at a crude amidophosphazene concentration of 400 g/l. The resulting aqueous solution of amidophosphazene compound was aged at 50° C. for 48 hours and diluted 4.42 times with water. In this diluted solution was dipped a scoured fabric comprising 100% of polynosics and having a basis weight of about 70 g/m$^2$. Then, this fabric was squeezed by mangles to obtain a pickup of 115%. Then, this fabric was dried and thereafter was subjected to heat treatment (curing) at 145° C. for 5 minutes. Subsequently, the fabric was washed with warm water and dried. Properties of the resulting fabric of this invention are shown in Table 5.

COMPARATIVE EXAMPLE 11

Example 19 was repeated except that aging was not effected (31P NMR curve of this aqueous solution is shown in FIG. 6) and the aqueous solution was diluted 3.36 times with water. Properties of the resulting fabric are shown in Table 5.

EXAMPLE 20

A crude amidophosphazene compound (Lot No. GB-003 manufactured by Nippon Soda Co., Ltd.; amidophosphazene compound: about 42% and ammonium chloride: about 58%) was dissolved in 14% aqueous ammonia solution at a crude amidophosphazene concentration of 400 g/l. The resulting aqueous solution of amidophosphazene compound was aged at 50° C. for 24 hours (31P NMR curve of this aqueous solution is shown in FIG. 5) and diluted 4.80 times with water. In this diluted solution was dipped a scoured fabric comprising 100% of polynosics and having a basis weight of about 70 g/m$^2$. Then, this fabric was squeezed by mangles to obtain a pickup of 112%. Then, this fabric was dried and thereafter was subjected to heat treatment (curing) at 150° C. for 4 minutes. Subsequently, the fabric was washed with warm water and dried. Properties of the resulting fabric of this invention are shown in Table 5.

EXAMPLE 21

A crude amidophosphazene compound (Lot No. GB-003 manufactured by Nippon Soda Co., Ltd.; amidophosphazene compound: about 42% and ammonium chloride: about 58%) was dissolved in 0.5% aqueous phosphoric acid solution at a crude amidophosphazene concentration of 400 g/l. The resulting aqueous solution of amidophosphazene compound was aged at 45° C. for 16 hours and diluted 4.31 times with water. In this diluted solution was dipped a scoured fabric comprising 100% of polynosics and having a basis weight of about 70 g/m$^2$. Then, this fabric was squeezed by mangles to obtain a pickup of 113%. Then, this fabric was dried and thereafter was subjected to heat treatment (curing) at 150° C. for 4 minutes. Subsequently, the fabric was washed with warm water and dried. Properties of the resulting fabric of this invention are shown in Table 5.

EXAMPLE 22

A crude amidophosphazene compound (Lot No. GB-003 manufactured by Nippon Soda Co., Ltd.; amidophosphazene compound: about 42% and ammonium chloride: about 58%) was dissolved in water at a crude amidophosphazene concentration of 400 g/l. The resulting aqueous solution of amidophosphazene compound was aged at 20° C. for 30 days and diluted 4.67 times with water. In this diluted solution was dipped a scoured fabric comprising 100% of polynosics and having a basis weight of about 70 g/m$^2$. Then, this fabric was squeezed by mangles to obtain a pickup of 115%. Then, this fabric was dried and thereafter was subjected to heat treatment (curing) at 150° C. for 4 minutes. Subsequently, the fabric was washed with warm water and dried. Properties of the resulting fabric of this invention are shown in Table 5.

COMPARATIVE EXAMPLE 12

Example 22 was repeated except that aging was not effected (31P NMR curve of this unaged aqueous solution is shown in FIG. 11) and the aqueous solution was diluted 3.29 times with water. Properties of the resulting fabric are shown in Table 5.

EXAMPLE 23

An amidophosphazene compound (Lot No. FB-03 manufactured by Nippon Soda Co., Ltd.; amidophosphazene compound: about 94% and ammonium chloride: about 6%) was dissolved in an aqueous solution containing 1% of ammonia and 5% of magnesium chloride at a amidophosphazene concentration of 400 g/l. The resulting aqueous solution of amidophosphazene compound was aged at 10° C. for 80 days and diluted 9.4 times with water. In this diluted solution was dipped a scoured fabric comprising 100% of polynosics and having a basis weight of about 70 g/m$^2$. Then, this fabric was squeezed by mangles. Then, this fabric was dried and thereafter was subjected to heat treatment (curing) at 155° C. for 3 minutes. Subsequently, the fabric was washed with warm water and dried. Properties of the resulting fabric of this invention are shown in Table 5.

COMPARATIVE EXAMPLE 13

Example 23 was repeated except that aging was not effected. Properties of the resulting fabric are shown in Table 5.

EXAMPLE 24

A crude amidophosphazene compound (Lot No. GH-605 manufactured by Nippon Soda Co., Ltd.; amidophosphazene compound: about 42% and ammonium chloride: about 58%) was dissolved in 2% aqueous ammonium acetate solution at a crude amidophosphazene concentration of 350 g/l. The resulting aqueous solution of amidophosphazene compound was aged at 50° C. for 120 days and diluted 4.20 times with water. In this diluted solution was dipped a dyed fabric comprising 100% of ramie and having a basis weight of about 200 g/m$^2$. Then, this fabric was squeezed by mangles to obtain a pickup of 80%. Then, this fabric was dried and thereafter was subjected to heat treatment (curing) at 145° C. for 6 minutes. Subsequently, the fabric was washed with warm water and dried. Properties of the resulting fabric of this invention are shown in Table 5.

COMPARATIVE EXAMPLE 14

Example 24 was repeated except that aging was not effected and the aqueous solution was diluted 2.94 times. Properties of the resulting fabric are shown in Table 5.

EXAMPLE 25

A crude amidophosphazene compound (Lot No. EL-20 manufactured by Nippon Soda Co., Ltd.; amidophosphazene compound: about 58% and ammonium chloride: about 42%) was dissolved in 1% aqueous diammonium hydrogenphosphate solution at a crude amidophosphazene concentration of 200 g/l. The resulting aqueous solution of amidophosphazene compound was aged at 15° C. for 60 days and diluted 1.66 times with water. In this diluted solution was dipped a fabric comprising 100% of cotton and having a basis weight of about 170 g/m$^2$. Then, this fabric was squeezed by mangles to obtain a pickup of 85%. Then, this fabric was dried and thereafter was subjected to heat treatment (curing) at 155° C. for 3 minutes. Subsequently, the fabric was washed with warm water and dried. Properties of the resulting fabric of this invention are shown in Table 5.

COMPARATIVE EXAMPLE 15

Example 25 was repeated except that aging was not effected and the aqueous solution was diluted 1.36 times. Properties of the resulting fabric are shown in Table 5.

TABLE 5

| No. | | Amidophosphazene compound used: Purity (%) | Amidophosphazene compound used: Lot No. | Kind of aqueous solution | Concentration of crude amidophosphazene compound in aqueous solution (g/l) | Aging conditions °C. × (hr) (day) | Treated fabric | Concentration of amidophosphazene compound in treating solution (g/l) |
|---|---|---|---|---|---|---|---|---|
| 1 | Example 16 | 42 | FC-028 | 1% ammonia | 400 | 50° C. × 30 hr | Scoured fabric comprising 100% of polynosics and having a basis weight of about 70 g/m$^2$. | 38 |
| 2 | Example 17 | " | " | 0.1% ammonia | 400 | 50° C. × 24 hr | Scoured fabric comprising 100% of polynosics and having a basis weight of about 70 g/m$^2$. | 38 |
| 3 | Example 18 | " | " | 1% sodium carbonate | 400 | 50° C. × 24 hr | Scoured fabric comprising 100% of polynosics and having a basis weight of about 70 g/m$^2$. | 38 |
| 4 | Example 19 | " | " | Water | 400 | 50° C. × 48 hr | Scoured fabric comprising 100% of polynosics and having a basis weight of about 70 g/m$^2$. | 38 |
| 5 | Comparative Example 11 | " | " | Water | 400 | Unaged | Scoured fabric comprising 100% of polynosics and having a basis weight of about 70 g/m$^2$. | 50 |
| 6 | Example 20 | 42 | GB-003 | 14% ammonia | 400 | 50° C. × 12 hr + 20° C. × 20 days | Scoured fabric comprising 100% of polynosics and having a | 35 |

TABLE 5-continued

| | | | | | | | | | |
|---|---|---|---|---|---|---|---|---|---|
| | | | | | | | basis weight of about 70 g/m². | | |
| 7 | Example 21 | " | " | 0.5% phosphoric acid | 400 | 45° C. × 16 hr | Scoured fabric comprising 100% of polynosics and having a basis weight of about 70 g/m². | 39 | |
| 8 | Example 22 | " | " | Water | 400 | 20° C. × 30 days | Scoured fabric comprising 100% of polynosics and having a basis weight of about 70 g/m². | 36 | |
| 9 | Comparative Example 12 | " | " | Water | 400 | Unaged | Scoured fabric comprising 100% of polynosics and having a basis weight of about 70 g/m². | 51 | |
| 10 | Example 23 | 94% | FB-03 | 1% ammonia + 5% magnesium chloride | 400 | 10° C. × 80 days | Scoured fabric comprising 100% of polynosics and having a basis weight of about 70 g/m². | 40 | |
| 11 | Comparative Example 13 | " | " | 1% ammonia + 5% magnesium chloride | 400 | Unaged | Scoured fabric comprising 100% of polynosics and having a basis weight of about 70 g/m². | 40 | |
| 12 | Example 24 | 42 | GH-605 | 2% ammonium acetate | 350 | 5° C. × 120 days | Dyed fabric comprising 100% of ramie and having a basis weight of about 200 g/m². | 35 | |
| 13 | Comparative Example 14 | " | " | 2% ammonium acetate | 350 | Unaged | Dyed fabric comprising 100% of ramie and having a basis weight of about 200 g/m². | 50 | |
| 14 | Example 25 | 58 | EL-20 | di-ammonium hydrogen phosphate | 200 | 15° C. × 60 days | Previously fluorescent-treated fabric comprising 100% of cotton and having a basis weight of about 170 g/m² | 70 | |
| | | A part of amido group was substituted with methoxy group | | | | | | | |
| 15 | Comparative Example 15 | 58 | EL-20 | di-ammonium hydrogen phosphate | 200 | Unaged | Previously fluorescent-treated fabric comprising 100% of cotton and having a basis weight of about 170 g/m² | 85 | |
| | | A part of amido group was substituted with methoxy group | | | | | | | |

| No. | Pick-up | Curing (°C. × minute) | Washing with warm water | Abrasion resistance (Number of bending) Warp direction | Abrasion resistance (Number of bending) Weft direction | Shrinkage after washing of 45 times (%) Warp direction | Shrinkage after washing of 45 times (%) Weft direction | Whiteness | Bending characteristics B Average in warp and weft direction | Bending characteristics 2HB Average in warp and weft direction | Content of phosphorus in treated fabric (%) |
|---|---|---|---|---|---|---|---|---|---|---|---|
| 1 | 112 | 150° C. × | Yes | 304 | 243 | 0.3 | 1.0 | 58 | 0.0270 | 0.0115 | 1.0 |

TABLE 5-continued

| | | | | | | | | | | | |
|---|---|---|---|---|---|---|---|---|---|---|---|
| 2 | 114 | 4 min 150° C. × 3 min | No | 430 | 331 | 0 | 0.5 | 59 | 0.0310 | 0.0145 | 1.3 |
| 3 | 111 | 155° C. × 3 min | Yes | 295 | 305 | 0.3 | 0.5 | 59 | 0.0251 | 0.0111 | 0.9 |
| 4 | 115 | 145° C. × 5 min | Yes | 426 | 279 | 0.3 | 0.5 | 57 | 0.0240 | 0.0101 | 1.1 |
| 5 | 116 | 145° C. × 5 min | Yes | 283 | 132 | 0.3 | 0.5 | 54 | 0.0955 | 0.0305 | 1.1 |
| 6 | 112 | 150° C. × 4 min | Yes | 402 | 310 | 0 | 0.7 | 59 | 0.0260 | 0.0110 | — |
| 7 | 113 | 150° C. × 4 min | Yes | 365 | 258 | 0.3 | 0.7 | 58 | 0.0291 | 0.0117 | — |
| 8 | 115 | 150° C. × 4 min | Yes | 385 | 301 | 0.3 | 0.5 | 59 | 0.0301 | 0.0161 | — |
| 9 | 117 | 150° C. × 4 min | Yes | 299 | 210 | 0.3 | 0.7 | 52 | 0.0611 | 0.0215 | — |
| 10 | — | 155° C. × 3 min | Yes | 411 | 315 | 0 | 1.0 | 63 | 0.0215 | 0.0095 | 1.0 |
| 11 | — | 155° C. × 3 min | Yes | 360 | 210 | 1.0 | 1.0 | 57 | 0.0375 | 0.0130 | 0.8 |
| 12 | 80 | 145° C. × 6 min | Yes | 120 | 80 | 1.0 | 1.0 | — | 0.18 | 0.09 | 0.6 |
| 13 | 81 | 145° C. × 6 min | Yes | 79 | 51 | 1.0 | 1.0 | — | 0.26 | 0.17 | 0.7 |
| 14 | 85 | 155° C. × 3 min | Yes | 950 | 830 | 0 | 0.5 | 120 | 0.081 | 0.011 | 1.0 |
| 15 | 87 | 155° C. × 3 min | Yes | 800 | 615 | 0.3 | 0.5 | 107 | 0.095 | 0.015 | 1.1 |

EXAMPLE 26

Fabrics treated in Examples 16–20 and these fabrics which were washed 30 times by the washing method (b) referred to herebefore were used as test fabrics. A portion of these test fabrics were dipped in blood, Worcester sauce, soy sauce, ketchup and fluorescent dye and taken out therefrom and were suspended and dried at room temperature for 12 hours. These stained fabrics were washed by domestic washing machine in accordance with Domestic Washing Method: JIS L 0217; method 103 under the following conditions. Bath ratio: 1:30; Detergent "NEWBEADS" manufactured by Kao Soap Co.: 0.1%; Temperature: 40° C. (5 minutes); Rinsing: twice (2 minutes) at room temperature, with dehydration and drying. Table 5 shows the results of evaluation of staining of the washed fabrics in accordance with gray scale evaluation method for judging degree of staining of Color Fastness Test of Japanese Standard Society.

In case the staining material is a fluorescent dye, the test fabrics were washed 30 times by domestic washing method of JIS L 0217 method 103 using a domestic washing machine under the following conditions; bath ratio: 1:30; fluorescent agent-containing detergent ("NEWBEADS" manufactured by Kao Soap Co.): 0.2%; temperature: 40° C. (5 minutes); rinsing: twice (2 minutes) at room temperature with dehydration and drying. Table 5 also shows the results of evaluation of staining in accordance with gray scale evaluation method for staining of Color Fastness Test of Japan Standard Society.

COMPARATIVE EXAMPLE 16

The scoured fabric used in Example 16 was subjected to the same treatment as in Example 26 and evaluated in the same manner as in Example 26. The results are also shown in Table 6.

TABLE 6

| | | Staining material | | | | |
|---|---|---|---|---|---|---|
| | Test fabric | Blood Grade | Worcester sauce | Soy sauce | Ketchup | Fluorescent dye |
| Example 26 | Treated fabric of Example 16 | 4 | 5 | 5 | 5 | 4–5 |
| | Treated fabric of Example 17 | 4 | 5 | 5 | 5 | 4–5 |
| | Treated fabric of Example 18 | 4 | 5 | 5 | 5 | 4–5 |
| | Treated fabric of Example 19 | 4 | 5 | 5 | 5 | 4–5 |
| | Treated fabric of Example 16 washed 30 times | 4 | 5 | 5 | 5 | 4 |
| | Treated fabric of Example 17 washed 30 times | 4 | 5 | 5 | 5 | 4 |
| Comparative Example 16 | Scoured fabric of Example 16 | 2 | 3–4 | 3–4 | 3 | 2 |

As is clear from the above Examples and Comparative Examples, when cases where aged phosphorus amide compound or aged amidophosphazene compound was used according to the present invention are compared with cases where unaged phosphorus amide compound or unaged amidophosphazene compound was used, no conspicuous difference is seen in shrinkage of fabric after washing 45 times, but there are considerable differences in abrasion resistance and bending properties and the results according to the present invention are superior to those of comparative examples.

Whiteness of the fabrics treated according to the present invention is also improved.

Furthermore, as is clear from Tables 3 and 6, the fabrics treated according to the present invention have markedly excellent resistance against staining with fluorescent dye, human blood, sauces and the like.

Besides, muslin of staple fibers dyed and washed 45 times shows a shrinkage in the warp direction of about 14% and if the fabric is treated with commercially available non-formalin resin treating agent, the shrinkage is improved to about 6% (Comparative Example 8 in Table 4) while when it is treated according to the present invention, the shrinkage can be further improved to about 2% (Example 13 in Table 4).

Thus, various properties are improved according to the present invention and hand of fabric treated is soft because the treating agent is of no-formalin type. Therefore, the fabrics treated are useful as clothes which directly contact with skin such as clothes for baby, pajamas, lingerie, bed sheets, blouses, shirts and the like.

What is claimed is:

1. A treating agent for cellulosic materials which comprises an aqueous solution of an aged phosphorus amide compound or an aged amidophosphazene compound, said phosphorus amide compound being at least one compound selected from the group consisting of a phosphoryl triamide, a phosphoryl triamide condensate and a derivative thereof in which the amido group is substituted with an alkoxy group, a substituted amino group, an ammonium-oxy group, a hydroxyl group or chlorine, and said amidophosphazene compound being a cyclic amidophosphazene compound represented by the formula:

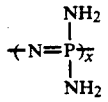

wherein x is an integer of 3 or more provided that the compound can be perfectly dissolved in water, the formula $P_nN_n(NH_2)_{2n+2}$ wherein n is an integer of 1 or more provided that the compound can be perfectly dissolved in water, or the formula $P_nN_{n-1}(NH_2)_{2n+3}$ wherein n is an integer of 2 or more provided that the compound can be perfectly dissolved in water.

2. A treating agent according to claim 1 wherein the phosphorus amide compound is a crude phosphorus amide compound.

3. A treating agent according to claim 1 wherein the amidophosphazene compound is a crude amidophosphazene compound.

4. A treating agent according to claim 1 wherein the alkoxy group, substituted amino group, ammonium-oxy group, hydroxyl group or chlorine is selected from the group consisting of $-OCH_3$, $-OC_2H_5$, $-OC_3H_7$, $-OC_4H_9$, $-OC_5H_{11}$, -continued

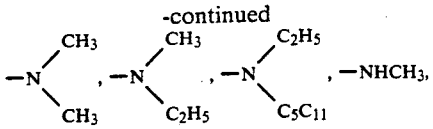

$-NHC_2H_5$, $-ONH_4$, $-OH$ and $-Cl$.

5. A method for treating cellulosic materials which comprises dipping the material in an aqueous solution of an aged phosphorus amide compound or an aged amidophosphazene compound as a treating agent or spraying or coating said aqueous solution to or on the material, and then squeezing the material as it is or by roll or mangle, and then heat treating the material, said phosphorus amide compound being at least one compound selected from the group consisting of a phosphoryl triamide, a phosphoryl triamide condensate and a derivative thereof in which the amido group is substituted with an alkoxy group, a substituted amino group, an ammonium-oxy group, a hydroxyl group or chlorine, and said amidophosphazene compound being a cyclic amidophosphazene compound represented by the formula:

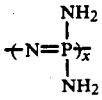

wherein x is an integer of 3 or more provided that the compound can be perfectly dissolved in water, the formula $P_nN_n(NH_2)_{2n+2}$ wherein n is an integer of 1 or more provided that the compound can be perfectly dissolved in water, or the formula $P_nN_{n-1}(NH_2)_{2n+3}$ wherein n is an integer of 2 or more provided that the compound can be perfectly dissolved in water.

6. A method according to claim 5 wherein the weight gain of the treating agent is 2–7% by weight of the starting cellulosic material.

7. A method according to claim 5 wherein the phosphorus amide compound is a crude phosphorus amide compound.

8. A method according to claim 5 wherein the amidophosphazene compound is a crude amidophosphazene compound.

9. A method according to claim 5 wherein the alkoxy group, substituted amino group, ammonium-oxy group, hydroxyl group or chlorine is selected from the group consisting of $-OCH_3$, $-OC_2H_5$, $-OC_3H_7$, $-OC_4H_9$, $-OC_5H_{11}$,

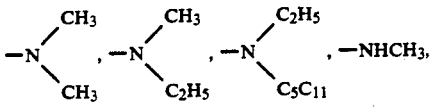

$-NHC_2H_5$, $-ONH_4$, $-OH$ and $-Cl$.

10. A cellulosic material treated by the method of claim 5.

11. A cellulosic material according to claim 10 which has 0.3–2.0% by weight of phosphorus itself based on the weight of the treated cellulosic material.

* * * * *